US011874025B2

(12) United States Patent
Suetsugu

(10) Patent No.: US 11,874,025 B2
(45) Date of Patent: Jan. 16, 2024

(54) AIR CURTAIN APPARATUS

(71) Applicant: Katsunori Suetsugu, Tokyo (JP)

(72) Inventor: Katsunori Suetsugu, Tokyo (JP)

( * ) Notice: Subject to any disclaimer, the term of this patent is extended or adjusted under 35 U.S.C. 154(b) by 169 days.

(21) Appl. No.: 17/448,827

(22) Filed: Sep. 24, 2021

(65) Prior Publication Data

US 2022/0163223 A1 May 26, 2022

(30) Foreign Application Priority Data

Nov. 24, 2020 (JP) ..... 2020-194073
Apr. 8, 2021 (JP) ..... 2021-065799
Apr. 8, 2021 (JP) ..... 2021-065800

(51) Int. Cl.
*F24F 7/06* (2006.01)
*F24F 11/74* (2018.01)
(Continued)

(52) U.S. Cl.
CPC ..... *F24F 7/06* (2013.01); *F24F 8/20* (2021.01); *F24F 11/74* (2018.01);
(Continued)

(58) Field of Classification Search
CPC ..... F24F 7/06; F24F 8/20; F24F 11/74; F24F 2009/007; F24F 2120/12; F24F 2221/02; F24F 9/00
(Continued)

(56) References Cited

U.S. PATENT DOCUMENTS 3,827,862 A * 8/1974 Berlant ..... A61L 9/20 422/121
4,123,967 A * 11/1978 Shanis ..... F24F 9/00 285/125.1
(Continued)

FOREIGN PATENT DOCUMENTS

EP 2942577 A1 * 11/2015 ..... F24F 9/00
JP 1973026208 U 7/1973
(Continued)

*Primary Examiner* — Avinash A Savani
*Assistant Examiner* — Dana K Tighe
(74) *Attorney, Agent, or Firm* — Simpson & Simpson, PLLC; S. Peter Konzel

(57) ABSTRACT

[SUMMARY]
[Problems to be Solved]
To provide an air curtain apparatus that is small and simple, capable of separating a space, and capable of preventing entry of foreign matters such as droplets from one subspace into the other subspace.
[Solution]
An air curtain apparatus 1 includes a plurality of blowers 11 arrayed in an up-down direction and a plurality of second blowers 21 arrayed in the up-down direction. An air inlet port 23 included in the blower 21 faces an air outlet port 14 included in the blower 11. In a pair of the blower 11 and the blower 21, the blower 11 blows out a helical air current SA1 from the air outlet port 14, and the blower 21 sucks in the helical air current SA1 from the air inlet port 23. The air curtain apparatus 1 forms an air curtain AC1 with a plurality
(Continued)

of the helical air currents SA1, the plurality of the helical air currents SA1 being blown from the plurality of the air outlet ports 14 and sucked into the plurality of air inlet ports 23.

26 Claims, 30 Drawing Sheets

(51) Int. Cl.
*F24F 8/20* (2021.01)
*F24F 120/12* (2018.01)
*F24F 9/00* (2006.01)

(52) U.S. Cl.
CPC ..... *F24F 2009/007* (2013.01); *F24F 2120/12* (2018.01); *F24F 2221/02* (2013.01)

(58) Field of Classification Search
USPC ..... 454/341
See application file for complete search history.

(56) References Cited

U.S. PATENT DOCUMENTS

| | | | | |
|---|---|---|---|---|
| 8,376,822 | B1 * | 2/2013 | Smith | A61N 7/02 454/188 |
| 2009/0291627 | A1 * | 11/2009 | Zimmermann | F24F 9/00 700/275 |
| 2017/0080465 | A1 * | 3/2017 | Ding | E05F 15/60 |
| 2022/0054699 | A1 * | 2/2022 | Nakama | F24F 7/003 |

FOREIGN PATENT DOCUMENTS

| | | | |
|---|---|---|---|
| JP | 1974017778 | U | 5/1975 |
| JP | 19979187567 | A | 7/1997 |
| JP | 2002213390 | A | 7/2002 |
| JP | 2008174081 | A | 7/2008 |
| JP | 2008188188 | A | 8/2008 |
| JP | 2017025472 | A | 2/2017 |
| KR | 20150118464 | A | 10/2015 |
| WO | 2016157675 | A1 | 10/2016 |

* cited by examiner (FLOWCHART OF VENTILATION PROCESS PERFORMED BY CONTROLLER 200)

AIR CURTAIN APPARATUS

TECHNICAL FIELD

The present invention relates to an air curtain apparatus that forms an air curtain.

BACKGROUND ART

In recent years, cases of pandemic viral or bacterial infectious diseases have been increasing. Examples of such infectious diseases include a new corona virus infection. In addition, in restaurants and other shops, as well as medical treatment facilities and nursing-care facilities, or the like, there are instances in which a plurality of persons face each other, have conversations, or eat and drink, with a short distance between each other. In such instances, and if one person is infected with the above-mentioned infectious disease, there is a risk that breathing, speech, coughing or sneezing or the like of that infected person disperses droplets such as saliva from the mouth of that infected person, and other person, more specifically, a person who faces that infected person may inhale from the nose or the mouth the droplets dispersed from that infected person.

As a method of preventing droplets from dispersing among a plurality of persons, it is desirable that when the plurality of persons face each other, or the like, all of them wear a mask. However, there are some instances where the plurality of persons is not able to wear a mask if conversations are difficult to hear while drinking and eating, for example, or in the case of identity confirmation. In addition, in a case where a shielding plate made of a glass or a resin or the like is installed between a plurality of persons, it may be difficult for the plurality of persons facing each other to have conversations in a quiet voice, for example, or impossible to hand over a good.

On the other hand, use of an air curtain apparatus instead of the shielding plate is conceivable that separates a certain space by belt-like air flow, more specifically, an air current, thereby dividing that space into two subspaces, and prevents entry of foreign matters such as droplets or the like from one subspace to the other subspace, for example, In Japanese Unexamined Patent Application Publication No. 2011-137588 (Patent Literature 1), there is disclosed a technique of forming an air curtain between a first space and a second space, in a droplet blocking air curtain apparatus that is provided between the first space where a first person is present and the second space where a second person is present and that prevents movement of droplets between the first space and the second space, wherein the air curtain apparatus has columnar members that stand upright facing each other, one of the columnar members having an air blow port that discharges air zonally and the other of the columnar members having an intake port that sucks in air zonally.

In Japanese Unexamined Patent Application Publication No. 2011-30719 (Patent Literature 2), there is disclosed a technique of providing an air curtain generating unit that delivers an antibacterial air curtain to a predetermined position inside a storing part designated by a given command in an air curtain apparatus that delivers the air curtain to the inside of the storing part that accommodates people.

In Japanese Unexamined Patent Application Publication No. 2007-10184 (Patent Literature 3), there is disclosed a technique of forming an air barrier that circulates between a right housing and a left housing, by providing a plurality of pairs of air channels, in which an air outlet port is arranged on one side of and an air inlet port is arranged on the other side of a surface where the right and left housings meet, in a gate-type air curtain including the housings, each of which holds the air outlet port and the air inlet port being erected and spaced apart to the right and left, and a top board connecting these housings. In the technique described in the above-mentioned Patent Literature 3, there is provided side-by-side a plurality of centrifugal fans units, the centrifugal fan unit including a motor, a centrifugal fan, a scroll or the like which are communicated with the air outlet port.

CITATION LIST

Patent Literature

[PTL 1] Japanese Unexamined Patent Application Publication No. 2011-137588

[PTL 2] Japanese Unexamined Patent Application Publication No. 2011-30719

[PTL 3] Japanese Unexamined Patent Application Publication No. 2011-10184

SUMMARY OF THE INVENTION

Problems to be Solved by the Invention

In the techniques described in the above-mentioned Patent Literature 1 to Patent Literature 3, there is a problem that use of a large or complicated air curtain apparatus is necessary to efficiently separate and divide a certain space into two subspaces and to prevent entry of foreign matters such as droplets from one subspace to the other subspace, for example. In addition, there is another problem that use of such a large or complicated air curtain apparatus does not allow the air curtain apparatus to be easily installed or easily moved. In the technique described in Patent Literature 1, in particular, there is a problem that the columnar parts have to be positioned so that belt-like air discharged from the air blow port on the one columnar member is sucked in by the air intake port on the other columnar member, which does not allow for easy installation of the air curtain apparatus.

On the other hand, there is also a problem that simply using a small and simple air curtain apparatus does not make it possible to efficiently separate and divide a certain space, and to efficiently prevent entry of foreign matters from one subspace to the other subspace.

The present invention has been made in order to solve the above-mentioned problems of the prior-art. The present invention has an objective of providing an air curtain apparatus, wherein simply using a small and simple air curtain apparatus makes it possible to efficiently separate and divide a certain space and to efficiently prevent entry of foreign matters such as droplets from one subspace to the other subspace.

Means for Solving the Problems

A brief and schematic description of typical inventions disclosed in the present application, is given below:

An air curtain apparatus as one aspect of the present invention is an air curtain apparatus that forms an air curtain. The air curtain apparatus includes a plurality of first blowers being arrayed in an up-down direction and each including a first air inlet port in which air is sucked and a first air outlet port from which air is blown out; and a plurality of second blowers being arrayed in the up-down direction, each including a second air inlet port in which air is sucked and a second air outlet port from which air is blown out, and, in a plan view, the second air inlet port each facing the first air outlet port included in each of the plurality of first blowers. In a pair of the first blower and the second blower, the first blower blows out a helical air current from the first air outlet port included in the first blower toward the second air inlet port included in the second blower, and the second blower sucks in the helical air current blown out by the first blower from the second air inlet port included in the second blower. In addition, the air curtain apparatus forms the air curtain of a plurality of the helical air currents, the plurality of helical air currents being blown out from the plurality of first air outlet ports each included in each of the plurality of first blowers and sucked into the plurality of second air inlet ports each included in each of the plurality of second blowers.

In addition, as another aspect, a third blower, which is any of the plurality of first blowers, may include a light emitting unit. The light emitting unit emits light in a direction in which the helical air current is blown out of the first air outlet port included in a third blower. Relative positions of the plurality of second blowers with respect to the plurality of first blowers may be adjusted so that light applied by the light emitting unit is applied to a fourth blower. The fourth blower is any of the plurality of second blowers and, in a plan view, includes the second air inlet port facing the first air outlet port included in the third blower.

In addition, as another aspect, the light emitting unit may be a laser or a light emitting diode that emits visible light or infrared light.

In addition, as another aspect, the fourth blower may also include a light receiving unit that receives light applied by the light emitting unit. Relative positions of the plurality of second blowers with respect to the plurality of first blowers may be adjusted so that light applied by the light emitting unit is applied to the light receiving unit.

In addition, as another aspect, the air curtain apparatus includes two air curtain forming units, each of which forms an air curtain. Each of the two air curtain forming units may have a plurality of first blowers and a plurality of second blowers. The plurality of second blowers held by a first air curtain forming unit, which is any of the two air curtain forming units, in a plan view, may be adjacent to the plurality of first blowers held by a second air curtain forming unit, which is different from the first air curtain forming unit of the two air curtain forming units. In a plan view, a direction from the plurality of first blowers held by the second air curtain forming unit toward the plurality of second blowers held by the second air curtain forming unit may differ from a direction from the plurality of first blowers held by the first air curtain forming unit toward the plurality of second blowers held by the first air curtain forming unit. The first air curtain forming unit may have a first connection unit that connects the plurality of second air outlet ports and the plurality of first air inlet ports in an airtight manner, each of the plurality of second air outlet ports being included in each of the plurality of second blowers held by the first air curtain forming unit, and each of the plurality of first air inlet ports being included in each of the plurality of first blowers held by the second air curtain forming unit.

In addition, as another aspect, the air curtain apparatus may include N air curtain forming units (N being an integer of 3 or larger), the air curtain forming units being arrayed along an annular path around a central axis along the up-down direction and each forming an air curtain. Each of the N air curtain forming units may have a plurality of first blowers and a plurality of second blowers. For each of the N air curtain forming units, in a pair of a third air curtain forming unit and a fourth air curtain forming unit, in a plan view, the plurality of second blowers held by the third air curtain forming unit may be adjacent to a plurality of first blowers held by the fourth air curtain forming unit, the third air curtain forming unit being the air curtain forming unit, and the fourth air curtain forming unit, of the N air curtain forming units, being arranged on a first side which is, in a plan view, side of an anti-clockwise direction or that of a clockwise direction, along the annular path of the third air curtain forming unit, and the fourth air curtain forming unit being the air curtain forming unit adjacent to the third air curtain forming unit. The third air curtain forming unit may have a second connection unit that connects in an air-tight manner the plurality of second air outlet ports and the plurality of first air inlet ports in an airtight manner, the plurality of second air outlet ports each being included in each of the plurality of second blowers held by the third air curtain forming unit and the plurality of first air inlet ports each being included in each of the plurality of first blowers held by the fourth air curtain forming unit.

In addition, as another aspect, a rotation direction of the helical air current, when the helical air current blown out by the first blower is seen from the first blower, is a clockwise or anti-clockwise rotation direction, and may be the same rotation direction among the plurality of first blowers.

In addition, as another aspect, each of the plurality of first blowers includes a first cylinder part and a first fan provided inside the first cylinder part. The first air inlet port is provided at a first end in an axial direction of the first cylinder part. The first air outlet port is provided at a second end opposite to the first end, in the axial direction of the first cylinder part. The first fan may suck in air from the first air inlet port and blow out from the first air outlet port the air sucked in from the first air inlet port. Each of the plurality of first blowers may further include a first grille, the first grille being provided at the first air outlet port and having a plurality of holes formed therein, each having a helical shape swirling in a clockwise or anti-clockwise direction when viewed from the direction of the first cylinder part.

In addition, as another aspect, each of the plurality of first blowers may have a spraying unit that sprays an antiseptic solution inside the first cylinder part.

In addition, as another aspect, each of the plurality of second blowers includes a second cylinder part and a second fan provided inside the second cylinder part. The second air inlet port is provided at a third end in the axial direction of the second cylinder part. The second air outlet port is provided at a fourth end which is opposite to the third end in the axial direction of the second cylinder part. The second fan may suck in air from the second air inlet port and blow out from the second air outlet port the air sucked from the second air inlet port. An inner diameter of the second air inlet port may be larger than that of the first air outlet port.

In addition, as another aspect, each of the plurality of first blowers may include a first injection unit that injects a colored gas into the inside of the first cylinder part.

In addition, as another aspect, each of the plurality of first blowers may include a second injection unit that injects a gas containing a smell component into the inside of the first cylinder part.

In addition, as another aspect, at least any one of the first blower and the second blower further includes an identification member that makes it possible to visually identify a traveling direction of the helical air current. The identification member includes a strip-shaped member, a storing part that stores the strip-shaped member in a rolled-up state, and a placement part in which the strip-shaped member is drawn from the storing part is placed. In a case where the strip-shaped member is drawn from the storing part, the strip-shaped member may be maintained in a state in which it is extended along the traveling direction of the helical air current.

According to this aspect, it is possible to judge the traveling direction of the helical air current by visually inspecting the identification member. For example, because it is possible to judge the traveling direction of the helical air current of the first blower, positioning of the air curtain apparatus completes by placing the second blower at a position along that traveling direction. In this manner, it becomes possible to provide the air curtain apparatus that is easy to install.

In addition, according to this aspect, the traveling direction of the helical air current may be judged by drawing the strip-shaped member from the storing part, placing it in the placement part, and visually inspecting a direction in which the strip-shaped member extends from the storing part. Therefore, for example, because it is possible to judge the traveling direction of the helical air current of the first blower, positioning of the air curtain apparatus completes by placing the second blower at a position along the traveling direction. In this manner, it becomes possible to provide the air curtain apparatus that is easy to install.

In addition, as another aspect, at least any one of the first blower and the second blower further includes an identification member that makes it possible to visually identify the traveling direction of the helical air current. The identification member includes a strip-shaped member, being deformable in any of an elongated state in which a plurality of short members is connected and a folded state; and a placement part in which a predetermined region of the strip-shaped member in the elongated state is placed. The strip-shaped member may extend along the traveling direction of the helical air current in the elongated state.

According to this aspect, it is possible to judge the traveling direction of the helical air current by deforming the plurality of short members of the strip-shaped member into the elongated state, placing them in the placement part, and visually inspecting a direction in which the strip-shaped member extends from the storing part. Therefore, for example, because it is possible to judge the traveling direction of the helical air current of the first blower, positioning of the air curtain apparatus completes by placing the second blower at a position along the traveling direction. In this manner, it becomes possible to provide the air curtain apparatus that is easy to install.

In addition, as another aspect, at least any one of the first blower and the second blower further includes an identification member that makes it possible to visually identify the traveling direction of the helical air current. The identification member includes a stretchable member having a plurality of cylindrical members of varying diameters arranged concentrically, and a placement part where a predetermined region of the stretchable member in a stretched state is placed. The stretchable member may also extend along the traveling direction of the helical air current in the stretched state.

According to this aspect, it is possible to judge the traveling direction of the helical air current by stretching the stretchable member, placing it in the placement part, and visually inspecting a direction in which the stretchable member extends from the storing part. Therefore, for example, because it is possible to judge the traveling direction of the helical air current of the first blower, positioning of the air curtain apparatus completes by placing the second blower at a position along the traveling direction. In this manner, it becomes possible to provide the air curtain apparatus that is easy to install.

In addition, as another aspect, at least any one of the first blower and the second blower further includes an identification member that makes it possible to visually identify the traveling direction of the helical air current. The identification member may also include a scope unit that is arranged in one of the first blower and the second blower and is able to visually recognize an object present in a direction along the traveling direction of the helical air current.

According to this aspect, it is possible to judge the traveling direction of the helical air current by looking into the scope unit. Therefore, for example, because it is possible to judge the traveling direction of the helical air current, positioning of the air curtain apparatus completes by placing the second blower at a position along that traveling direction. In this manner, it becomes possible to provide the air curtain apparatus that is easy to install.

In addition, as another aspect, at least any one of the first blower and the second blower further includes an identification member that makes it possible to visually identify the traveling direction of the helical air current. The identification member includes an elongated bag-shaped member a base end of which is opened and a termination of which is closed; and a linear spring member fixed to the bag-shaped member and deforming the bag-shaped member into a wrapped state. The bag-like member is arranged so that the base end faces the first blower and may extend along the traveling direction of the helical air current by air from the first blower flowing in from the base end.

According to this aspect, because air that drives the first blower flows into the bag-shaped member, the bag-shaped member extends along the traveling direction of the helical air current. This makes it possible to judge the traveling direction of the helical air current. Therefore, for example, because it is possible to judge the traveling direction of the helical air current of the first blower, positioning of the air curtain apparatus completes by placing the second blower at a position along the traveling direction. In this manner, it becomes possible to provide the air curtain apparatus that is easy to install.

In addition, as another aspect, there may be an aspect having a controller that drives and controls the first blower and the second blower. This another aspect has the controller, and a controller that drives and controls the first blower and the second blower. The plurality of first blowers is juxtaposed in an upper part of an indoor space, and the plurality of second blowers is juxtaposed in a lower part of an indoor space. In the plurality of first blowers and the plurality of second blowers, the controller may select a plurality of predetermined pairs, the predetermined pairs being pairs of predetermined first blowers of the plurality of first blowers and the second blowers facing the predetermined first blowers, and may drive and control the selected first blowers and second blowers.

According to this aspect, by the controller performing driving and control of the plurality of first blowers and the plurality of second blowers to select and drive the first blower and the second blower to be driven, it is possible to form air curtains of various patterns at various positions.

In addition, as another aspect, the aspect having the controller further has a position sensing apparatus that senses a position of a mobile object in the indoor space. The controller may obtain positional information of a mobile object from the position sensing apparatus, select the plurality of the predetermined pairs that are located at a certain distance from the mobile object, and drive and control the first blower and the second blower that constitute the selected predetermined pairs.

According to this aspect, by the controller performing driving and control of the plurality of first blowers and the plurality of second blowers, and selecting and driving the first blower and the second blower to be driven on the basis of a position of the mobile object, it becomes possible to form an air curtain of a suitable pattern at a position suitable for the mobile object.

In addition, as another aspect, in an aspect having the controller and the position sensing apparatus, the plurality of first blowers and the plurality of second blowers may be arranged in a matrix in the indoor space.

According to this aspect, it becomes possible to form an air curtain of various patterns such as an air curtain having a near-circular pattern, for example.

In addition, as another aspect, in an aspect in which the plurality of second blowers is arranged in a matrix in the indoor space, the controller may select a plurality of the predetermined pairs located in a predetermined radius from the mobile object, and form a cylindrical air curtain surrounding the mobile object.

According to this aspect, in order to form the cylindrical air curtain surrounding the mobile object, In addition, as another aspect, in the aspect having the controller and the position sensing apparatus, the plurality of first blowers and the plurality of second blowers may be arranged in a grid pattern in the indoor space.

According to this aspect, it becomes possible to form an air curtain having various patterns, like an air curtain having a linear or rectangular tubular pattern, for example.

In addition, as another aspect, in an aspect in which the second blowers are arranged in a grid pattern in the indoor space, the controller may be able to collectively select the plurality of first blowers and the plurality of second blowers aligned on an individual line of four lines that form one grid.

According to this aspect, the controller is able to control the plurality of first blowers and the plurality of second blowers in units of a grid line, thereby reducing processing load of the controller.

In addition, as another aspect, in an aspect having the controller and the position detecting apparatus, the controller may form an air curtain surrounding a plurality of mobile objects in a case where the plurality of mobile objects sensed by the position sensing apparatus mutually has a group relationship, and a distance between the respective mobile objects is closer than a predetermined distance.

According to this aspect, in a case where the plurality of mobile object mutually has the group relationship, it becomes possible to separate the plurality of mobile objects together by one air curtain, rather than forming an air curtain individually.

In addition, as another aspect, in the aspect having the controller and the position sensing apparatus, the controller may update the positional information for every predetermined period, and select the plurality of predetermined pairs on the basis of the updated positional information.

According to this aspect, it becomes possible to move an air curtain so as to follow a mobile object as the mobile object moves.

In addition, as another aspect, in the aspect having the controller and the position sensing apparatus, the controller may select the plurality of predetermined pairs, the predetermined pairs being able to configure an air curtain that separates only a specific mobile object in a case where there is the specific mobile object for one or more mobile objects located at a position corresponding to the positional information obtained by the position sensing apparatus. The controller may drive and control the first blower and the second blower that constitute the selected predetermined pair. The second blower may suck in, from the second air inlet port included in the second blower, the helical air current blown out from the first blower located vertically above.

In addition, as another aspect, an aspect having the controller and the position sensing apparatus and being able to configure the air curtain that separates only the specific mobile object may further have guide means that is able to guide to a specific position in the certain space with respect to the specific mobile object.

In addition, as another aspect, the aspect having the controller may further have marker means that is able to notify a position that differs from a position of an air curtain formed in a direction from the first blower to the second flower, the first blower and the second blower being selected by the controller.

Effect of the Invention

With one aspect of the present invention applied, simply using a small and simple air curtain apparatus makes it possible to efficiently separate and divide a certain space and to efficiently prevent entry of foreign matters such as droplets or the like from one subspace to the other subspace.

MODES FOR CARRYING OUT THE INVENTION

Figure 1:
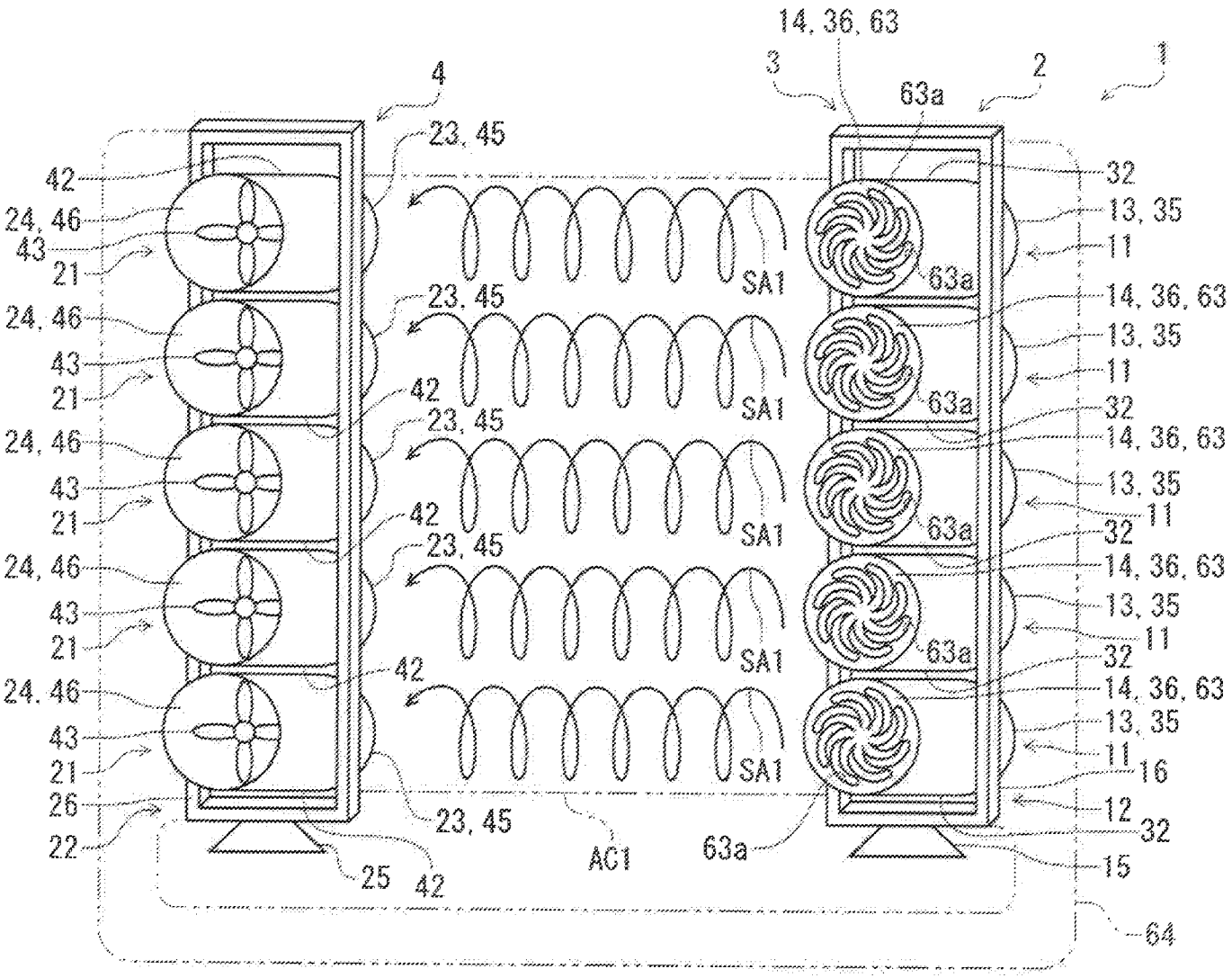
FIG. 1 is a diagram schematically illustrating a configuration of an air curtain apparatus of an embodiment.

In the following, a description is given of an embodiment and respective modification examples of the present invention, with reference to the drawings.

It is to be noted that the disclosure is merely an example, and that those modifications of which those skilled in the art may easily conceive, where appropriate, while maintaining the gist of the present invention shall be naturally included in the scope of the present invention. In addition, in order to clarify the description, while drawings may be schematically depicted in terms of a width, a thickness, a shape, of the like, as compared with the embodiment, they are merely an example, and shall not limit any interpretation of the present invention.

In addition, in the specification and respective figures, same components as those described in relation to the above-mentioned drawings may be designated by the same reference numerals, and a detailed description thereof may be omitted where appropriate.

Furthermore, in the drawings used in the embodiment, hatching may be omitted to make the drawings easier to see, even though they are cross-sectional diagrams. In addition, hatching may be added to even a top view to make it easier to see.

It is to be noted that in the following embodiment, in a case where a range is denoted as A to B, the range shall represent A or larger and B or smaller, unless otherwise specified.

Embodiment

<Air Curtain Apparatus>

Figure 2:
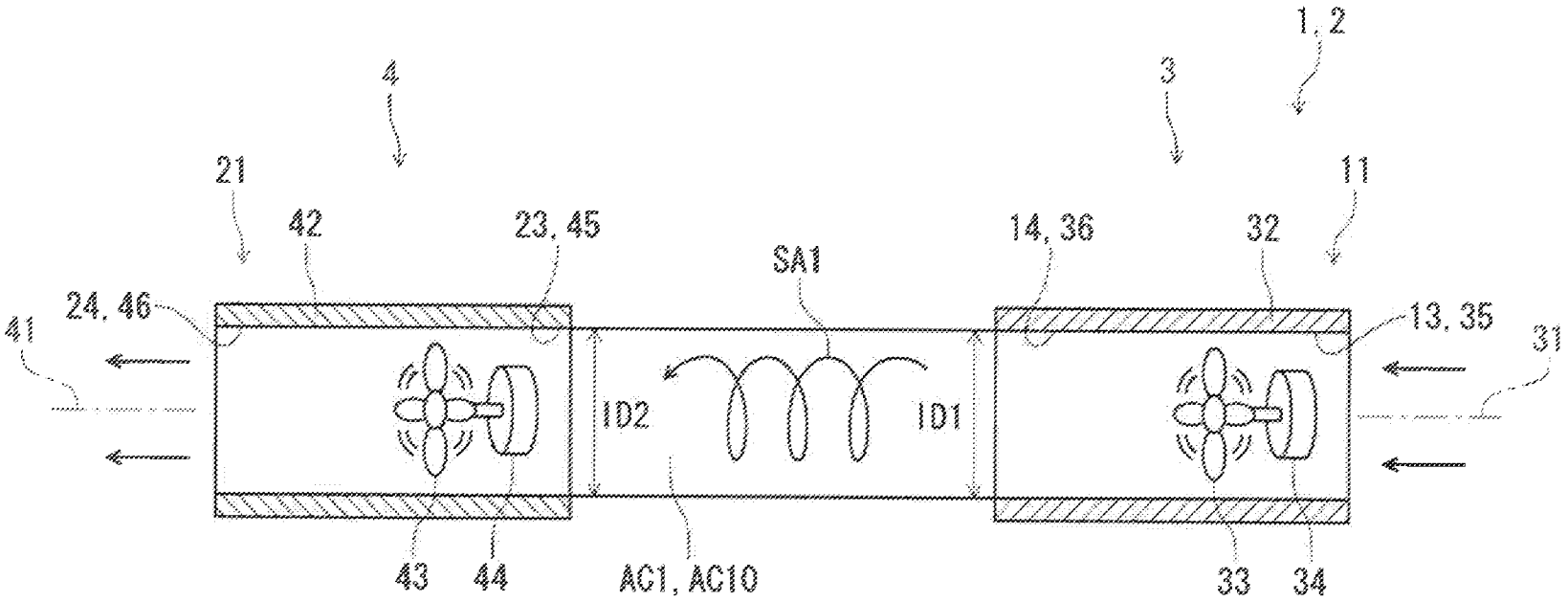
FIG. 2 is a cross-sectional diagram schematically illustrating the air curtain apparatus of the embodiment.
Figure 3:
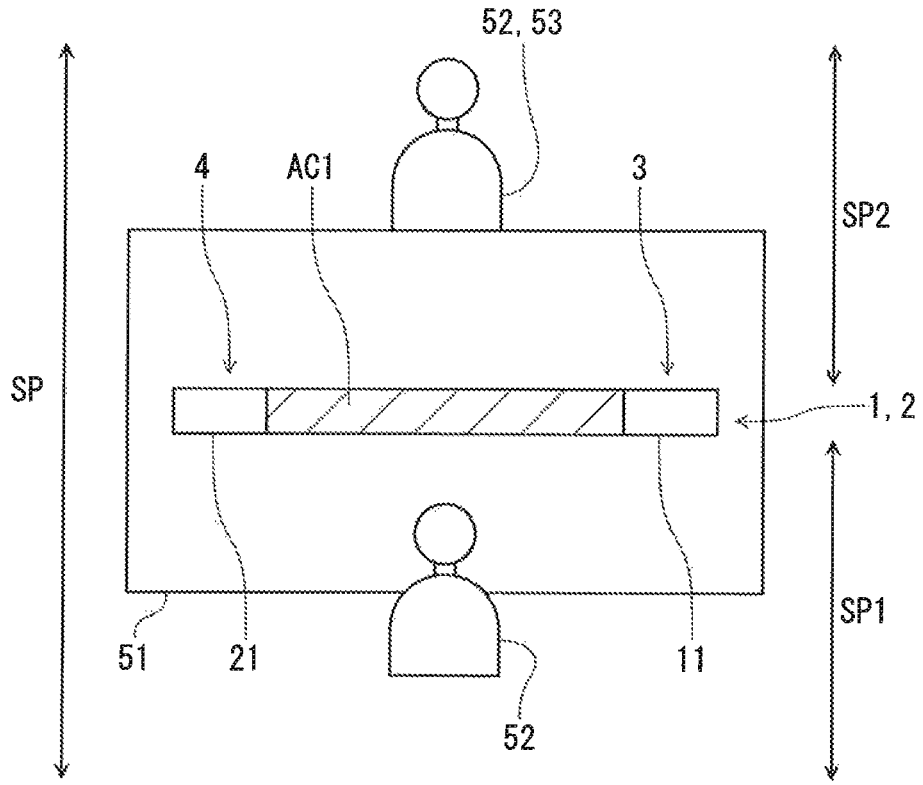
FIG. 3 is a top view schematically illustrating an example of arrangement of the air curtain apparatus of the embodiment.
Figure 4:
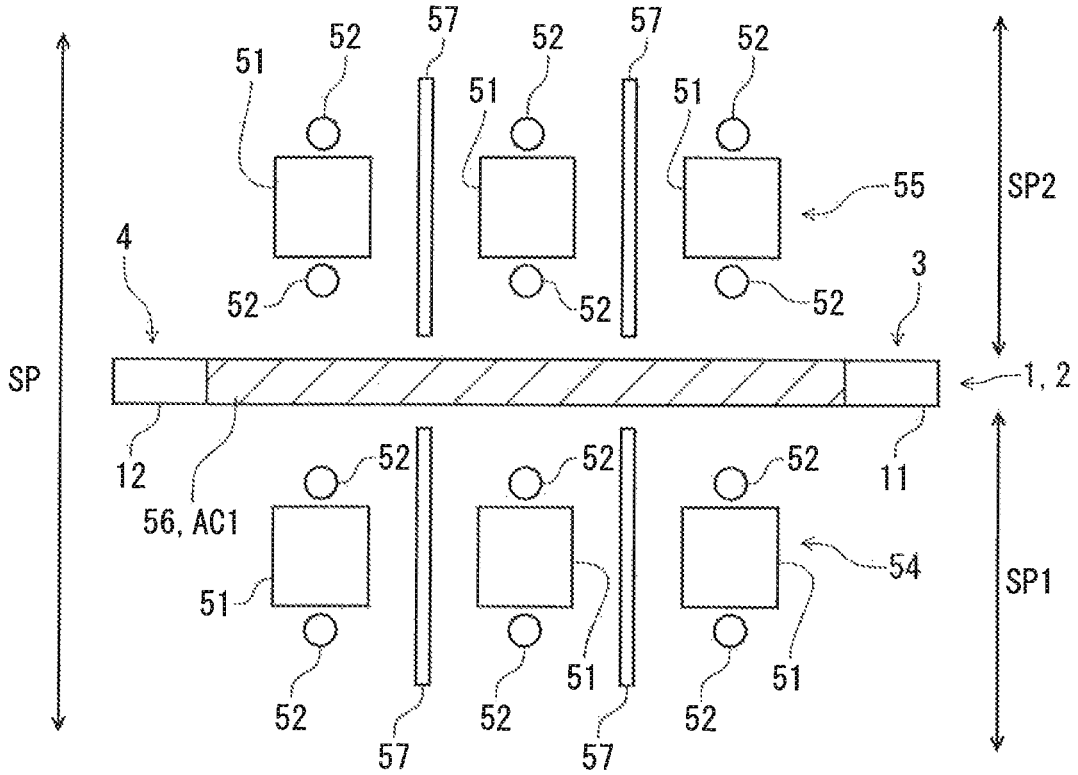
FIG. 4 is a top view schematically illustrating another example of the arrangement of the air curtain apparatus of the embodiment.
Figure 5:
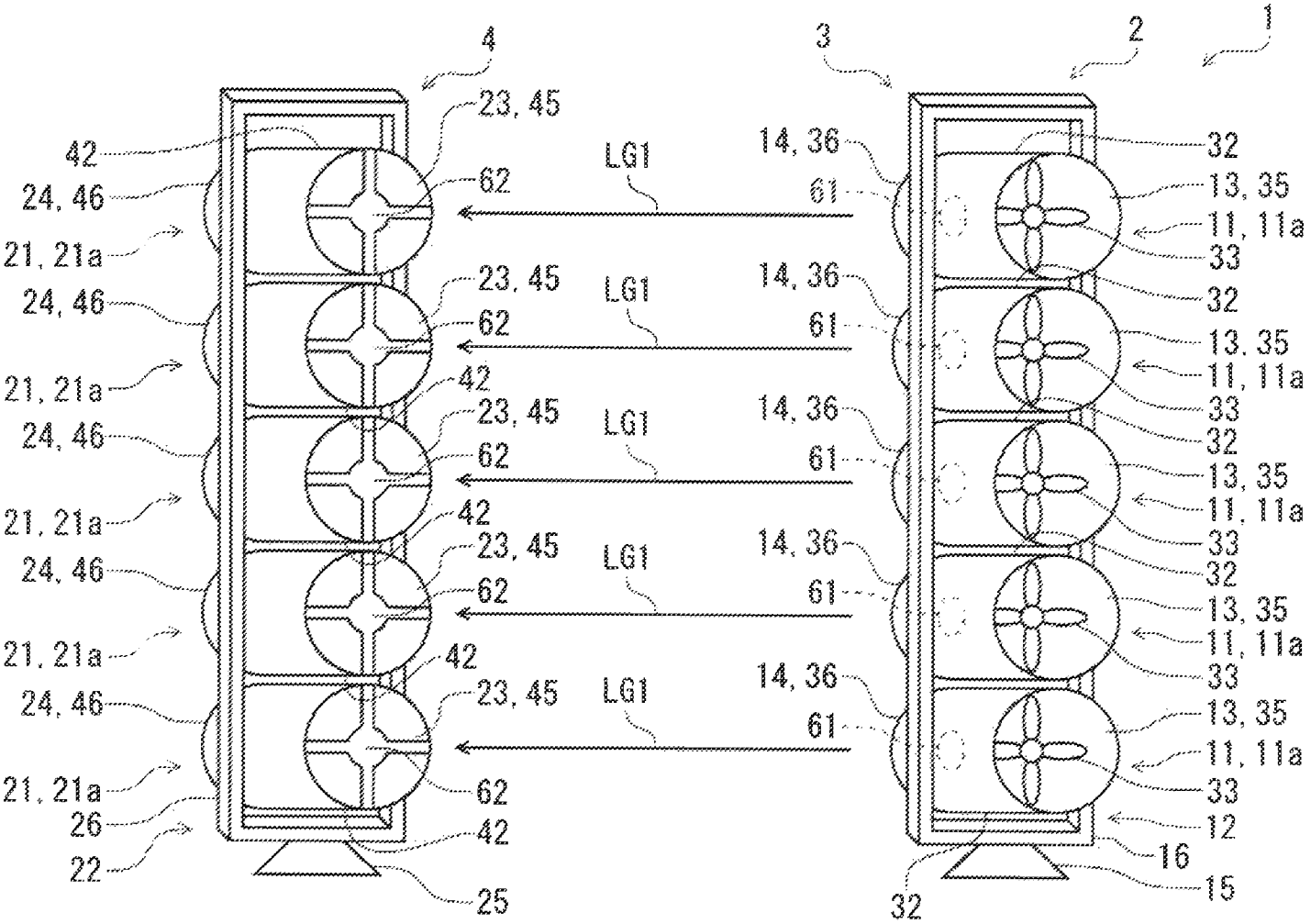
FIG. 5 is a diagram schematically illustrating a configuration of the air curtain apparatus of the embodiment.

A description is given of an air curtain apparatus according to an embodiment which is one embodiment of the present invention. FIG. 1 is a diagram schematically illustrating a configuration of an air curtain apparatus of the embodiment. FIG. 2 is a cross-sectional diagram schematically illustrating the configuration of the air curtain apparatus of the embodiment. FIG. 3 is a top view schematically illustrating an example of arrangement of the air curtain apparatus of the embodiment. FIG. 4 is a top view schematically illustrating another example of the arrangement of the air curtain apparatus of the embodiment. FIG. 5 is a diagram schematically illustrating the configuration of the air curtain apparatus of the embodiment. Note that FIG. 2 represents a pair formed by one (one unit) of a blower 11 and one (one unit) of a blower 21, of an air curtain 1 illustrated in FIG. 1. In addition, in FIG. 2, a part of an air curtain AC1 is depicted as an air curtain AC10. In addition, in FIG. 1, FIG. 2, and FIG. 5, an arrow represents a direction of an air current (the same also applies to FIG. 6 and FIG. 8 to FIG. 10).

As illustrated in FIG. 1 and FIG. 2, the air curtain apparatus 1 of the present embodiment is an air curtain apparatus that forms an air curtain, and includes an air curtain forming unit 2 that forms an air curtain. The air curtain forming unit 2 includes an air outlet unit 3 from which air is blown out and an air inlet unit 4 from which air is sucked in. The air curtain forming unit 2 forms an air curtain AC1 of a plurality of helical air currents SA1, the helical air currents SA1 being blown out from the air outlet unit 3 and sucked into the air inlet unit 4.

The air outlet unit 3 has a plurality of vertically arrayed blowers (circulators) 11 and a support part (stand) 12 that supports the plurality of blowers 11. Each of the plurality of blowers 11 includes an air inlet port 13 in which air is sucked and an air outlet port 14 from which air is blown out. For example, the support 12 including a leg 15 and a frame part 16 provided on the leg 15 may be used, although the support 12 is not specifically limited thereto. In such a case, each of the plurality of blowers 11 is fixed by the frame part 16 in a vertically arrayed state or is supported by the frame part 16, while being arrayed vertically and in a state in which a direction of the air outlet port 14 is changeable. In addition, it is possible to easily install or move the air outlet unit 3 by grasping and carrying the frame part 16.

The air inlet unit 4 has a plurality of vertically arrayed blowers (circulators) 21 and a support part (stand) 22 that supports the plurality of blowers 21. Each of the plurality of blowers 21 includes an air inlet port 23 in which air is sucked and an air outlet port 24 from which air is blown out. In addition, in a plan view, the plurality of blowers 21 is arranged so that the air inlet port 23 respectively faces the air outlet port 14 included in each of the plurality of blowers 11. For example, the support 22 including a leg 25 and a frame part 26 provided on the leg 25 may be used, although the support 22 is not specifically limited thereto. In such a case, each of the plurality of blowers 21 is fixed to the frame part 26 in a vertically arrayed state, or is supported by the frame part 26 while being arrayed vertically and in a state in which a direction of the air inlet port 23 is changeable. In addition, it is possible to easily install or move the air inlet unit 4 by grasping and carrying the frame part 26.

Specifically, each of the plurality of blowers 11 is able to include a cylinder part 32 centering around a central axis 31, a fan 33 rotatably provided inside the cylinder part 32 around the central axis 31, and a drive unit 34 that rotates and drives the fan 33. In such a case, the air inlet port 13 is provided at an end 35 in a direction along the central axis 31 of the cylinder part 32, more specifically, in an axial direction, and the air outlet port 14 is provided at an end 36 opposite to the end 35, in the direction along the central axis 31 of the cylinder part 32, more specifically, in the axial direction. The fan 33 sucks in air from the air inlet port 13 and blows out, from the air outlet port 14, the air sucked in from the air inlet port 13.

In addition, each of the plurality of blowers 21 is able to include a cylinder part 42 centering around a central axis 41, a fan 43 rotatably provided inside the cylinder part 42 around the central axis 41, and a drive unit 44 that rotates and drives the fan 43. In such a case, the air inlet port 23 is provided at an end 45 in a direction along the central axis 41 of the cylinder part 42, more specifically, in an axial direction, and the air outlet port 24 is provided at an end 46 opposite to the end 45, in the direction along the central axis 41 of the cylinder part 42, more specifically, in the axial direction. The fan 43 sucks in air from the air inlet port 23 and blows out, from the air outlet port 24, the air sucked in from the air inlet port 23.

In the present embodiment, for each of the plurality of blowers 11, a pair is formed by the blower 11 and the blower 21, the blower 21 being any of the plurality of blowers 21 and including the air inlet port 23 that faces the air outlet port 14 included in the blowers 11.

In the air of the blower 11 and the blower 21, the blower 11 blows out the helical air current SA1 from the air outlet port 14 included in the blower 11 toward the air inlet port 23 included in the blower 21. In addition, in the pair of the blower 11 and the blower 21, the blower 21 sucks in, from the air inlet port 23 included in the blower 21, the helical air current SA1 blown out by the blower 11 from the air outlet port 14 included in the blower 11 toward the air inlet port 23 included in the blower 21.

The air curtain apparatus 1 of the present embodiment is arrayed in the up-down direction, and forms the air curtain AC1 with the plurality of helical air currents SA1, the helical air currents SA1 each being blown out from each of the plurality of air outlet ports 14 included in each of the plurality of blowers 11 and the helical air currents SA1 each being sucked in each of the plurality of air inlet ports 23 each included in each of the plurality of blowers 21. The plurality of helical air currents SA1 forms the air curtain AC1.

Here, a description is given of problems in forming an air curtain by the air curtain apparatus.

In the techniques described in the above-mentioned Patent Literature 1 to 3, there is a problem that use of a large or complicated air curtain apparatus is necessary to efficiently separate and divide a certain space into two subspaces and to prevent entry of foreign matters such as droplets from one subspace to the other subspace, for example. There is another problem that use of such a large or complicated air curtain apparatus does not allow the air curtain apparatus to be easily installed or easily moved.

Moreover, there is also a problem that simply using a small and simple air curtain apparatus does not make it possible to efficiently separate and divide a certain space, and to efficiently prevent entry of foreign matters from one subspace to the other subspace.

On the other hand, the air curtain apparatus 1 of the present embodiment includes a plurality of vertically arrayed blowers 11 and a plurality of vertically arrayed blowers 21, wherein the air inlet ports 23 included in the blowers 21 face the air outlet ports 14 included in the blowers 11. In addition, in the pair of the blower 11 and the blower 21, the blower 11 blows out the helical air current SA1 from the air outlet port 14 included in the blower 11 toward the air inlet port 23 included in the blower 21, and the blower 21 sucks in, from the air inlet port 23, the helical air current SA1 blown out by the blower 11. In addition, the air curtain apparatus 1 of the present embodiment forms the air curtain AC1 with the plurality of helical air currents SA1, the helical air currents SA1 being blown from the plurality of air outlet ports 14 included in of the plurality of blowers 21 and being sucked in the plurality of air inlet ports 23 each included in each of the plurality of blowers 21.

In a case where the helical air current SA1 having a helical shape is blown out from the air outlet port 14, the air current does not spread and goes straight more easily than a case where an air current having any shape other than the helical shape is blown out. That is to say, straightness of the helical air current SA1 is higher than that of the air current having any shape other than the helical shape.

Consequently, the plurality of helical air currents SA1 being blown from the plurality of air outlet ports 14 each included in each of the plurality of vertically arrayed blowers 11, more specifically, the plurality of vertically arrayed air outlet ports 14, it is possible to prevent or suppress a thickness of the air curtain AC1 from increasing as the air curtain AC1 moves away from the plurality of blowers 11.

In addition, the plurality of helical air currents SA1 each blown out from each of the plurality of air outlet ports 14 being sucked in the plurality of air inlet ports 23 each included in each of the plurality of vertically arrayed blowers 21, more specifically, the plurality of vertically arrayed air inlet ports 23, it is possible to prevent or suppress the thickness of the air curtain AC1 from increasing as the air curtain AC1 moves away from the plurality of blowers 11.

Consequently, according to the air curtain apparatus 1 of the present embodiment, simply using the small and simple air curtain apparatus makes it possible to efficiently separate and divide a certain space and efficiently prevent entry of foreign matters such as droplets or the like from one subspace to the other subspace. Moreover, because use of the large or complicated air curtain apparatus is not necessary to efficiently separate and divide ae certain space into two subspaces and prevent entry of foreign matters such as droplets or the like from one subspace to the other subspace, it is possible to easily install and easily move the air curtain apparatus.

That is to say, according to the air curtain apparatus 1 of the present embodiment, it is possible to efficiently separate and divide a certain space, to efficiently prevent entry of foreign matters such as droplets or the like from one subspace to the other subspace, and to easily install and easily move the air curtain apparatus.

As illustrated in FIG. 3, the air curtain apparatus 1 of the present embodiment is a small and simple air curtain apparatus and may therefore be installed on a table 51, for example. For example, in a restraint and other shops, for example, in a case where two users 52 face each other with the table in between or where the user 52 faces an employee 53, it is possible to efficiently separate and divide a space SP centering around the table 51 into two subspaces SP1 and SP2 between the two users 52 or between the user 52 and the employee 53.

In such a case, as described above, it is not necessary to install a shielding plate made of a glass, a resin or the like between the two users 52 or between the user 52 and the employee 53. Therefore, the two users 52 or the user 52 and the employee 53 may easily have conversations in a quiet voice, for example, or hand over a good.

As illustrated in FIG. 4, because the air curtain apparatus 1 of the present embodiment is a small and simple air curtain apparatus, it is possible to install the air curtain apparatus 1 between a table group 54 including a plurality of tables 51 and a table group 55 including a plurality of the tables 51. Even in a case where there is an aisle 56 between the table group 54 and the table group 55 and it is difficult to install a shielding plate made of a glass, a resin, or the like on that aisle 56, installation of the air curtain apparatus 1 of the present embodiment on the aisle 56 between the table group 54 and the table group 55 makes it possible to efficiently separate and divide a space SP where a plurality of the tables 51 is located in two subspaces SP1 and SP2 with the aisle 56 as a boundary. Note that the plurality of tables 51 included in the table group 54 is arrayed along the aisle 56 so that the tables 51 and partitions 57 are alternately arranged, and that the plurality of tables 51 included in the table group 55 are arrayed along the aisle 56 so that the tables 51 and the partitions 57 are alternately arranged.

In addition, as described above, straightness of the helical air current SA1 is higher than that of the air current having any shape other than the helical shape. Consequently, according to the air curtain apparatus 1 of the present embodiment, as illustrated in FIG. 4, one air curtain apparatus 1 is able to efficiently separate and divide the table group 54 and the table group 55, the table group 54 including the three tables 51 that are arranged in the one subspace SP1 and arrayed along the aisle 56, and the table group 55 including the three tables 51 that are arranged in the other subspace SP2 and arrayed along the aisle 56.

As illustrated in FIG. 5, preferably, a blower 11*a*, which is any (or all) of the plurality of blowers 11, includes a light emitting unit 61, the light emitting unit 61 applying light LG1 to a direction in which the helical air current SA1 is blown out from the air outlet port 14 included in the blower 11*a*. In addition, relative positions of the plurality of blowers 21 with respect to the plurality of blowers 11 are adjusted so that the light LG1 applied by the light emitting unit 61 included in the blower 11*a* is applied to a blower 21*a*, the blower 21*a* being any (or all) of the plurality of blowers 21 and including the air inlet port 23 that, in a plan view, faces the air outlet port 14 included in the blower 11*a*.

In such a case, in a location where the air curtain apparatus 1 of the present embodiment is installed, it is possible to confirm easily and visually whether or not the helical air current SA1 blown out from the air outlet port 14 of the blower 11 reaches straight the air inlet port 23 of the blower 21 (whether or not it arrives) by adjusting the relative position of the air inlet unit 4 with respect to the air outlet unit 3, while irradiating the blower 21*a* with the light applied by the light emitting unit 61 included in the blower 11*a*.

It is to be noted that as for the light emitting unit 61, the blower 11 and the blower 21 may be reversed. That is to say, the blower 21*a*, which is any (or all) of the plurality of blowers 21 may also include a light emitting unit (not illustrated) that applies light in a direction in which the helical air current SA1 is sucked into the air inlet port 23 included in the blower 21*a*. In addition, the relative positions of the plurality of blowers 11 with respect to the plurality of blowers 21 may be adjusted so that the light applied by the light emitting unit (not illustrated) included in the blower 21*a* is applied to the blower 11*a*, the blower 11*a* being any (or all of) the plurality of blowers 11 and including the air outlet port 14 that faces the air inlet port 23 included in the blower 21*a*.

Preferably, the light emitting unit 61 included in the blower 11 is a laser or a light emitting diode that emits visible light or infrared light as the light LG1.

The straightness of the light applied by the laser or the light emitting diode is higher than that of light applied by any other light source. Consequently, the light emitting unit 61 being the laser or the light emitting diode that emits visible light or infrared light further makes it possible to confirm visually and easily whether or not the helical air current SA1 blown out from the air outlet port 14 of the blower 11 reaches straight the air inlet port 23 of the blower 21 (whether or not it arrives). Therefore, it is further possible to ensure that the blower 11 is reliably associated with the blower 21 on a one-to-one basis.

Preferably, the blower 21*a* includes a light receiving unit 62, the light receiving unit 62 receiving the light applied by the light emitting unit 61 included in the blower 11*a*. In addition, the relative positions of the plurality of blowers 21 with respect to the plurality of blowers 11 are adjusted so that the light applied by the light emitting unit 61 included in the blower 11*a* is applied to the light receiving unit 62 included in the blower 21*a*. As the light receiving unit 62, a smooth plate portion, for example, having a high reflectance of reflecting the light LG1, may be used.

In such a case, in a location where the air curtain apparatus 1 of the present embodiment is installed, it is also possible to further visually and easily confirm whether or not the helical air current SA1 blown out from the air outlet port 14 of the blower 11 reaches straight the air inlet port 23 of the blower 21 (whether or not it arrives) by adjusting the relative position of the air inlet unit 4 with the respect to the air outlet unit 3, while irradiating the light receiving unit 62 of the blower 21*a* with the light applied by the light emitting unit 61 included in the blower 11. Therefore, it is further possible to ensure that the blower 11 is reliably associated with the blower 21 on a one-to-one basis.

Preferably, when viewed from the blower 11 toward the blower 21, a rotation direction of the helical air current SA1, which is blown out by the blower 11 from the air outlet port 14 included in the blower 11 toward the air inlet port 23 included in the blower 21, is a clockwise or anti-clockwise rotation direction, and is the same rotation direction among the plurality of blowers 11. In other words, the plurality of blowers (circulators) 11 each blowing out the helical air current SA1 is aligned (arrayed) lengthwise, more specifically, in the up-down direction, the helical air current SA1 having the helical shape (spiral shape) that rotates in the same direction of the clockwise or anti-clockwise rotation direction.

In a case where the two (two units of) blowers 11 adjacent to each other in the up-down direction each blow out the helical air current SA1 having the helical shape (spiral shape) rotating in the direction that is the clockwise or anti-clockwise direction and the same as each other, the two (two units of) blowers 11 are able to strengthen an amount of air to be blown out (wind force), stabilize the wind force, and easily maintain the wind force, as compared with a case where the two (two units of) blowers 11 each blows out the helical air current SA1 having the helical shape that rotates in a reverse direction to each other.

Preferably, each of the plurality of blowers 11 further includes a grille 63 that has a plurality of holes 63*a* formed therein, the plurality of holes 63*a* being provided at the air outlet port 14 and each having the helical shape that swirls clockwise or anti-clockwise when viewed from the axial direction of the cylinder part 32. Each of the plurality of holes 63*a* penetrates the grille 63 in the axial direction of the cylinder part 32.

In a case where the plurality of holes 63*a* formed in the grille 63 each has the helical shape that swirls clockwise or anti-clockwise, it is possible to blow out the helical air current SA1 having the helical shape (spiral shape) more easily than a case where the plurality of holes 63*a* formed in the grille 63 does not have the helical shape that swirls clockwise or anti-clockwise. It is to be noted that when viewed from the blower 21 toward the blower 11, the rotation direction of the helical shape of the holes 63*a* formed in the grille 63, the rotation direction of the helical air current SA1 blown out by the blower 11, and the rotation direction of the fan 33 are all the same direction of rotation.

Preferably, the air curtain forming unit 2 may have a connection unit 64 (see FIG. 1) that connects in an air-tight manner an end of the air inlet unit 4 opposite to side facing the air outlet unit 3 with an end of the air outlet unit 3 opposite to side facing the air outlet unit 4. That is to say, the air curtain forming unit 2 has the connection unit 64 that connects the plurality of air outlet ports 24 each included in each of the plurality of blowers 21 and the plurality of air inlet ports 13 each included in each of the plurality of blowers 11 in an integrated manner or on a one-to-one basis. A connection unit made of a metal material, a resin material such as plastics, or an elastic material such as rubber, or the like, may be used as the connection unit 64.

In such a case, when foreign matters such as droplets enter the air curtain AC1, it is possible to prevent or suppress entry into any space other than the air curtain AC1, including entry of the entering foreign matters into any of the two subspaces SP1 and SP2 located on both sides with the air curtain AC1 as the center.

First Modification Example of Air Curtain Apparatus

Next, a description is given of a first modification example of the air curtain apparatus of the embodiment. While the air curtain apparatus 1 of the embodiment includes the one (one unit) of the air curtain forming unit 2, an air curtain apparatus 1 of this first modification example includes two (two units) of air curtain forming units 2. Those two (two units) of air curtain forming units 2 are connected to each other in an air-tight manner.

Figure 6:
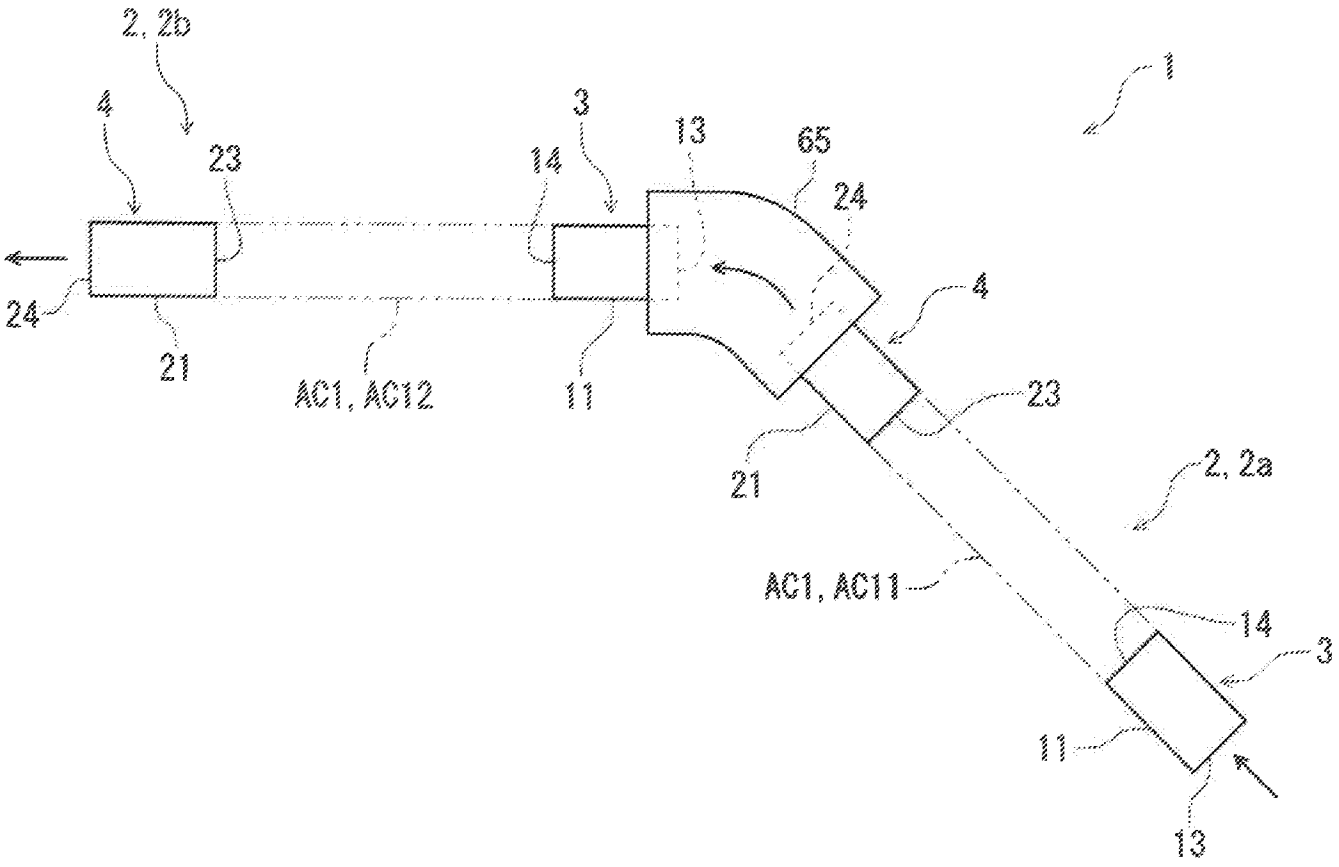
FIG. 6 is a top view schematically illustrating a configuration of an air curtain apparatus of a first modification example of the embodiment.

FIG. 6 is a top view schematically illustrating a configuration of the air curtain apparatus of the first modification example of the embodiment.

As illustrated in FIG. 6, unlike the air curtain apparatus 1 of the embodiment, the air curtain apparatus 1 of this first modification example includes the two (two units) of air curtain forming units 2. Similarly to the air curtain forming unit 2 included in the air curtain apparatus 1 of the embodiment, each of the two (two units) of air curtain forming units 2 includes an air outlet unit 3 and an air inlet unit 4. The air outlet unit 3 has a plurality of blowers 11 and the air inlet unit 4 includes a plurality of blowers 21. More specifically, each of the two (two units) of air curtain forming unit 2 includes the plurality of blowers 11 and the plurality of blowers 21. Note that the plurality of blowers 11 and the plurality of blowers 21 may be made similar to the plurality of blowers 11 and the plurality of blowers 21 in the embodiment.

In the first modification example, the plurality of blowers 21 held by an air curtain forming unit 2*a*, which is any of the two units of air curtain forming units 2, is adjacent to the plurality of blowers 11 held by an air curtain forming unit 2*b*, in a plan view. The air curtain forming unit 2*b* is different from the air curtain forming unit 2*a* of the two units of air curtain forming units 2. Note that the air curtain forming unit 2*a* forms an air curtain AC11 as the air curtain AC1, and that the air curtain forming unit 2*b* forms an air curtain AC12 as the air curtain AC1.

In a plan view, a direction from the plurality of blowers 11 held by the air curtain forming unit 2*b* towards the plurality of blowers 21 held by the air curtain forming unit 2*b* differs from a direction from the plurality of blowers 11 held by the air curtain forming unit 2*a* toward the plurality of blowers 21 held by the air curtain forming unit 2*a*. In other words, in a pair of the blower 11 and the blower 21, a direction in which the helical air current SA1 (see FIG. 1) is blown out from the air outlet port 14 included in the blower 11 is a direction that mutually differs between the two units of air curtain forming units 2.

The air curtain forming unit 2*a* has a connection unit 65 that connects in an air-tight manner a plurality of air outlet ports 24 each included in each of the plurality of blowers 21 held by the air curtain forming unit 2*a* with a plurality of air inlet ports 13 each included in each of the plurality of blowers 11 held by the air curtain forming unit 2*b*, in an integrated manner or on a one-to-one basis.

That is to say, in the air curtain apparatus 1 of this first modification example, the air curtain forming units 2 of the pair, more specifically, the two (two units) of air curtain forming units 2, which are adjacent to each other, are connected by the connection unit 65. It suffices that the connection unit 65 is able to connect the plurality of air outlet ports 24 each included in each of the plurality of blowers 21 held by the air curtain forming unit 2*a* with the plurality of air inlet ports 13 each included in each of the plurality of blowers 11 held by the air curtain forming unit 2*b*, in an air-tight manner. Therefore, a connection unit made of a metal material, a resin material such as plastics, or an elastic material such as rubber, or the like, may be used as the connection unit 65.

According to this first modification example, in addition to achievement of the effects similar to the embodiment, it is further possible to freely extend the air curtain and to freely bend the air curtain in a plan view. Consequently, even in a case where a layout is limited such as a case where an air curtain is formed along a curved aisle in a plan view, for example, it is possible to install the air curtain apparatus easily. Moreover, when foreign matters such as droplets enter the air curtain AC11 formed by the air curtain forming unit 2*a*, it is possible to prevent or suppress entry of the entering foreign matters into any of two subspaces that are located on both sides with the air curtain AC12 as the center, the air curtain 12 being formed by the air curtain forming unit 2*b*.

Second Modification Example of Air Curtain Apparatus

Next, a description is given of a second modification example of the air curtain apparatus of the embodiment. While the air curtain apparatus 1 of the embodiment includes the one (one unit) of air curtain forming unit 2, an air curtain apparatus 1 of this second modification example includes N air curtain forming units (N unit s, N being an integer of 3 or larger). Those N (N unit s) of air curtain forming units 2 are arrayed along a circular route CR1. The two (two units) of air curtain forming units 2, which are adjacent to each other along the circular route CR1, are connected in an air-tight manner.

Figure 7:
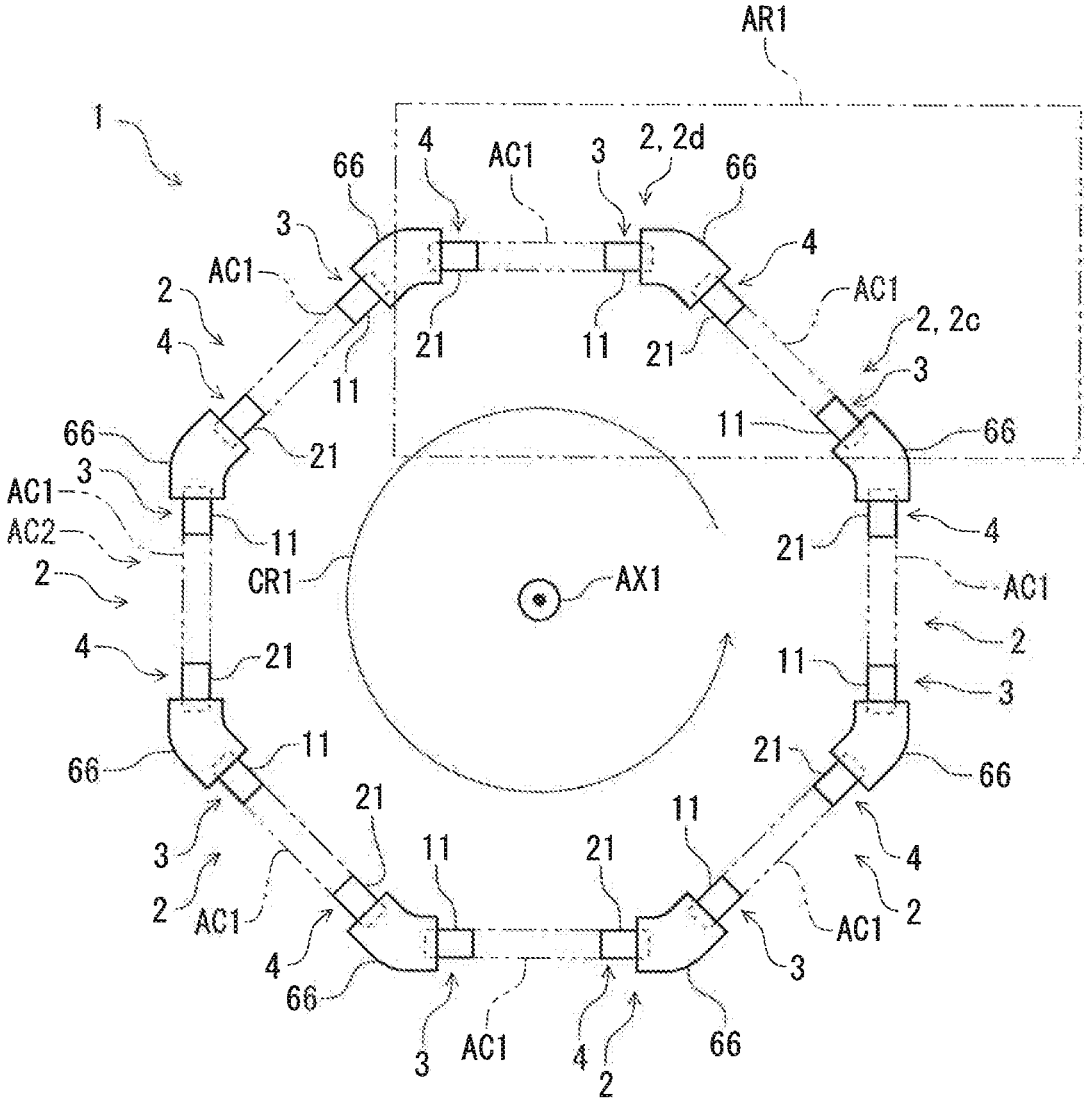
FIG. 7 is a top view schematically illustrating a configuration of an air curtain apparatus of a second modification example of the embodiment.

FIG. 7 is a top view schematically illustrating the air curtain apparatus of the second modification example of the embodiment. Note that FIG. 6 illustrates a configuration similar to that illustrated in an enlarged view of the area AR1 surrounded by a two-dot chain line in FIG. 7.

As illustrated in FIG. 7, unlike the air curtain apparatus 1 of the embodiment, the air curtain apparatus 1 of this second modification example includes N (N units, N being an integer of 3 or larger) of air curtain forming units 2. The N air curtain forming units 2 are arrayed along the circular route R1 around a central axis AX1, which is along the up-down direction, and each form the air curtain AC1. FIG. 7 illustrates a case where N=8. Similarly to the air curtain forming unit 2 included in the air curtain apparatus 1 of the embodiment, each of the N (N units) of air curtain forming units 2 includes an air outlet unit 3 and an air inlet unit 4. The air outlet unit 3 has a plurality of blowers 11 and the air inlet unit 4 includes a plurality of blowers 21. More specifically, each of the N (N units) of air curtain forming units 2 has the plurality of blowers 11 and the plurality of blowers 21. Note that the plurality of blowers 11 and the plurality of blowers 21 may be made similar to the plurality of blowers 11 and the plurality of blowers 21 in the embodiment.

In this second modification example, for each of the N (N units) of air curtain forming units 2, in a pair of an air curtain forming unit 2*c* which is an air curtain forming unit, and an air curtain forming unit 2*d*, which is located on first side and is the air curtain forming unit 2 adjacent to the air curtain forming unit 2*c*, a plurality of blowers 21 held by the air curtain forming unit 2*c* is adjacent to a plurality of blowers 11 held by the air curtain forming unit 2*d* in a plan view. The first side is, in a plan view, side of an anti-clockwise direction or that of a clockwise direction of the air curtain forming unit 2*c* of the N air curtain forming units 2 along the circular route CR1. Note that while any of the N (N units) of air curtain forming units 2 forms the air curtain AC1, an annular air curtain AC2 having an annular shape in a plan view shall be formed by the plurality of air curtains A1 each formed by each of the N (N units) of the air curtain forming units 2.

The air curtain forming unit 2*c* has a connection unit 66 that connects in an air-tight manner a plurality of air outlet ports 24 (see FIG. 6) each included in each of the plurality of blowers 21 held by the air curtain forming unit 2*c* with a plurality of air inlet ports 13 (See FIG. 6) each included in each of the plurality of blowers 11 held by the air curtain forming unit 2*d*, in an integrated manner or on a one-to-one basis.

That is to say, similarly to the air curtain apparatus 1 of the first modification example of the embodiment, in the air curtain apparatus 1 of this second modification example, a pair of air curtain forming units 2 which are adjacent to each other, more specifically, the two (two units) of air curtain forming units 2, which are adjacent to each other, are connected by the connection unit 66. It suffices that similarly to the connection unit 65 in the first modification example of the embodiment, the connection unit 66 is able to connect the plurality of air outlet ports 24 (See FIG. 6) each included in each of the plurality of blowers 21 held by the air curtain forming unit 2*c* with the plurality of air inlet ports 13 (See FIG. 6) each included in each of the plurality of blowers 11 held by the air curtain forming unit 2*d*, in an air-tight manner. Therefore, similarly to the connection unit 65 in the first modification example of the embodiment, a connection unit made of a metal material, a resin material such as plastics, or an elastic material such as rubber or the like may be used as the connection unit 66.

According to this second modification example, the N (N units) of air curtain forming units 2 are arrayed along the circular route CR1 and the two (two units) of air curtain forming units 2, which are adjacent to each other along the circular route CR1, are connected in an air tight manner. Thereby, in addition to achievement of the effects similar to the embodiment, it is further possible to easily form a space surrounded by the annular air curtain AC2 having an annular shape in a plan view. In addition, when foreign matters such as droplets enter the annular air curtain AC2, it is possible to prevent or suppress entry of the entering foreign matters into the space surrounded by the annular air curtain AC2 and into a space on circumferential side of the annular air curtain AC2 with the central axis AX1 as the center.

Third Modification Example of Air Curtain Apparatus

Figure 8:
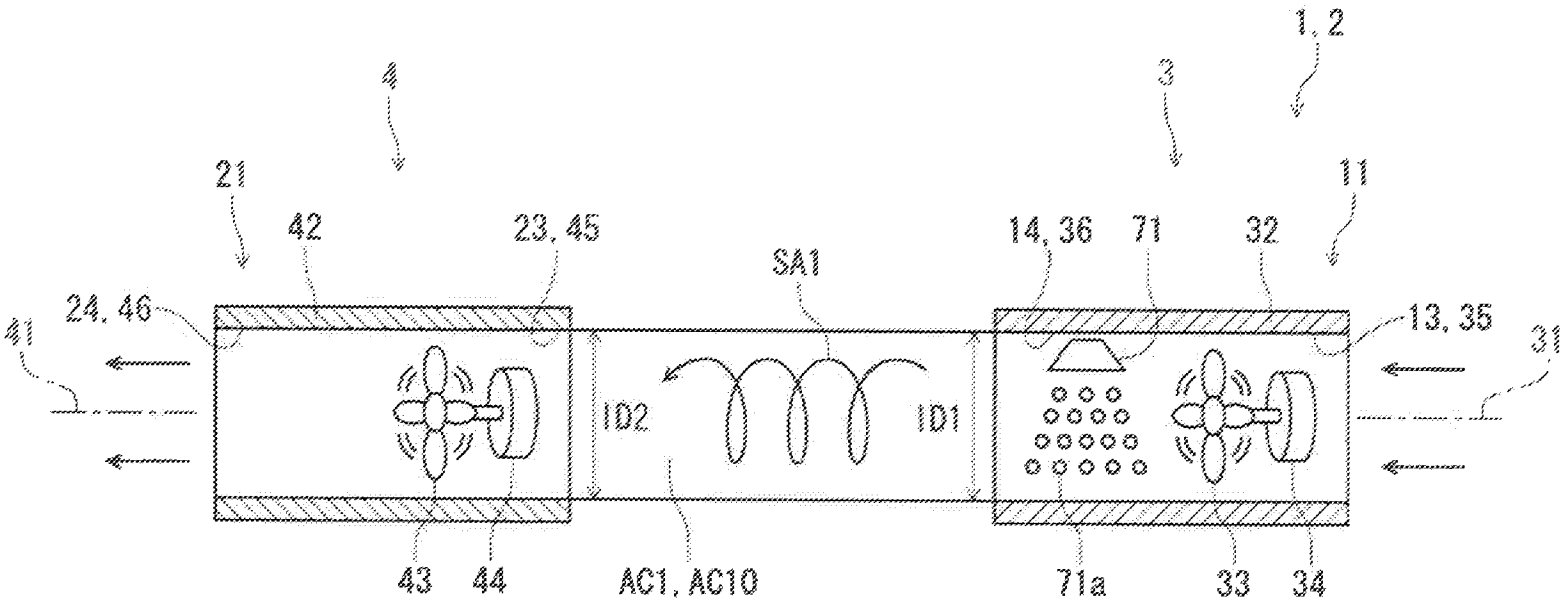
FIG. 8 is a top view schematically illustrating a configuration of an air curtain apparatus of the third modification example of an embodiment.

Next, a description is given of a third modification example of the air curtain apparatus of the embodiment. FIG. 8 is a cross-sectional diagram schematically illustrating a configuration of an air curtain apparatus of the third modification example of the embodiment. Note that in FIG. 8, a part of the air curtain AC1 is depicted as an air curtain AC10.

As illustrated in FIG. 8, in the air curtain apparatus 1 of this third modification example, each of a plurality of blowers 11 includes a spraying unit (sprayer) 71 that sprays an antiseptic solution 71*a* inside a cylinder part 32. More specifically, in the air curtain apparatus of this third modification example, each of a plurality of blowers 11 includes means (function) of spraying the antiseptic solution 71*a* that inactivates or disinfects viruses or bacteria, in addition to a fan 33 that blows out air. An antiseptic solution containing ethyl alcohol (ethanol) or chorine, for example, may be used as the antiseptic solution 71*a*.

Consequently, in addition to obtaining the similar effects to the embodiment, the helical air current SA1 blown out from each of the plurality of blowers 11 contains the antiseptic solution SA1 and thus viruses or bacteria are easily inactivated or disinfected by the air curtain AC1 itself. Therefore, the air curtain AC1 itself is able to remove viruses or bacteria. As a result, in a case where the two users 52 (see FIG. 3) face each other or where the user 52 (See FIG. 3) and the employee 53 (See FIG. 3) face each other, with the air curtain AC in between, it is further possible to ensure that an infectious disease is reliably prevented from being transmitted between the two users 52 or between the user 52 and the employee 53.

Fourth Modification Example of Air Curtain Apparatus

Figure 9:
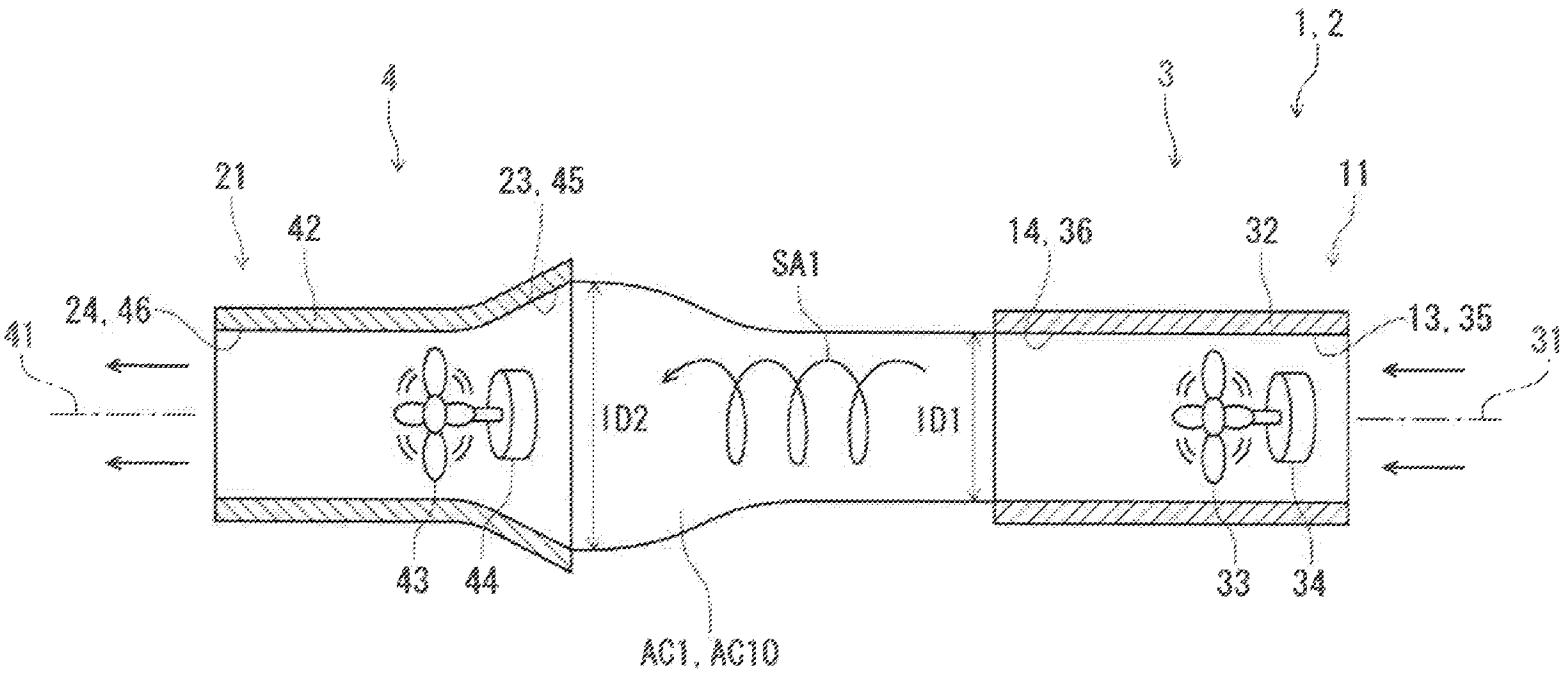
FIG. 9 is a top view schematically illustrating a configuration of an air curtain apparatus of a fourth modification example of the embodiment.

Next, a description of a fourth modification example of the air curtain apparatus of the embodiment is given. FIG. 9 is a cross-sectional diagram schematically illustrating a configuration of an air curtain apparatus of the fourth modification example of the embodiment. Note that in FIG. 9, a part of the air curtain AC1 is depicted as the air curtain AC10.

As illustrated in FIG. 9, in the air curtain apparatus 1 of this fourth modification example, in a pair of a blower 11 and a blower 21, an inner diameter ID2 of an air inlet port 23 included in the blower 21 is larger than an inner diameter ID1 of an air outlet port 14 included in the blower 11. In addition, a cylinder part 42 is able to have a shape with an inner diameter of the cylinder part 42 gradually increasing toward the air inlet port 23.

Consequently, in addition to achievement of the effects similar to the embodiment, further, an inner diameter ID2, which is an opening size of the air inlet port 23 included in the blower 21, is made wider than the inner diameter ID1, which is an opening size of the air outlet port 14 included in the blower 11. Therefore, the air inlet unit 4 sucks in air easily from the air inlet port 23 included in the blower 21 held by the air inlet unit 4, and it is possible to prevent or suppress air, which is blown out from the air outlet port 14 included in the blower 11 held by the air outlet unit 3, from being released without being sucked into the blower 21 held by the air inlet unit 4.

Fifth Modification Example of Air Curtain Apparatus

Figure 10:
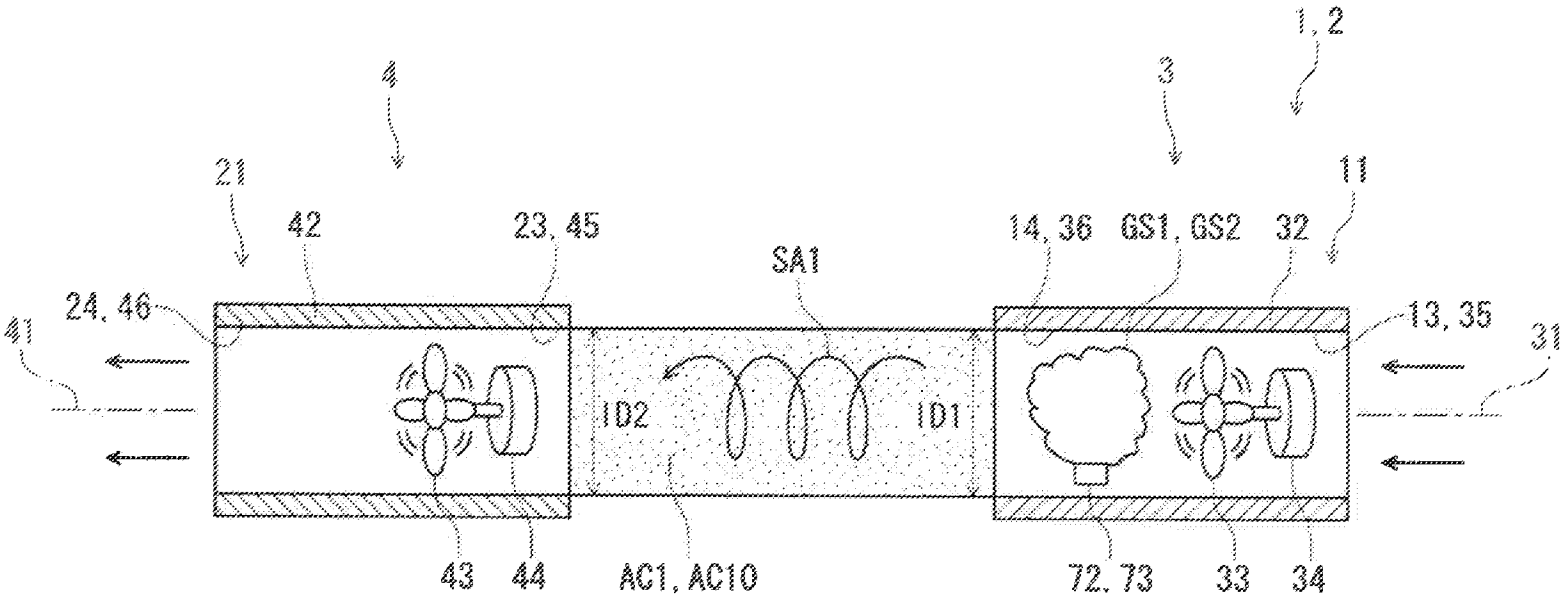
FIG. 10 is a top view schematically illustrating a configuration of an air curtain apparatus of a fifth modification example of the embodiment.

Next, a description is given of a fifth modification example of the air curtain apparatus of the embodiment. FIG. 10 is a cross-sectional diagram schematically illustrating a configuration of an air curtain apparatus of the fifth modification example of the embodiment. Note that in FIG. 10 a part of the air curtain AC1 is depicted as the air curtain AC10.

As illustrated in FIG. 10, in the example of the air curtain apparatus 1 of this fifth modification example, each of a plurality of blowers 11 includes an injection unit (injector) 72 that injects a colored gas GS1 into a cylinder part 32. More specifically, in the example of the air curtain apparatus 1 of this fifth modification example, the air curtain AC1 is colored or the air curtain AC1 contains smoke according to an application or a design of a space. This alerts users that the air curtain apparatus is installed, for example, and promotes awareness about prevention of the users or the like. Therefore, it possible to enhance the effect of preventing infection.

Coloring designed for strong alert includes yellow and black coloring like so-called "Tora Tape (safety stripe tape)" such as positive alert, no entry, or off-limits due to construction, and red coloring such as a pylon for alert on the road. In addition, coloring designed for further strong alert includes coloring by a relatively strong color such as a smoke marker. In addition, coloring includes coloring designed to make it objectively easy to understand that a space is separated by an air curtain. In addition, in a case where an air curtain is formed that allows for light communications, not strong off-limits, coloring includes coloring designed to encourage use of the air curtain with a little attention. In such a case, because it is loose alert, coloring is not necessary to be such a strong color, and coloring with a slightly weak color is sufficient.

In various spaces such as a sales floor of a store or the like, although a partition separating a space, or the like, may be installed, there are some cases in which it is desired to color the partition or the like according to the atmosphere of the sales floor, or the like. Furthermore, in some cases, a transparent but lightly colored partition may be preferred over a transparent and uncolored partition, from the perspective that it is better not to see faces clearly when users and employees face each other, like a cash desk (accounting).

According to the example of the air curtain apparatus 1 of this fifth modification example, in addition to achievement of the effect similar to the embodiment, by coloring the air curtain AC1 according to the application or the design of the space or by the air curtain AC containing smoke, it is further possible to meet the demand to color the partition or the like according to the atmosphere of the sales floor or the like or the demand that the faces are not seen too clearly in a case where the users and the employees face each other.

Alternatively, as illustrated in FIG. 10, in another example of the air curtain apparatus 1 of this fifth modification example, each of a plurality of blowers 11 includes an injection unit (injector) 73 that injects a gas GS2 containing a smell component into the cylinder part 32. More specifically, in the other example of the air curtain apparatus 1 of this fifth modification example, the air curtain contains a smell according to the application or the atmosphere of the space. This alerts users that the air curtain apparatus is installed, for example, and promotes awareness about prevention of the users or the like. Therefore, it is possible to enhance the effect of preventing infection.

Examples of the smell includes a smell fitted for a theme of a café or a restaurant or the like, or a smell of steak or popcorn, a smell fitted for an atmosphere of a theme park, or a smell fitted for flowers of the four seasons. Alternatively, examples include a smell of a refreshing atmosphere that matches business negotiations, or a smell of a relaxing atmosphere such as a massage parlor. Alternatively, examples include a smell having the effect of deodorizing near a smoking room or a toilet, or a smell reminiscent of the natural environment.

In various spaces such as a sales floor of a store or the like, there are some cases where it may be desirable to contain various types of smells such as a smell of coffee according to the atmosphere or theme of the sales floor. According to the other example of the air curtain apparatus 1 of this fifth modification example, in addition to achievement of the effect similar to the embodiment, by the air curtain AC1 containing a smell according to the application or atmosphere of the space, it is further possible to meet a demand to include various types of smells according to the atmosphere of theme of the sales floor.

It is to be noted that any one type or a plurality of types of the air curtain apparatus of the embodiment and the first to fifth modification examples of the embodiment may be combined, where appropriate.

Sixth Modification Example of Air Curtain Apparatus

Figure 11A:
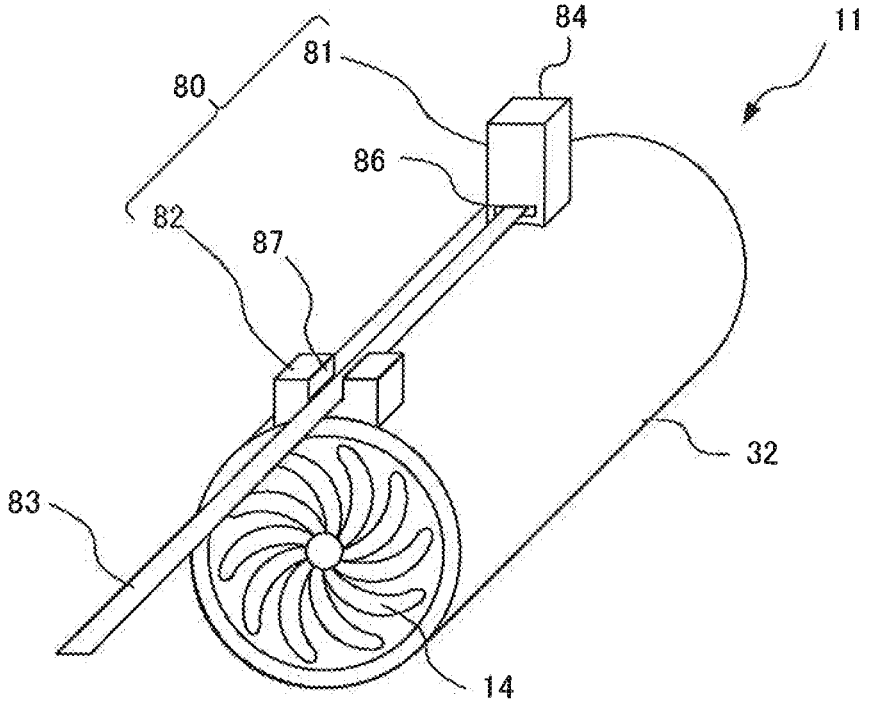
FIG. 11A is a perspective view schematically illustrating a configuration of a blower 11 according to an air curtain apparatus of a sixth modification example of the embodiment.
Figure 11B:
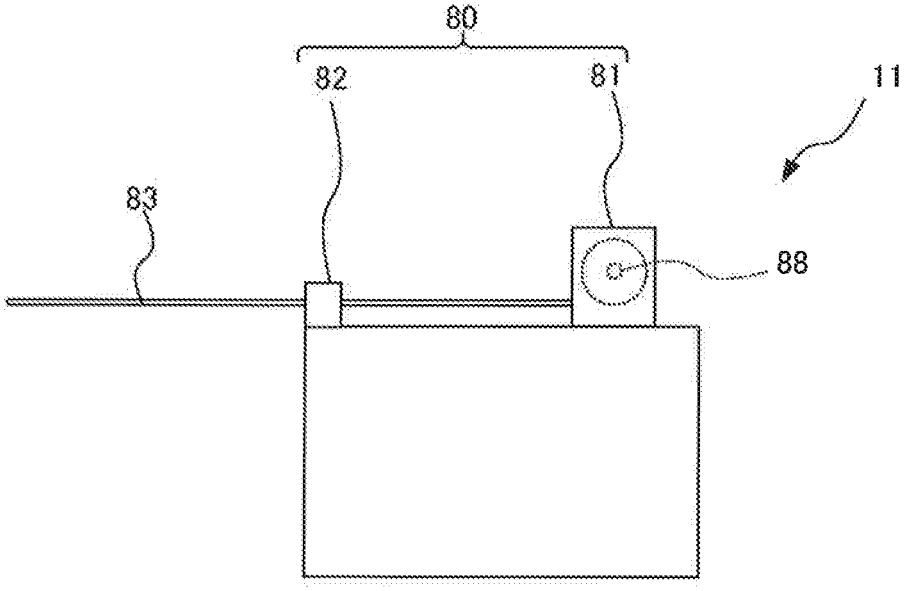
FIG. 11B is a lateral view schematically illustrating a configuration of the blower 11 according to the air curtain apparatus of the sixth modification example of the embodiment.

Next, a description is given of a sixth modification example of the air curtain apparatus of the embodiment. FIG. 11 is an explanatory diagram schematically illustrating a configuration of a blower 11 according to an air curtain apparatus of the sixth modification example of the embodiment. FIG. 11A is a perspective view and FIG. 11B is a lateral view. In the air curtain apparatus of the sixth modification example, the blower 11 includes an identification apparatus 80 that makes it possible to visually identify a traveling direction of the helical air current SA1 (see FIG. 1) blown out from an air outlet port 14 included in the blower 11.

The identification apparatus 80 includes a stretching part 81 and a placement part 82. The stretching part 81 includes a long steel strip-shaped member 83 and a storing body 84 that stores the strip-shaped member 83 in its wound state.

In the strip-shaped member 83, warp is formed from a central portion in a width direction toward both side parts. In a case where the strip-shaped member 83 is stretched straight, it is not broken easily due to the warp in the central part in the width direction, thus being maintained in a straightened state.

The storing body 84 is connected to a base end portion of the strip-shaped member 83, and includes a rotating shaft 88 capable of winding up the strip-shaped member 83; and a storing case rotatably supporting the rotating shaft 88 and storing the strip-shaped member 83 wound up by the rotating shaft 88. The storing body 84 also includes a drawer port 86 for drawing the strip-shaped member 83. The storing body 84 also includes a stopper function of maintaining the strip-shaped member 83 (not illustrated) in a drawn state and releasing the maintenance. When the stopper function is released, the rotating shaft 88 rotates and the strip-shaped member 83 is wound around the rotating shaft 88. A tip of the strip-shaped member 83 wound up by the rotating shaft 88 is positioned outside of the drawer port 86.

When the strip-shaped member 83 is wound up by the rotating shaft 88, the warp in the central portion becomes small and planar due to elastic deformation. Thus, the strip-shaped member 83 is wound up easily by the rotating shaft 88.

The drawer port 86 is formed in a rectangle that is slightly larger than a width of the strip-shaped member 83.

The placement part 82 includes an approximately cuboid member. With a lower surface being an arc-shaped surface recessed in a half-pipe shape, the placement part 82 is formed so that it may be placed on a side face of the cylinder part 32. In addition, a recess 87 is formed in a middle part of a top face of the placement part 82. The recess 87 is formed slightly larger than the width of the strip-shaped member 83, and extends parallel to an imaginary central axis of the arc-like surface on the lower surface. The recess 87 also penetrates an upper part of a front surface and that of a back surface of the approximately cuboid.

The placement part 82 is fixed to an upper part of a side edge portion of the air outlet port 14 on the side face of the cylinder part 32. The storing body 84 is fixed to the side face of the cylinder part 32, with a predetermined space with respect to the placement part 82. Here, in a front view of the blower 11 from side of the air outlet port 14, a bottom face of the recess 87 approximately matches that of the drawer port 86. The strip-shaped member 83 drawn from the storing body 84 may be placed inside the recess 87 of the placement part 82. Transverse movement of the strip-shaped member 83 placed in the placement part 82 is restricted by wall surfaces of both side parts of the recess 87. The tip of the strip-shaped member 83 which further extends from the placement part 82 extends approximately parallel to the central axis 31 (See FIG. 2). Here, the direction of the central axis 31 (See FIG. 31) is approximately parallel to the traveling direction of the helical air current blown out from the blower 11. Therefore, the direction in which the tip of the strip-shaped member 83 further extends from the placement part 82 is approximately parallel to the traveling direction of the helical air current.

When a second blower 11 is positioned with respect to a second blower 11, the strip-shaped member 83 is drawn from the storing body 84 and placed inside the recess 87 of the placement part 82. Further, by being drawn, the strip-shaped member 83 is caused to extend from the recess 87 of the placement part 82. This makes it possible to figure out the traveling direction of the helical air current blown out from the air outlet port 14 that is included in the blower 11, by visually recognizing the strip-shaped member 83 extending from the placement part 82. Consequently, it is possible to make the strip-shaped member 83 a mark in determining a location of the blower 21 which corresponds to the blower 11. After the location of the blower 21 is determined, it becomes possible to store the strip-shaped member 83 compactly, by rotating the rotating shaft 88 to cause the rotating shaft 88 to wind the strip-shaped member 83.

Figure 12A:
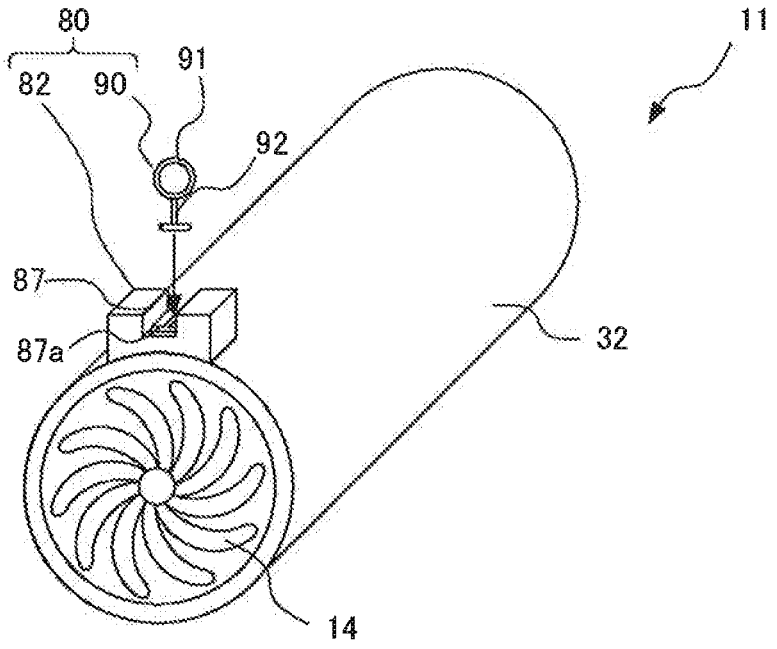
FIG. 12A is a perspective view illustrating another configuration 1 of an identification apparatus 80 in the sixth modification example.
Figure 12B:
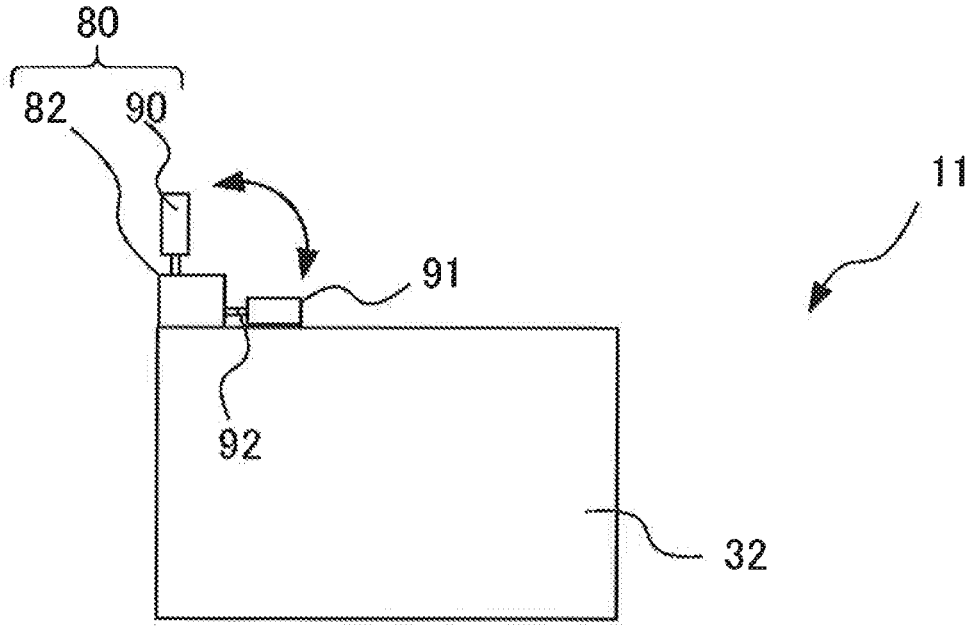
FIG. 12B is a lateral view illustrating the other configuration 1 of the identification apparatus 80 in the sixth modification example.

FIG. 12 is an explanatory diagram illustrating another configuration 1 of the identification apparatus 80 in the sixth modification example. FIG. 12A is a perspective view and FIG. 12B is a lateral view.

The identification apparatus 80 in the other configuration 1 includes the placement part 82 and a scope unit 90. Note that in the other configuration 1 illustrated in FIG. 12, the same members or the same functions as those of the air curtain apparatus of the sixth modification example may be designated by the same reference numerals, and a detailed description thereof is omitted.

The scope unit 90 includes a scope 91 and a support 92 that supports the scope 91. The scope 91 includes a cylindrical member. The support 92 forms a T-shape including a columnar bar-like horizontal shaft and a vertical shaft extending from the center of this horizontal shaft.

On the bottom face of the recess 87 is formed a T-shaped groove part 87*a* capable of storing the support 92. Both ends of a horizontal axis of the groove part 87*a* are formed as a hole part that is cut out more deeply than the wall surfaces of the recess 87. A vertical axis of the groove part 87*a* extends from a middle portion of the horizontal axis of the groove part 87*a* to side of the air inlet port 13.

Both ends of the horizontal shaft of the support 92 are rotatably supported by the hole parts (not illustrated) formed at the both ends of the horizontal axis of the groove part 87*a*. This makes it possible for the vertical shaft of the support 92 to swing in a direction along the imaginary central axis of the cylinder part 32. In addition, the placement part 82 is provided with a stopper mechanism that restricts swinging of the vertical shaft of the support 92. In a case where the vertical shaft of the support 92 is turned to the side of the air outlet port 14 and the vertical shaft of the support 92 is perpendicular to the imaginary central axis of the cylinder part 32, this stopper mechanism restricts further turning.

The scope 91 is fixed to a tip of the vertical shaft of the support 92.

When the second blower 11 is positioned with respect to the first blower 11, the vertical shaft of the support 92 is turned to the side of the air outlet port 14 till the movement is restricted. At this time, the imaginary central axis of the scope 91 is approximately parallel to the imaginary central axis of the cylinder part 32. Therefore, it becomes possible to figure out a direction to an object visually recognized via the scope 91 as the traveling direction of the helical air current blown out from the air outlet port 14 included in the blower 11. This allows for positioning of the air curtain apparatus by adjusting the location of the first blower 11 or the second blower 21, so that the upper part of the blower 21 may be visually recognized through the scope 91.

In a case where the scope 91 is not used, it is possible to turn the support 92 to side of the cylinder part 32 and keep it tilted down. At this time, the support 92 is stored in the groove part 87*a*.

Note that the scope 91 may be supported rotatably in a range of 90 degrees to the tip of the vertical shaft of the support 92. In a case where the scope 91 is not used, this makes it possible to turn the scope 91 by 90 degrees and tilt down the vertical shaft of the support 92 with the imaginary central axis of the scope 91 being approximately parallel to the horizontal shaft of the support 92. As a result, by rotating the scope 91 by 90 degrees, it is possible to tilt even a long scope 91, when not in use, to the side of the cylinder part 32 together with the support 92.

Figure 13A:
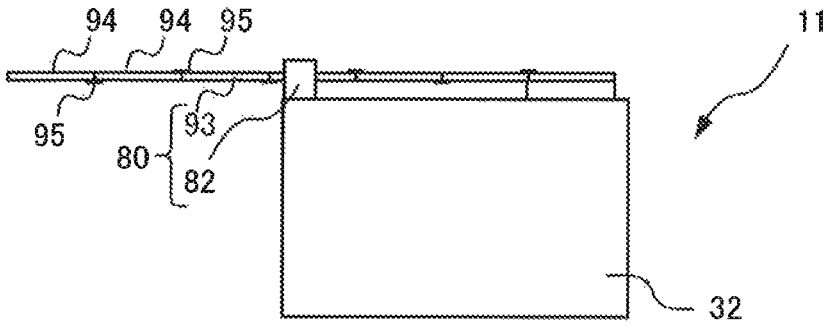
FIG. 13A is a lateral view illustrating another configuration 2 of the identification apparatus 80 in the sixth modification example.
Figure 13B:
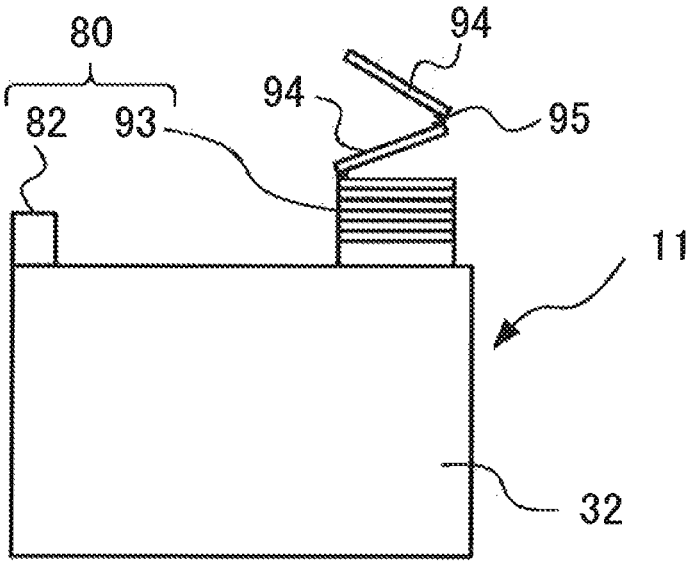
FIG. 13B is a lateral view illustrating a state prior to use of the other configuration 2 of the identification apparatus 80 in the sixth modification example.

FIG. 13 is a lateral view illustrating another configuration 2 of the identification apparatus 80 in the sixth modification example. FIG. 13A illustrates a state in use and FIG. 13B illustrates a state prior to use.

The identification apparatus 80 in the other configuration 2 includes the placement part 82 and a long member 93. Note that in the other configuration 2 illustrated in FIG. 13, the same members or the same functions as those of the air curtain apparatus of the sixth modification example as illustrated in FIG. 11 may be designated by the same reference numerals, and a detailed description thereof is omitted.

The long member 93 includes a plurality of short members 94 and a hinge 95 that connects the adjacent short members 94 to each other. The plurality of short members 94 is formed like a plate and all is of a same type. The hinge 95 connects ends of the two short members 94 in a longitudinal direction. When the two sort members 94 are unfolded, end faces of the two short members 94 in the longitudinal direction come into contact with each other, making a long strip shape. When the two short members 94 are folded, a lower surface of the other short member 94 is in contact with an upper surface of the one short member 94, thus resulting in a state in which the short member 94 is stacked on the short member 94.

The long member 93 is switchable from a form as illustrated in FIG. 13A in which the plurality of short members 94 is turned to make a long strip shape to a form as illustrated in FIG. 13B in which the plurality of short members 94 is turned to alternately stack the second lowest short member 94 on the lowest short member 94 to make a cuboid.

A locking mechanism (not illustrated) is provided at a connection region in the adjacent short members 94, 94. When the adjacent members 94, 94 are unfolded to form a single strip-shaped member, this locking mechanism makes it possible to maintain that state. In addition, in a front view of the blower 11 from the side of the air outlet port 14, a pedestal is placed between the cylinder part 32 and the lowest short member 94 so that a position of the bottom face of the recess 87 approximately matches that of the lower surface of the lowest short member 94.

As illustrated in FIG. 13A, the long member 93 is installed on the cylinder part 32 via the pedestal, with a predetermined space with respect to the placement part 82. In a case where the long member 93 is made to have a single long strip-shaped form as illustrated in FIG. 13A, a portion of the long member 93 is placed on the bottom face of the recess 87 in the placement part 82. As a result, because the short member 94 at the tip and the short member 94 at the base end portion are on the same level, the tip of the long member 93 extending from the placement part 82 extends approximately parallel to the central axis 31 (see FIG. 2).

Then, by visually recognizing the long member 93 extending from the placement part 83 in determining the location of the blower 21 corresponding to the blower 21, it becomes possible to figure out the traveling direction of the helical air current blown out from the air outlet port 14 included in the blower 11. As such, it becomes possible to make the strip-shaped member 83 a mark in determining the location of the blower 21 corresponding to the blower 11. After the location of the blower 21 is determined, it becomes possible to keep the long member 93 in a compact state, by folding the long member 93 and stacking the short member 94.

Figure 14A:
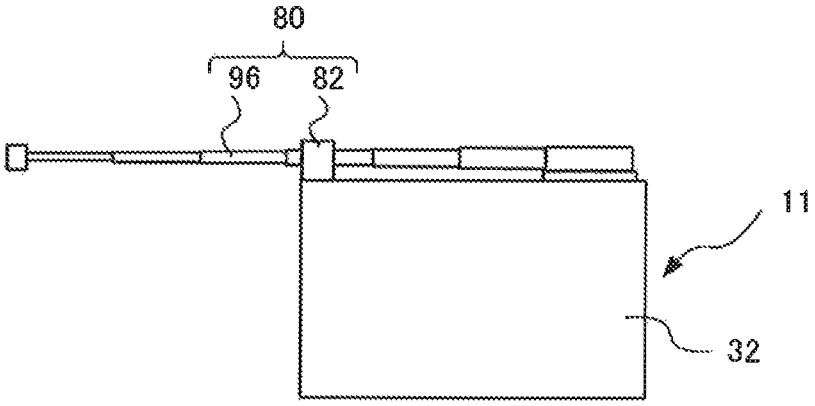
FIG. 14A is a lateral view illustrating another configuration 3 of the identification apparatus 80 in the sixth modification example.
Figure 14B:
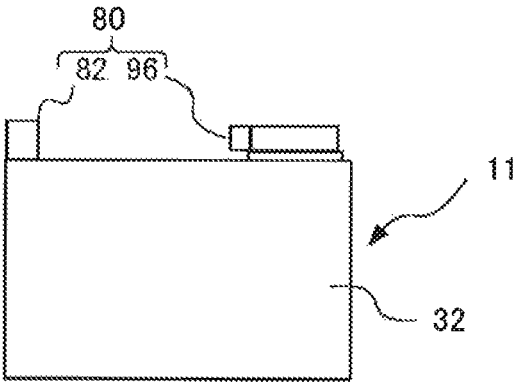
FIG. 14B is a lateral view illustrating a state prior to use of the other configuration 3 of the identification apparatus 80 in the sixth modification example.

FIG. 14 is a lateral view illustrating another configuration 3 of the identification apparatus 80 in the sixth modification example. FIG. 14A illustrates a state in use and FIG. 14B illustrates a state prior to use.

The identification apparatus 80 in the other configuration 3 includes the placement part 82 and a rod member 96. Note that in the other configuration 2 illustrated in FIG. 14, the same members or the same functions as those of the air curtain apparatus in the other configuration 2 of the sixth modification example as illustrated in FIG. 13 may be designated by the same reference numerals, and a detailed description thereof is omitted.

In the identification apparatus 80 in the other configuration 3, the long member 93 in the identification apparatus 80 in the other configuration 2 is replaced with the rod member 96.

The rod member 96 is such configured that a plurality of cylinder members is concentrically stored within a cylinder member of the largest diameter. The rod member 96 is a stretchable member that may be stretched longitudinally to a plurality of stages, by pulling the plurality of cylinder members from the inside of the cylinder member of the largest diameter, and that, to the contrary, may be stored inside the cylinder member of the largest diameter by pushing the other cylinder members into the cylinder member of the largest diameter.

As illustrated in FIG. 14A, the rod member 96 is installed on the cylinder part 32 via the pedestal, with a predetermined space with respect to the placement part 82. In a case where the rod member 96 is stretched so as to be a bar-like member, as illustrated in FIG. 14A, a portion of the rod member 96 is placed on the bottom face of the recess 87 in the placement part 82.

Here, the recess 87 in the placement part 82 is formed to have a width slightly larger than a diameter of the cylinder member placed on the recess 87 in the rod member 96. In addition, a position of the bottom face of the recess 87 is set to be slightly higher than the lowest position of the cylinder member of the largest diameter in the rod member 96 placed in the cylinder part 32. Specifically, the position of the bottom surface of the recess 87 is set to be higher than the lowest position of the cylinder member of the maximum diameter, only by a difference between a radius of the cylinder member of the largest diameter in the rod member 96 and that of the cylinder member placed on the recess 87 in the rod member 96. As a result, the tip of the rod member 96 extending from the placement part 82 extends approximately parallel to the central axis 31 (See FIG. 2).

Then, by visually recognizing the rod member 96 extending from the placement part 82 in determining the location of the blower 21 corresponding to the blower 11, it becomes possible to figure out the traveling direction of the helical air current blow out from the air outlet port 14 included in the blower 11. As such, it becomes possible to make the rod member 96 a mark in determining the location of the blower 21 corresponding to the blower 11. After the location of the blower 21 is determined, it becomes possible to keep the rod member 96 in a compact state, by pushing the tip of the rod member 96 into side of the cylinder part of the largest diameter.

Figure 15A:
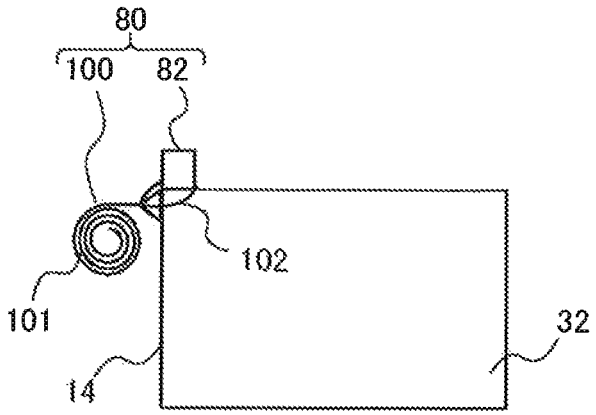
FIG. 15A is a lateral view illustrating another configuration 4 of the identification apparatus 80 in the sixth modification example.
Figure 15B:
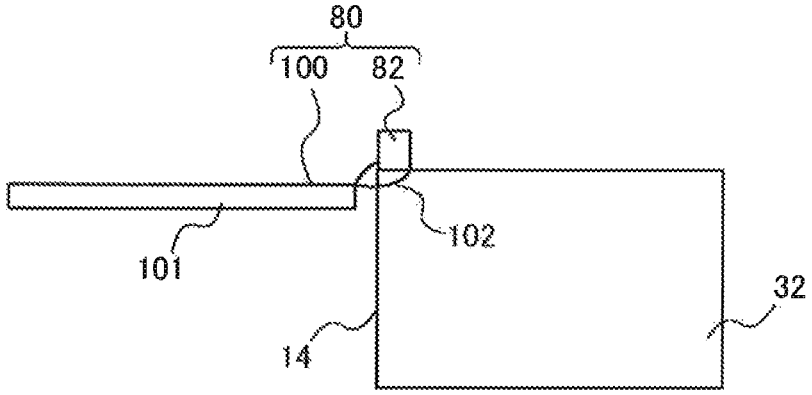
FIG. 15B is a lateral view illustrating a state of use of the other configuration 4 of the identification apparatus 80 in the sixth modification example.
Figure 15C:
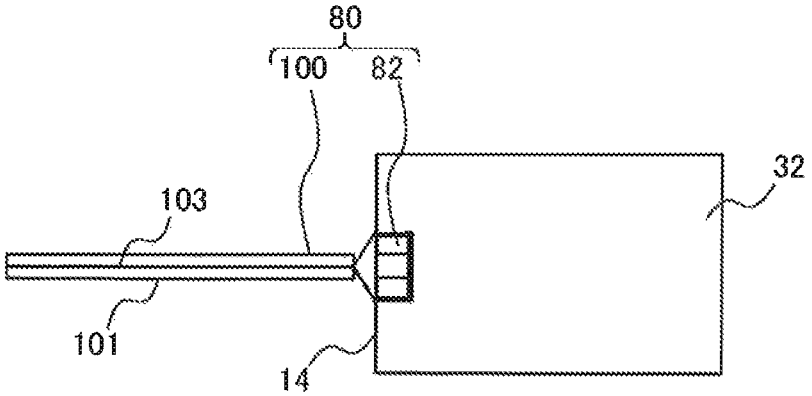
FIG. 15C is a lateral view illustrating the state of use of the other configuration 4 of the identification apparatus 80 in the sixth modification example.

FIG. 15 is a diagram illustrating another configuration 4 of the identification apparatus 80 in the sixth modification example. FIG. 15A is a lateral view illustrating a state prior to use, FIG. 15B is a lateral view illustrating a state in use, and FIG. 15C is a top view of FIG. 15B.

The identification apparatus 80 in the other configuration 4 includes the placement part 82 and a blow-back member 100. Note that in the other configuration 2 illustrated in FIG. 13, the same members or the same functions as those of the air curtain apparatus of the sixth modification example may be designated by the same reference numerals, and a detailed description thereof is omitted.

The blow-back member 100 includes a belt-like bag body 101 having an open base end portion and a closed tip; a ringed thread-like member 102 attached to the base end portion of the bag body 101 and capable of being hung on the placement part 82; and a linear spring member 103 attached to a middle portion of the bag body 101 in the width direction and extending along the longitudinal direction of the bag body. In the blow-back member 100, in a normal state, the spring member 103 is in a curled state like a spiral, and thus, the bag body 101 is maintained in the curled state like a spiral, as illustrated in FIG. 15A.

By hanging the thread-like member 102 on the placement part 82 while in use, the identification apparatus 80 of the other configuration 4 positions the blow-back member 100 in front of the blower 11 and causes the base end portion of the back body 101 to face the air outlet port 14.

Then, thereafter, turning the power on the blower 11 causes the helical air current to be blown out from the air outlet port 14. When the helical air current is blown out from the air outlet port 14, a portion of that air current flows from the base end portion of the bag body 101, thus maintaining the bag body 101 in a linearly extended state, as illustrated in FIG. 15B. A direction in which this bag body 101 is extended makes it possible to figure out the traveling direction of the helical air current blown out from the air outlet port 14 included in the blower 11. As such, it becomes possible to make the bag body 101 in the blow-back member 100 a mark in determining the location of the blower 21 corresponding to the blower 11. By stopping the blower 11 after the location of the blower 21 is determined, the bag body 101 returns to the curled state by deforming the spring member 103 in the helical shape of the original. Note that the bag body 101 in the curled state may be stored in the recess 87.

Figure 16:
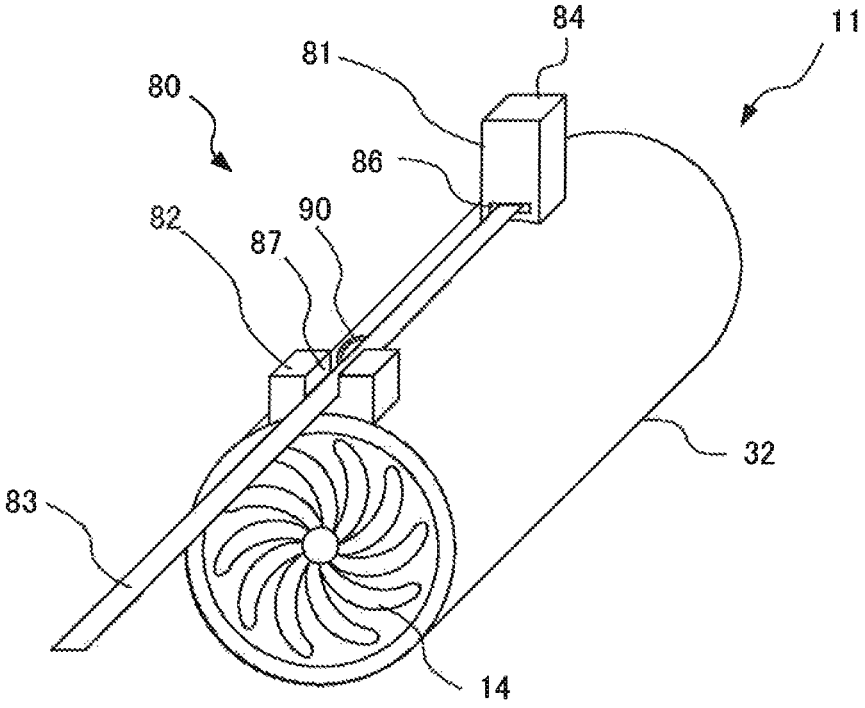
FIG. 16 is a perspective view illustrating an example of a configuration in which the identification apparatus 80 illustrated in FIG. 11 is combined with the identification apparatus 80 illustrated in FIG. 12.

Note that the identification apparatuses 80 illustrated in FIG. 11 to FIG. 15 may be combined where appropriate. FIG. 16 is a perspective view illustrating an example of a configuration in which the identification apparatus 80 of FIG. 11 and the identification apparatus 80 of FIG. 12 are combined. When the location of the blower 21 corresponding to the blower 11 is determined, first of all, as illustrated in FIG. 12, the scope unit 90 is raised to locate the blower 21 at a position where the blower 21 is visible through the scope unit 90. Then, scope unit 90 is tilted down to install the stretching part 81 in the cylinder part 32. As illustrated in FIG. 16, the strip-shaped member 83 is extended from the stretching part 81 to be installed in the placement part 82. Then, it is possible to determine the position of the blower 21 by adjusting the position of the blower 21 while looking at the strip-shaped member 83.

In addition, the identification apparatus 80 may be detachable with respect to the cylinder part 32. As a result, after alignment of the blower 21 of the air inlet unit 4 corresponding to one blower 11 in the plurality of blowers 11 of the air outlet unit 3 ends, it becomes possible to remove the identification apparatus 80, to attach the identification apparatus 80 to the next blower 11, and to align the blower 21 corresponding to the next blower 11.

Figure 17:
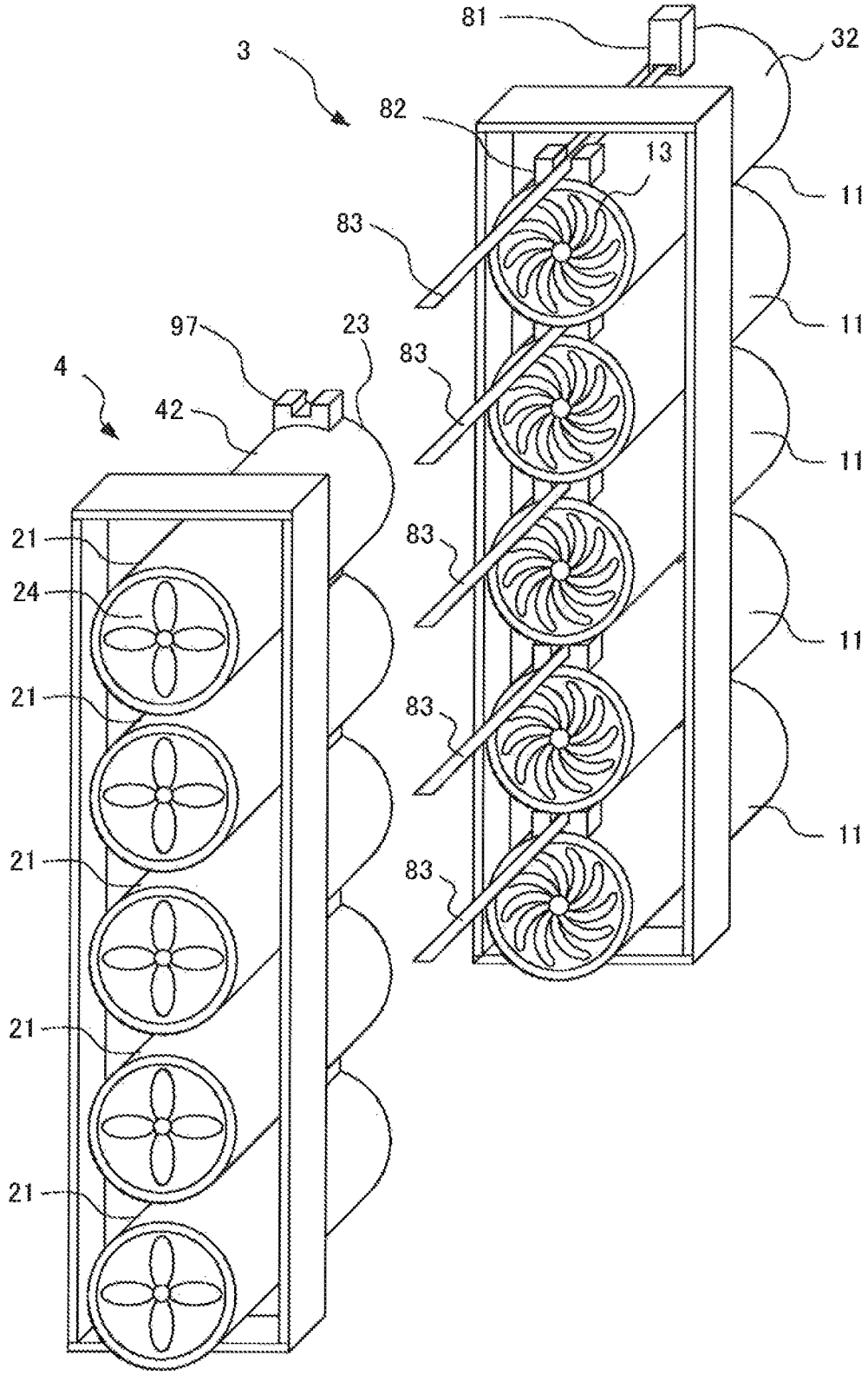
FIG. 17 is a perspective view illustrating an example of a configuration in which the identification apparatus 80 illustrated in FIG. 11 is attached to each of a plurality of blowers 11 in an air outlet unit 3.

In addition, the identification apparatus 80 may be installed individually to each of the plurality of blowers 11 of the air outlet unit 3. FIG. 17 is a perspective view illustrating an example of a configuration in which the identification apparatus 80 illustrated in FIG. 11 is attached to each of the plurality of blowers 11 of the air outlet unit 3. In the example illustrated in FIG. 17, a placement part 97 is attached to each of the plurality of blowers 21 held by the air inlet unit 4. The placement part 97 of the blower 21 is located on an upper part of a side edge portion of the air inlet port 23 in the cylinder part 42.

In alignment of the blower 11 and the blower 21, first, each of the strip-shaped members 83 is drawn from the stretching part 81 installed in each of the plurality of blowers 11 of the air inlet unit 3 and placed on the placement part 97, and the tip thereof is caused to extend from the blower 11. Then, the plurality of blowers 21 held by the air inlet unit 4 has is located to face the plurality of blowers 11 of the air outlet unit 3 at predetermined intervals. Then, the blower 11 is visually recognized from the side of the air outlet port 24 of the blower 21. A direction of the blower 21 is adjusted so that the tip of the strip-shaped member 83 is located in the placement part 97 of the blower 21. By making such an adjustment on the plurality of blowers 11 of the air outlet unit 3, it is possible to determine the position of the blower 21 with respect to the blower 11.

As described above, according to the sixth modification example, the direction in which the strip-shaped member 83, the long member 93, the rod member 96, or the blow-back member 100 extends serves as the mark that indicates the direction in which the helical air current flows from the blower 11. Therefore, by referring to this mark in locating the blower 21, it is possible to locate the blower 21 along the direction of the helical air current that flows from the blower 11. Moreover, by locating the blower 21 in the range visible through the scope unit 90, it is possible to locate the blower 21 along the direction of the helical air current that flows from the blower 11. As such, according to the sixth modification example, it is possible to visually determine the direction of the helical air current that blows from the blower 11, which thus makes it possible to easily install the air curtain apparatus.

Note that the light emitting unit 61 and the light receiving unit 62 may be provided in the blower 11 and the blower 21 of the sixth modification example. Furthermore, an output apparatus may be provided that outputs sound or an image when the light receiving unit 62 receives light from the light emitting unit 61. This makes it possible to inform a worker that positioning is complete, by the output apparatus outputting the sound or the image when the worker is performing a positioning work of the blower 21 with reference to the mark of the blower 11. In this case, the light from the light emitting unit 61 may be invisible light.

In addition, when the worker performs the positioning work of the blower 21 with reference to the mark of the blower 11, a pressure sensor is temporarily attached to the air inlet port 23 of the blower 21*a* so that a measurement result of this pressure sensor may be confirmed by a display apparatus. Then, the worker may adjust the position of the blower 11 and the position of the blower 21 so as to have the maximum wind pressure.

Seventh Modification Example of Air Curtain Apparatus

Next, a description is given of a seventh modification example of the air curtain apparatus of the embodiment.

Figure 18:
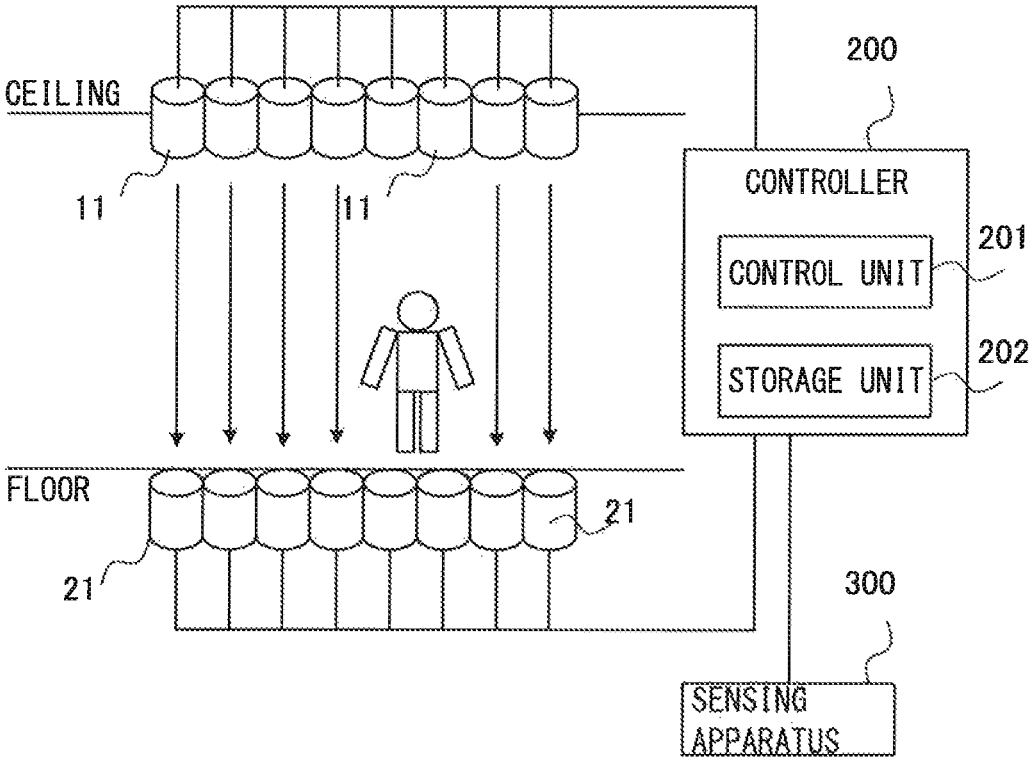
FIG. 18 is an explanatory diagram schematically illustrating a skeleton framework of a seventh modification example.

FIG. 18 is an explanatory diagram schematically illustrating a skeleton framework of the seventh modification example. An air curtain apparatus of the seventh modification example includes a plurality of blowers 11, a plurality of blowers 21 corresponding to the plurality of blowers 11, a controller 200 that drives and controls the blowers 11 and the blowers 21, and a sensing apparatus 300 that senses a person.

The plurality of blowers 11 is installed on a ceiling and the plurality of blowers 21 is installed on a floor. The plurality of blowers 11 blows out helical air currents vertically downward toward the floor. Located vertically below the plurality of blowers 11, the plurality of blowers 21 sucks in the helical air currents from the plurality of blowers 11 and blows out the helical air currents vertically downward. As a result, it is possible to form an air screen in the up-down direction by the plurality of blowers 11 and blowers 21.

The controller 200 includes a control unit 201 that controls an air curtain apparatus and a storage unit 202 that stores various types of programs. In the storage unit 202 are stored a program that determines positional information of a person on the basis of sensing information from the sensing apparatus 300, a program that controls on or off of the blowers 11 and the blowers 21, an increase or decrease in an air quantity, or the like on the basis of the positional information of the person, or the like. The control unit 201 is able to individually control the plurality of blowers 11 and blowers 21. Consequently, the control unit 201 is able to perform control, such as increasing or decreasing a breadth of the air screen.

The control unit 201 is not specifically limited as long as the control unit 201 is able to individually control the plurality of blowers 11 and blowers 21. The control unit 201 may be a control unit having one or more electronic circuits including a microcomputer or an integrated circuit (Integrated Circuit, IC) which is configured by using a CPU (Central Processing Unit), a RAM (Random Access Memory), and a ROM (Read Only Memory) or the like.

The storage unit 202 is an apparatus in which data or a file is stored, and has a data storage unit implemented by using one or more storage means exemplified by a hard disk, a semiconductor memory, a storage medium, and a memory card, or the like.

The sensing apparatus 300 senses a position of a person and transmits information thereof to the controller 200. As the sensing apparatus 300 may be applied an imaging apparatus such as a camera, a thermo-camera; an optical sensing apparatus including a light-emitting element that generates laser or far infrared rays and a light-receiving element that receives light emitted from this light-emitting element, and that senses a person on the basis of whether or not there is light sensed by the light-emitting element; a contactless sensing apparatus including a card having a radio-wave-type RFID tag carried by a person and a tag reader capable of long-distance communication with this radio-wave-type RFID tag.

In the case of the imaging apparatus, it is possible to determine a presence of a person and a position thereof by the controller 200 analyzing imaged data from the imaging apparatus.

In the case of the optical sensing apparatus, for example, a plurality of light-emitting elements is arranged in a matrix on a ceiling, and a plurality of light-receiving elements is arranged in a matrix on a floor. Then, the controller 200 monitors output of the light-receiving elements and determines the light-receiving element whose output switches from an ON state to an OFF state. A position of the light-receiving element determined at this time corresponds to the position of the person.

In the case of the contactless sensing apparatus, for example, three or more tag readers are located to surround the floor. Each of the tag readers transmits to the controller 200 information of the read radio-wave-type RFID tag and information on a direction of the radio wave from the radio-wave-type RFIG tag. The controller 200 determines a common position of the radio-wave-type RFID tags read by the three or more tag readers, on the basis of the information on the direction of the radio wave from the radio-wave-type RFID tag that is obtained from the three or more tag readers. The position of the radio-wave-type RFID tag determined at this time corresponds to the position of the person.

Although it is not an essential aspect, it is preferable that the radio-wave-type RFID tag and the tag reader be a tag and a tag reader of a microwave type. The microwave type tag and tag reader may read a relatively remote tag to the extent of a few meters. Therefore, by the radio-wave-type RFID tag and the tag reader each being the microwave type tag and tag reader, the radio-wave-type RFID tag may be read by a relatively small number of three or more tag readers. Therefore, a configuration of the tag reader may be made simpler.

In the case of the contactless sensing apparatus, a configuration may be such that three or more electromagnetic induction type tags and tag readers are used. The electromagnetic induction type tags and tag readers may be configured at a relatively low cost. By the contactless sensing apparatus having the configuration that the three or more electromagnetic induction type tags and tag readers are used, the contactless sensing apparatus may be configured at a relatively low cost.

In the case of the contactless sensing apparatus in which the three or more tag readers are located so as to surround the floor, for radio waves transmitted by the radio-wave-type RFID tags according to a transmit command from the tag reader, a position of the radio-wave-type RFID tag may be estimated by using a time span from transmission of the transmit command till reception of the radio wave by each of the three or more tag readers.

Use of the time span from the transmission of the transmit command till the reception of the radio wave allows for estimation of a distance from the tag reader to the radio-wave-type RFID tag. Therefore, use of the time span from the transmission of the transmit command till the reception of the radio wave by each of the three or more tag readers allows for estimation of each distance from each of the three or more tag readers to the radio-wave-type RFID tag. Use of the distances makes it possible to perform three-point positioning that estimates a target position using distances from three points positions of which are known.

Therefore, use of the time from the transmission of the transmit command till reception of the radio wave by each of the three or more tag readers allows for estimation of the position of the radio-wave-type RFID tag by means of the three-point positioning. This makes it possible to estimate a position of the radio-wave-type RFID tag even if the tag reader does not have a configuration to obtain the information on the direction of the radio wave from the radio-wave-type RFID tag.

A method of estimating the position of the radio-wave-type RFID tag using each of the time spans from the transmission of the transmit command till the reception of the radio wave by the three or more tag readers is not specifically limited, and may be a method of estimating a target position by a prior-art radar apparatus having three or more receiving antennas, for example.

A procedure to estimate the position of the radio-wave-type RFID tag using each of the time spans from the transmission of the transmit command till the reception of the radio wave by each of the three or more tag readers may estimate the position of the radio-wave-type RFID tag using information on a difference between the time spans from the transmission of the transmit command till the reception of the radio wave by the respective three or more tag readers. The information is, for example, information exemplified by a phase difference and a frequency difference in the radio waves received by the three or more tag readers. This makes it possible to estimate the position of the radio-wave-type RFID tag using the information on the difference in the respective time spans, even if each of the time spans from the transmission of the transmit command till the reception of the radio wave by each of the three or more tag readers includes an error.

The method of estimating the position of the radio-wave-type RFID tag using the information on the difference in the respective time spans from the transmission of the transmit command till the reception of the radio wave by the three or more tag readers is not specifically limited, and may be, for example, the method of estimating the target position by the prior-art radar apparatus having the three or more receiving antennas.

Then, the controller 200 determines a position to form an air curtain depending on the position of the person and drives the plurality of blowers 11 and blowers 21 located at the position.

Although it is not an essential aspect, it is preferable that the air curtain apparatus have marker means capable of informing a passenger of a preferred boarding position. The preferred boarding position is, for example, a position where an air curtain is not formed. This makes it possible to provide the air curtain apparatus capable of preventing any passenger from boarding at an unfavorable position where the air curtain is formed, or the like, and more efficiently preventing mixing of foreign matters or the like. The marker means is not specifically limited and may be, for example, a mark indicating a boarding position posted on the ceiling, a mark indicating a boarding position posted on the floor, or the like. The mark is not specifically limited, and may be a mark including a picture, a figure, and/or a line or the like indicating a preferred boarding position in a case where passengers are divided and board.

Flowchart of Seventh Modification Example

Figure 19:
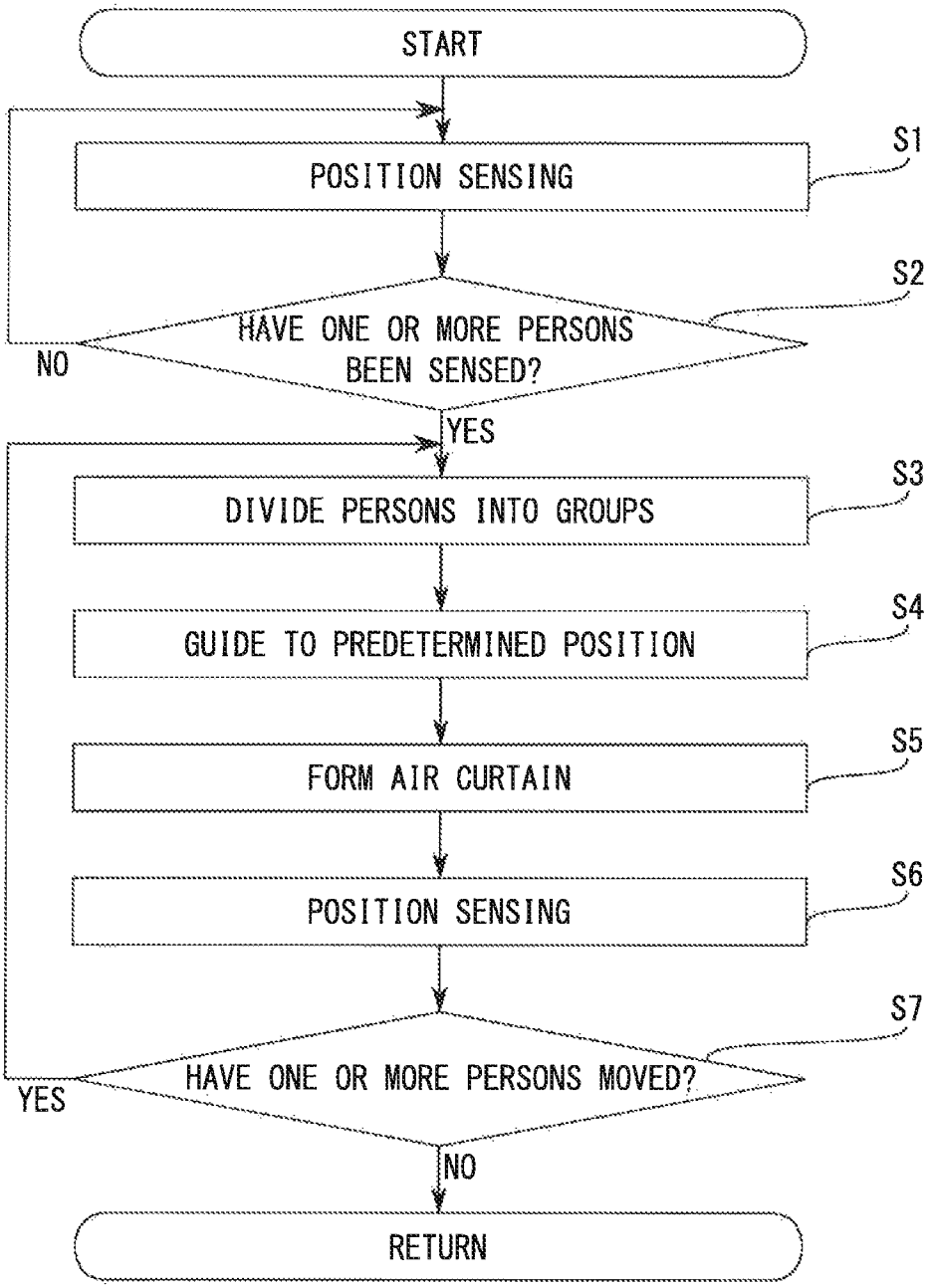
FIG. 19 is a flow chart illustrating an example of preferred flow of a ventilation process to be performed in a controller 200 according to the seventh modification example.

FIG. 19 is a flowchart illustrating an example of preferable flow of a ventilation process to be performed by the controller 200 according to the seventh modification example. In the following, a description is given of the preferable flow of ventilation control to be performed by the controller 200, with reference to FIG. 19.

[Step 1: Position Sensing]

In cooperation with the storage unit 202 and the sensing apparatus 300, the control unit 201 performs a process to sense information on a position of a person (step S1). The control unit 201 shifts the process to step S2. It is possible to use the sensed information to drive the plurality of blowers 11 and blowers 21 by performing the process to sense the information on a position of a person.

Means to sense a position is not specifically limited and may be any means to use means to sense various positions held by the sensing apparatus 300. It is preferable that the means to sense a position be able to sense positions of a plurality of persons. This makes it possible to drive the plurality of blowers 11 and blowers 21 so as to prevent foreign matters from being mixed into a space where each of the plurality of persons is located, in accordance with the information on positions of the plurality of persons.

In a case where the sensing apparatus 300 includes the three or more tag readers capable of sensing the radio-wave-type RFID tag, it is preferable that the means to sense the position include a procedure to determine a position of a common radio-wave-type RFID tag read by the three or more tag readers, on the basis of information on directions of radio waves from the radio-wave-type RFID tag, the information being obtained from the three or more tag readers. As a result, the position of the radio-wave-type RFID tag may be determined, using an intersecting point where the respective directions of the obtained radio waves intersect.

In a case where the sensing apparatus 300 includes the three or more tag readers capable of sensing the radio-wave-type RFID tag, it is preferable that the means to sense the position include a procedure to estimate the position of the radio-wave-type RFID tag, using each of the time spans from the transmission of the transmit command to the reception of the radio wave by the three or more tag readers, for the radio waves transmitted by the radio-wave-type RFID tags according to the transmit command from the tag readers. This makes it possible to estimate the position of the radio-wave-type RFID tag using the three-point positioning. The procedure is not specifically limited, and may be a procedure including the means for the prior-art radar apparatus having the three or more antennas to estimate the target position.

In a case where the sensing apparatus 300 includes the three or more tag readers capable of sensing the radio-wave-type RFID tag, it is preferable that the means to sense the position include a procedure to estimate the position of the radio-wave-type RFID tag, using the information on the difference in the respective time spans from the transmission of the transmit command till the reception of the radio wave by the three or more tag readers. This makes it possible to estimate the position of the radio-wave-type RFID tag even if each of the time spans from the transmission of the transmit command till the reception of the radio wave by each of the three or more tag readers includes an error. The procedure is not specifically limited, and may be a procedure including the means for the prior-art radar apparatus having the three or more receiving antennas to estimate the target position.

It is preferable that the means to sense the position be able to obtain information on each of the plurality of persons. This makes it possible to drive the plurality of blowers 11 and blowers 21 so that the information on each of the plurality of persons is used to prevent foreign matters from being mixed into the space where each of the plurality of persons is located. The information on the person is not specifically limited.

The information on the person may be information that includes one or more of, for example, personal information exemplified by a person's name, contact information, height, age, an overseas travel record, and personal medical history or the like, group information that makes it possible to identify a group to which a person belongs, or attribute information exemplified by a person's body temperature or the like.

[Step S2: Determination of Whether One or More Person are Sensed]

In cooperation with the storage unit 202, the control unit 201 performs a process to determine whether or not one or more persons are sensed, on the basis of the position of the person sensed in step S1 (step S2). If the one or more persons are sensed, the control unit 201 shifts the process to step S3. If the one or more persons are not sensed, the control unit 201 shifts the process to step S1.

If the one or more persons are not sensed, it is preferable that the control unit 201 further perform a process to stop driving of the plurality of blowers 11 and blowers 21. This makes it possible to reduce consumption of energy for generating an air curtain in a case where no person is sensed.

[Step S3: Dividing Persons into Groups]

In cooperation with the storage unit 202, the control unit 201 performs a process to divide persons into groups on the basis of the position of the person sensed in step S1 (step S3). The control unit 201 shifts the process to step S4. As a result, the plurality of persons may be divided into a plurality of groups in a case where the plurality of persons is sensed. In addition, in a case where one person is sensed, the one person is separated to one group. The process to divide persons into groups is not specifically limited.

It is preferable that the process to divide persons into groups include a process to assign a plurality of persons whose positions are close to each other into a same group. This makes it possible to prevent assignment to another group of the plurality of persons who are close to each other and any person of whom may be exposed to the wind when separated by an air curtain. Therefore, it is possible to prevent exposure of the person to wind in attempt to separate such a plurality of persons assigned to the other group by the air curtain.

It is preferable that the process to divide persons into groups include a process to divide persons into groups using the information related to a person. This makes it possible to obtain a group relationship of a plurality of persons using the information on the person and divide two or more persons of the plurality of persons who have the group relationship into a same group. The two or more persons having the group relationship are expected to be at positions close to each other. Therefore, it is possible to prevent such two or more persons from being exposed to wind in an attempt to separate them by the air curtain.

Although it is not the essential aspect, it is preferable that the controller 200 perform a process to guide to a predetermined position performed by step S4.

[Step S4: Guiding to Predetermined Position]

In cooperation with the storage unit 202, the control unit 201 performs a process to guide so as to move to a predetermined position based on the groups divided in step S3 (step S4). The control unit 201 moves the process to step S5. This makes it possible to move the respective persons divided into the respective groups to positions where they are easily separated by the air curtain. Therefore, these groups and/or persons may be easily separated by the air curtain. Means to guide movement to the predetermined position is not specifically limited and may be the prior-art means to guide persons, exemplified by means using audio output and/or image display, or the like.

[Step S5: Forming Air Curtain]

In cooperation of the storage unit 202, the plurality of blowers 11 and the plurality of blowers 21, the control unit 201 performs a process to form the air curtain so as to separate the groups (step S5). The control unit 201 shifts the process to step S6. This makes it possible to form the air curtain and separate the groups. Therefore, foreign matters may be prevented from being mixed into a space corresponding to each of the groups, from outside of the space. The process to form the air curtain so as to separate the groups is not specifically limited.

It is preferable that the process to form the air curtain so as to separate the groups include a process to drive the plurality of blowers 11 and the plurality of blowers 21 that are adjacent to a cylindrical area. The cylindrical area has a central axis that passes through a periphery of the position of the person and is in a direction approximately coinciding with a vertical direction. As a result, a cylindrical air curtain that surrounds the person may be generated. This air curtain may prevent foreign matters from being mixed into a position away from the person.

It is preferable that the process to form the air curtain so as to separate the groups include a process to drive the plurality of blowers 11 and the plurality of blowers 21 that are adjacent to a cylindrical area. The cylindrical area has the central axis that passes through a position shifted by a predetermined distance from the position of the person in a traveling direction of the person and is in the direction approximately coinciding with the vertical direction. As a result, the cylindrical air curtain may be generated that surrounds the person according to the direction in which the person moves. This air curtain may further prevent mixing of foreign matters from the direction in which the person moves, while preventing foreign matters from being mixed from the position away from the person.

In a case where the cylindrical air curtains surrounding the plurality of persons are in contact with each other, it is preferable that the process to form the air curtain perform a process not to drive the plurality of blowers 11 and the plurality of blowers 21 included in an area which is inside of two or more cylindrical air curtains. This may prevent a person surrounded by the cylindrical air curtain from being exposed to the cylindrical air curtain that surrounds another person.

In a case where the process not to drive the plurality of blowers 11 and the plurality of blowers 21 surrounded by the area which is the inside of the two or more cylindrical air curtains is performed, it is preferable that for intersecting points where the two or more cylindrical air curtains intersect each other, the process to form the air curtain include a process to drive the plurality of blowers 11 and the plurality of blowers 21 that are in contact with two or more line segments connecting the intersecting points. As a result, even if the cylindrical air curtains surrounding the plurality of persons are in contact with each other, an air curtain may be formed so as to separate the plurality of persons from each other.

The process to form the air curtain so as to separate the groups may be a process including a procedure to drive one or more of the plurality of blowers 11 and the plurality of blowers 21 that are in contact with a perpendicular bisector of the line segment connecting two persons. This makes it possible to form a flat plate like air curtain in contact with the perpendicular bisector. This air curtain may prevent foreign matters from being mixed from a periphery of a person to that of another person.

It is preferable that the process to form the air curtain so as to separate the groups include a process to drive the plurality of blowers 11 and the plurality of blowers 21 in contact with the two or more cylindrical areas. The two or more cylindrical areas have a central axis that passes through the periphery of the position of the person, passes through the periphery of the position of the person, and is in the direction approximately coinciding with the vertical direction. As a result, the cylindrical air curtain that multiply surrounds the person may be generated. This air curtain may further prevent foreign matters from being mixed from the position away from the person.

It is preferable that the process to form the air curtain to separate the groups include a process to drive the plurality of blowers 11 and the plurality of blowers 21 so as to form an air curtain that surrounds a specific area. As a result, an air curtain may be generated that surrounds a specific area where the person is frequently located, for example. This air curtain may further prevent mixing of foreign matters.

The specific area is not specifically limited, and may be, for example, an area where a person is located, the area being exemplified by a boarding area provided by dividing inside of an elevator, a working area of a surgeon, and a working area of an assistant, as well as surroundings of furniture exemplified by a table, a chair, a desk, a sofa, and a bed, and surroundings of equipment exemplified by an operating table, etc., or the like.

In a case where it is possible to drive the plurality of blowers 11 and plurality of blowers 21 so as to form the air curtain that surrounds the specific area, it is preferable that the process to form the air curtain so as to separate the groups include a process to drive the plurality of blowers 11 and the plurality of blowers 21 using the information on the person. As a result, the air curtain may be generated that surrounds the specific area where the person having specific information is frequently located, for example. This air curtain may further prevent mixing of foreign matters.

[Step S6: Position Sensing]

In cooperation with the storage unit 202 and the sensing apparatus 300, the control unit 201 performs a process to sense information on the position of the person (step S6). The control unit 201 shifts the process to step S7. By performing the process to sense the information on the position of the person, it is possible to determine whether or not the person has moved, using the sensed information.

[Step S7: Determining Whether or not One or More Persons have Moved]

In cooperation with the storage unit 202, the control unit 201 performs a process to determine whether or not one or more persons have moved, on the basis of each of the positions of the persons sensed in step S1 and step S6 (step S7). If the one or more persons have moved, the control unit 201 shifts the process to step S3. If the one or more persons have not moved, the control unit 201 ends the ventilation control and repeats the processes of step S1 to step S7. This makes it possible to form an air curtain according to the movement of the persons. Therefore, mixing of foreign matters may be further prevented.

Utilization Example 1 of Seventh Modification Example

Figure 20:
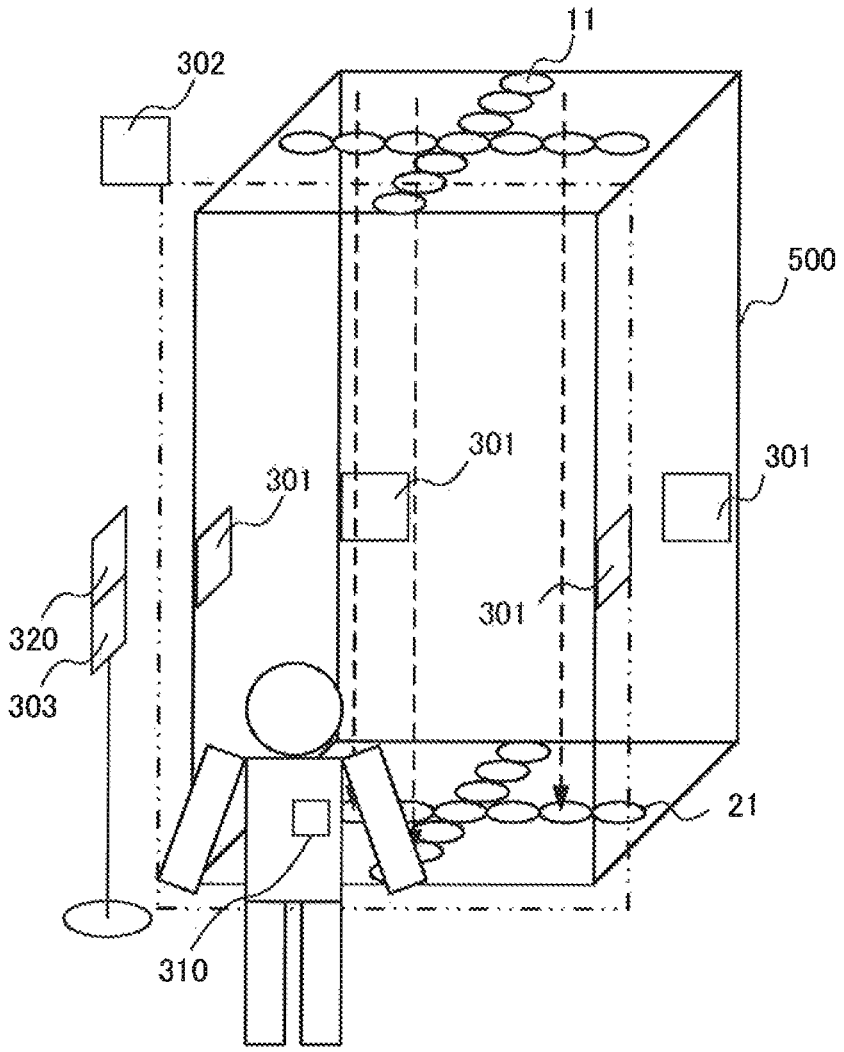
FIG. 20 is an explanatory diagram schematically illustrating a utilization example 1 in which the seventh modification example is utilized in an elevator.

FIG. 20 is an explanatory diagram schematically illustrating an example in which the seventh modification example is utilized in an elevator. The plurality of blowers 11 is arranged in a cross shape on the ceiling of an elevator car 500 and the plurality of blowers 21 is arranged in a cross shape on the floor. As a result, in a case where all of the plurality of blowers 11 and the plurality of blowers 21 is driven, inside of the elevator car 500 is divided into four areas by air curtains. In addition, it is possible to change patterns of the air curtains by selecting the plurality of blowers 11 and the plurality of blowers 21 to be driven.

FIG. 21 is a top view illustrating patterns of the air curtain. FIG. 21 illustrates an example in which the inside of the elevator car 500 is divided into four areas (FIG. 21A, for example), an example in which the inside is divided into three areas by dividing the back part into halves (FIG. 21B, for example), an example in which the inside is divided into two parts of the front side and the back side (FIG. 21C, for example), an example in which the inside is divided into right and left parts (FIG. 21D, for example), and an example in which the inside is divided into a left back part and other parts (FIG. 21E, for example), respectively. In this manner, combining a group of the blowers, which are arrayed from the center of the ceiling and that of the floor of the elevator car 500 in front-rear and right-left directions, makes it possible to change separation patterns by the air curtains, as illustrated in FIG. 21. Consequently, it is possible to change the separation patterns by the air curtains to large, medium, or small, according to the number of persons in a group or a body shape.

In the usage example 1 of the seventh modification example, a description is given of a case where a contactless sensing apparatus is applied as the sensing apparatus 300. The sensing apparatus 300 includes a contactless sensing apparatus including tag readers 301 to 303 and a radio-wave-type RFID tag 310. In the radio-wave-type RFID tag 310 is registered in advance various types of information including a card number uniquely assigned to each of the radio-wave-type RFID tags 310, personal information that allows for identification of an owner of the radio-wave-type RFID tag 310, group information that allows for identification of a group relationship such as company colleagues, family members, or friends, and attribute information which is characteristic information on the owner of the radio-wave-type RFID tag 310.

The personal information includes a name or contact information or the like, for example. The group information includes a group identification number automatically assigned to each group. More specifically, a same group identification number is stored in radio-wave-type RFID tags 310 of persons belonging to a same group. The attribute information is appropriately registered according to a purpose of use of a building having the elevator that utilizes the seventh modification example. For example, in a case where the building is a hospital, as the attribute information, job types such as a doctor, a nurse, or other staff members are stored for a person who works at the hospital, or for a patient, information such as whether he or she has returned from abroad in two weeks, whether he or she has a pre-existing disease, or whether his or her body temperature is 37.5 degrees or higher is stored. In addition, in a case where a building is a hall in which a theatrical play or a lecture takes place, as the attribute information, information such as a theatrical group name, a height or age, or a role is stored for a theatrical group member; for a speaker of the lecture, information identifying that he or she is the speaker is stored; or for a spectator, information identifying that he or she is the spectator is stored.

The tag readers 301 are arranged inside the elevator car 500, and the tag readers 302 and 302 are arranged at an entrance of the elevator. Inside the elevator car, the tag readers 301 are arranged at four corners at a height near a person's chest, for example. At the entrance to the elevator are arranged the tag reader 302 and the tag reader 303.

The tag readers 301 wirelessly communicate with the radio-wave-type RFID tags 310 of those who board the elevator car 500 to read the personal information from the radio-wave-type RFID tag 310, requests information on receiving directions of radio waves from the radio-wave-type RFID tags 310, and transmits the information to the controller 200.

The tag readers 302 read the radio-wave-type RFID tag possessed by those who line in front of the entrance of the elevator while waiting to board the elevator. The tag reader 303 reads the radio-wave-type RFID tags possessed by those who intend to board the elevator car 500. The tag readers 302 and the tag reader 303 transmit the read information to the controller 200.

Hereinafter, a description is given of control by the controller 200.

On the basis of the group information read by the tag readers 302 from the radio-wave-type RFID tags 310, the controller 200 determines a group relationship among the persons waiting for boarding to decide on a pattern of an air curtain and determines areas of the inside of the elevator car 500 where the persons are to board. The controller 200 determines to have persons having a group relationship board in the same area, whenever possible.

When the elevator car 500 arrives and its door opens and every time those who are waiting board one by one, the tag reader 303 reads the group information from the radio-wave-type RFID tag 310, and the controller 200 drives and controls a guiding apparatus 320 on the basis of the information read by the tag reader 303. The guiding apparatus 320 performs audio output or screen display to guide those who intend to board, on an area inside of the elevator car 500 to board.

Then, after passengers get in the elevator car 500 and the entrance door closes, the tag readers 301 inside the elevator car read passengers' radio-wave-type RFID tags 310 and transmits to the controller 200 requesting information on directions of the passengers with respect to the tag readers 301. The controller 200 obtains the identification numbers and the personal information from the radio-wave-type RFID tags 310 of the persons on board. The controller 200 further determines a position of each passenger on board on the basis of the information on the receiving directions from the four tag readers 301. In a case where the controller 200 determines that the passenger is located as he or she has been guided, the controller 200 drives the plurality of blowers 11 and the blowers 21 so that a predetermined pattern of the air curtain is formed.

Hereinafter, a description is given of the utilization example 1 of the seventh modification example in more detail, by way of an example of a hospital elevator.

First, as a premise, it is assumed that hospital staff members and patients each carry a card with the radio-wave-type RFID tag 310. A new patient or a visitor is given the card with radio-wave-type RFID tag 310 at a reception desk at the entrance of the building. For example, if there is a plurality of visitors, a same group identification number is stored in the cards given to the plurality of visitors.

Figure 21A:
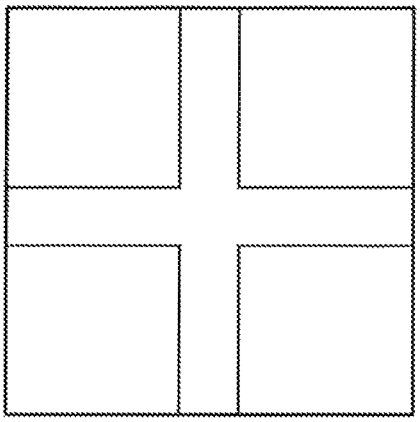
FIGS. 21A-21F are top views illustrating air curtain patterns in the utilization example 1.
Figure 21B:
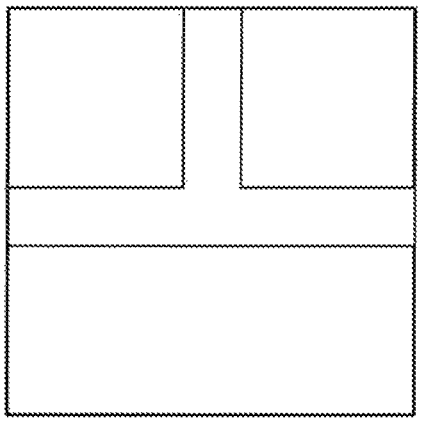
Figure 21C:
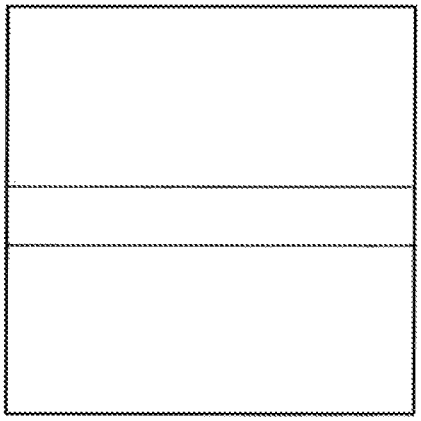
Figure 21D:
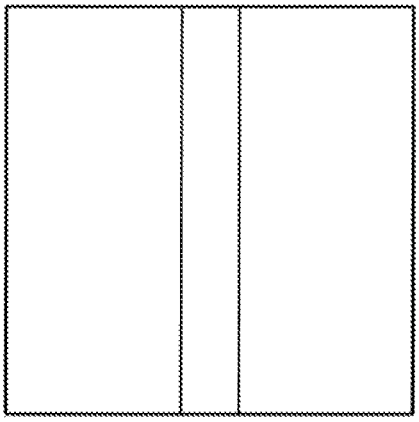
Figure 21E:
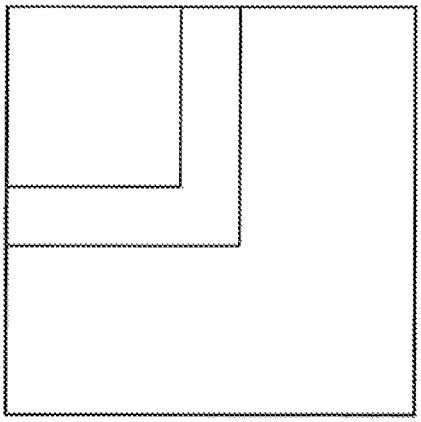
Figure 21F:
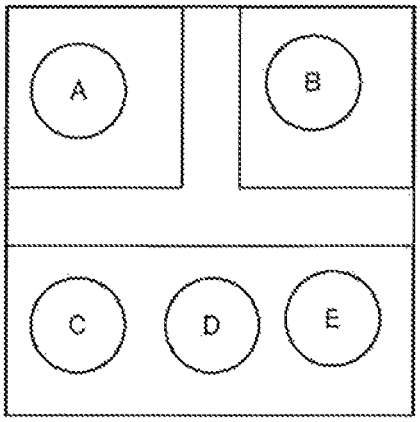

In FIG. 20, five persons, Person A to Person E, line in front of the elevator. The tag reader 303 reads the radio-wave-type RFID tags 310 of the five persons, thereby determining a group relationship among Person A to Person E. For example, suppose that Person A or Person B has no group relationship with others, and that Person C, Person D, and Person E have the group relationship. In this case, the controller 200 determines that the air curtain illustrated in FIG. 21B is suited, and decides to locate Person A in the left back part, Person B in the right back part, Person C in the left front part, Person D in the right front part, and Person E in the center front part as illustrated in FIG. 21F. Then, when the elevator door opens and they board one by one, the tag readers 302 read the radio-wave-type RFID tag 301 of Person A. Then, the controller 200 controls the guiding apparatus 320 and causes the guiding apparatus 320 to perform the audio output or display screen guiding Person A to be located in the left back part. The same applies to Person B to Person E.

Then, after all of the persons has boarded the elevator car 500, the four tag reader 301 reads the radio-wave-type RFID tags 310 in the elevator car 500 and transmits to the controller 200 the card numbers, the personal information, and the information on the receiving directions of the radio waves. The controller 200 determines the positions of Person A to Person E on the basis of the information on the receiving directions that is transmitted from the four tag readers 301. That is to say, in a case where three-dimensional coordinates of a vertical axis (X axis), a horizontal axis (Y axis) and a height axis (Z axis) are assumed inside the elevator car 500, imaginary lines extend from the coordinates of the four tag readers 301 in the receiving directions and the coordinate where each of the imaginary lines intersects is a position of the radio-wave-type RFID tag 310. In addition, because the personal information is read from the radio-wave-type RFID tag 310, the controller 200 is able to understand who stands at which position in the elevator car 500.

In a case where the controller 200 confirms that Person A to Person E are located at the positions as guided, the controller 200 drives the plurality of blowers 11 and blowers 21 to form the air curtain having the pattern illustrated in FIG. 21B. In a case where the controller 200 confirms that Person A to Person E are not located at the positions as guided, the controller 200 determines an air curtain pattern that is most suited on the basis of the current positions of Person A to Person E, and drives the plurality of blowers 11 and blowers 21 so as to form the pattern.

Note that although the four tag readers 301 are arranged around the elevator car 500 in the example illustrated in FIG. 21, it is possible to measure of the position of the radio-wave-type RFID tag 310 as far as there are at least three tag readers 301.

In addition, in a case where an imaging apparatus or an optical sensing apparatus is applied as the sensing apparatus 300, the controller 200 receives sensing information from the sensing apparatus 300 to determine location of the persons after they board the elevator and the door closes. The controller 200 determines a pattern of an air curtain that suits this location and drives the plurality of blowers 11 and blowers 21 so as to form the pattern.

As such, according to the utilization example 1, in a case where a plurality of persons boards the elevator, it is possible to separate between a person and a person inside the elevator car 500. Consequently, if a person suffering from an infectious disease is included in the persons on board, that person is separated by an air curtain, which thereby makes it possible to prevent virus or the like from being transferred from that person to another person. Therefore, it is possible to prevent the spread of the infectious disease due to gathering of people in a closed space such as an elevator.

In addition, in a case where a plurality of persons on board has a group relationship, it is possible to determine their location inside the elevator so that the persons on board in that group gather in one area. Therefore, it is possible to relieve anxiety among the persons on board due to being in a closed space.

Note that in the utilization example 1, a priority may be given to location of the areas in the elevator where the persons board. For example, if the attribute information of one of the persons on board who have a group relationship includes information that "the person has the body temperature of 37.5° C.", that person is preferentially guided to the right back part of the elevator so that only he or she is surrounded by the air curtain for the small area.

In addition, in the case of a large elevator capable of accommodating a carrier that carries a patient, the plurality of blowers 11 and blowers 21 may be arranged in a grid pattern, rather than in the cross shape as illustrated in FIG. 20. In this case, the blowers 11 and the blowers 21 may be controlled in the unit of a grid, by controlling the blowers 11 and the blowers 21 in the unit of a side of each grid.

In addition, although the contactless sensing apparatus is applied as the sensing apparatus 300 in the utilization example 1 of the seventh modification example, an imaging apparatus may be used. For example, the controller 20 is provided with a face recognition capability and database in which the group information and the attribute information that are associated with the personal information of a person are stored. Then, the controller 200 identifies a person on the basis of a captured image and obtains the group information from the database. Furthermore, the controller 200 identifies a position of the person on the basis of the captured image. As such, it becomes possible for the controller 200 to obtain the group information and the positional information on the basis of the captured image from the imaging apparatus, which makes it possible to control the blowers 11 and the blowers 21 on the basis of the group information and the positional information of the person and to form the air curtain.

Although it is not an essential aspect, in the utilization example 1, location of the persons after the movement may be determined according to the movement of the persons on board in the elevator, an air curtain pattern suitable for the location of the persons after movement may be determined, and the plurality of blowers 11 and blowers 21 may be driven to form the pattern. As a result, it is possible to provide an air curtain apparatus that is able to efficiently prevent foreign matters from being mixed according to location of persons on board and movement of the persons on board.

Utilization Example 2 of Seventh Modification Example

Figure 22:
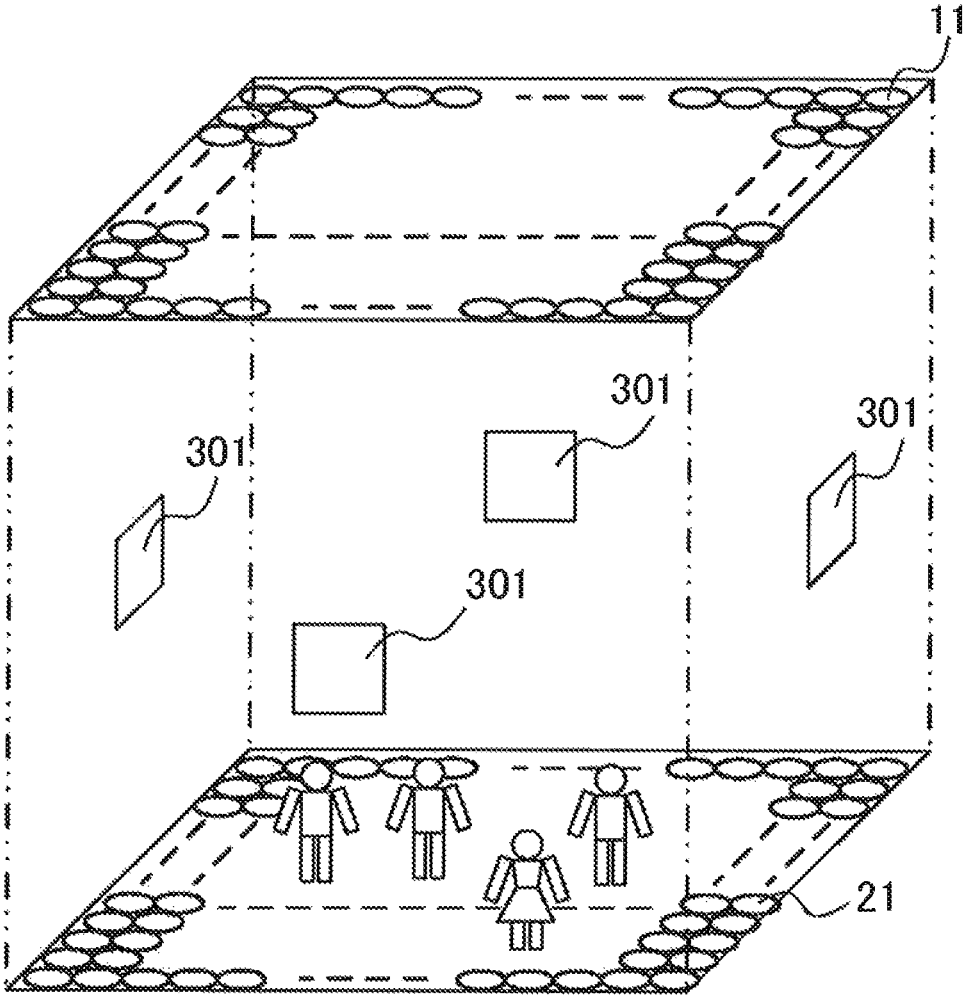
FIG. 22 is an explanatory diagram schematically illustrating a utilization example 2 in which the seventh modification example is utilized in a large hall such as a party space, a banquet hall, and an exhibition space.

FIG. 22 is an explanatory diagram schematically illustrating an example in which the seventh modification example is utilized in a large hall such as a party space, a banquet hall, and an exhibition space. The plurality of blowers 11 is arranged in a matrix on the ceiling of the large hall and the plurality of blowers 21 is arranged in a matrix on the floor. A plurality of tag readers 301 is arranged on walls of the large hall. Note that in the utilization example 2 of the seventh modification example, similarly to the utilization example 1, a description is given of a case where the contactless sensing apparatus is applied as the sensing apparatus 300.

In addition, those who are given a card with a radio-wave-type RFID tag 31 similar to that in the utilization example 1 may enter the large hall. In addition, in the radio-wave-type RFID tag 310 of the utilization example 2 are stored a card number, personal information, group information, and attribute information similar to those in the radio-wave-type RFID tag 310 of utilization example 1.

In the utilization example 1, the blowers 11 and the blowers 21 are arranged in a cross shape on the ceiling and the floor. The controller 200 collectively controls the plurality of blowers 11 and blowers 21 in the unit of a line, the plurality of blowers 11 and blowers 21 making up four lines which form the cross shape.

In contrast to this, in the utilization example 2, the controller 200 is able to individually control the plurality of blowers 11 and blowers 21 arranged in a matrix. Consequently, by individually selecting the blowers 11 and the blowers 21 to be driven, it is possible to form various air curtains when viewed in a plan view.

First, the controller 200 reads the RFID tags 310 possessed by persons in the large hall by the tag readers 301 and identify the persons and their positions. Then, the controller 200 determines an air curtain pattern on the basis of location of the persons in the large hall. Then, by selecting and driving the plurality of blowers 11 and blowers 22 corresponding to this pattern, the air curtain is formed in the large hall. Furthermore, the controller 200 drives the tag reader 301 at predetermined time intervals (once per second, for example) to read the RFID tags 310 possessed by the persons in the large hall, identify the persons and their positions, and thereby monitors movement of the persons. Then, the controller 200 changes the air curtain pattern according to the movement of the persons.

Figure 23:
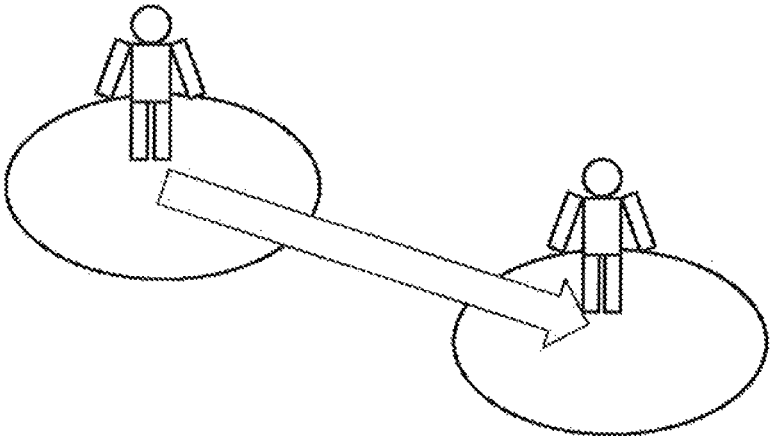
FIG. 23 is an explanatory diagram illustrating an example of air curtain formation in the utilization example 2.

FIG. 23 is an explanatory diagram illustrating an example of forming an air curtain. After determining the position of the person, the controller 200 determines a circle having a radius r (1 m, for example) with this position as the center. A line thickness at this time is a diameter of the blower 21. By extracting and driving the plurality of blowers 21 in contact with the circle thus determined and the plurality of blowers 11 corresponding thereto, a cylindrical air curtain covering the periphery of the person is formed. As illustrated in FIG. 23, if the person moves, by driving the plurality of blowers 21 in contact with the circle having the radius r (1 m, for example) with a moving position as the center and the plurality of blowers 11 corresponding thereto, the cylindrical air curtain is formed.

Specifically, the controller 200 sets an XY coordinate system with respect to a floor surface and manages the position of the person and the position of the blower 21 by means of the XY coordinates. The controller 200 determines the XY coordinates at the position of the person on the basis of the sensing information from the sensing apparatus 300 and further assumes a circle which has a radius r with the XY coordinates of the person's position as the center and the line thickness of which is a diameter of the blower 21. Then, the controller 200 lists up the blowers 21 that include the coordinates matching the coordinates of this circle. Then, by driving the plurality of blowers 21 listed and the plurality of blowers 11 corresponding thereto, the cylindrical air curtain is formed.

FIG. 24 is an explanatory diagram illustrating examples of forming an air curtain in a case where there is a plurality of persons. As illustrated in FIG. 24A, in a case where a distance between Person A and Person B is longer than a radius r×2, cylindrical air curtains are formed with respective positions of Person A and Person B as the center.

Figure 24A:
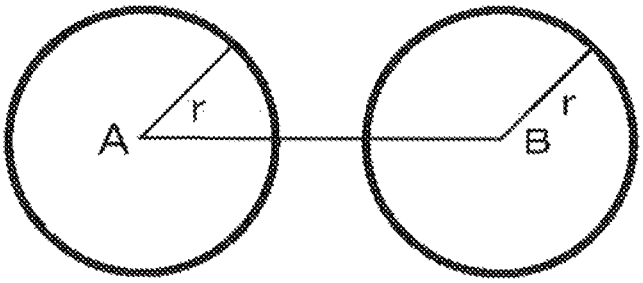
FIG. 24A is an explanatory diagram illustrating an example of air curtain formation in the utilization example 2 in which there are two persons.
Figure 24B:
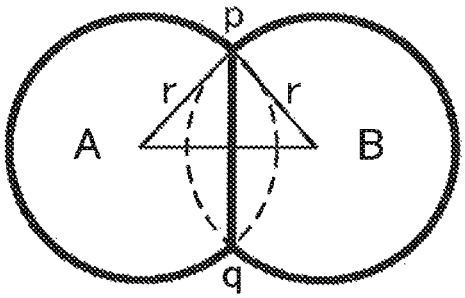
FIG. 24B is an explanatory diagram illustrating an example of air curtain formation in the utilization example 2 in which there are two persons.

As illustrated in FIG. 24B, in a case where the distance between Person A and Person B is shorter than the radius r×2, a circle with the position of Person A as the center partially intersects that with the position of Person B as the center. In this case, the plurality of blowers 21 in contact with the circumferences of the two circles and the plurality of blowers 11 corresponding thereto are driven, and the plurality of blowers 11 and the plurality of blowers 21 that correspond to a line (point p and point q in the figure) connecting two intersecting points (point p and point q in the figure) are also driven. This forms an air curtain having a shape in which parts of side surfaces of the two cylinders overlap.

Figure 24C:
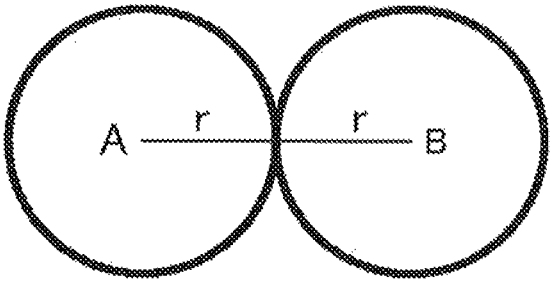
FIG. 24C is an explanatory diagram illustrating an example of air curtain formation in the utilization example 2 in which there are two persons.

As illustrated in FIG. 24C, in a case where the distance between Person A and Person B is the radius r×2, an air curtain like a figure of eight in a plan view, in which parts of the side surfaces of the two cylinders abut, is formed.

Figure 24D:
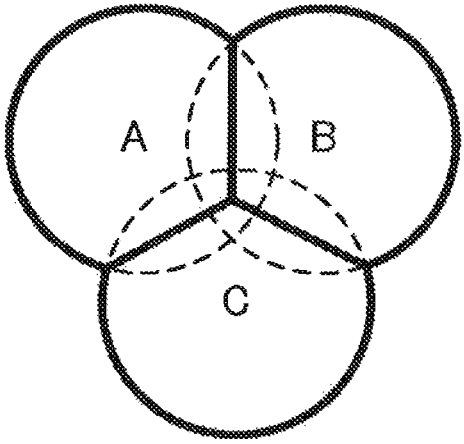
FIG. 24D is an explanatory diagram illustrating an example of air curtain formation in the utilization example 2 in which there are three persons.

FIG. 24D is an example of forming air curtains among three persons, Person A, Person B, and Person C. In a case where air curtain patterns of Person A, Person B, and Person C have a common region, a center point of the region is determined. Then, the controller 200 forms an air curtain around Person A, Person B, and Person C, by driving not only the plurality of blowers 11 and the plurality of blowers 21 that are located at lines connecting points where Person A, Person B, and Person C intersect with each other and the center point, but also the plurality of blowers 11 and the plurality of blowers 21 corresponding to the outer circumferences of the three circles.

Note that in a case where the two persons illustrated in FIG. 24B or the three persons illustrated in 24D each have a group relationship, only the plurality of blowers 11 and the plurality of blowers 21 that correspond to the outer circumferences of the respective circles may be driven.

Figure 24E:
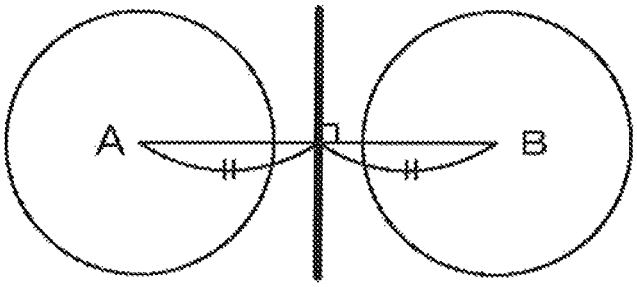
FIG. 24E is an explanatory diagram illustrating an example of air curtain formation in the utilization example 2 in which there are two persons.

In addition, although the examples illustrated in FIG. 24A to FIG. 24D form the cylindrical air curtain, Person A and Person B may be separated by driving the plurality of blowers 11 and the plurality of blowers 21 which correspond to a perpendicular bisector of the line connecting the position of Person A and the position of Person B and by forming a flat plate like air curtain, as illustrated in FIG. 24E.

It is to be noted that in a case a height or age is stored as attributes in an RFID tag 310 of a card possessed by a person, the radius of the air curtain may be automatically set according to the attributes, such as, setting the radius r to 1 m when the age is 10 years or older, setting the radius to 0.7 m when the age is less than 10 years, setting the radius r to 1.5 m if the height is 180 cm or higher, or the like.

In addition, although the air curtain is the singe cylinder in the examples of forming illustrated in FIG. 24, the air curtain may be made a double cylinder. Specifically, the controller 200 may be able to set, through operation on a meu screen by an administrator, whether to make an air curtain a single cylinder or a double cylinder, or whether to make the air curtain a single flat plate or a double flat plate, or furthermore, whether to make the radius larger or smaller, or the like. For example, in a case where a large hall is used as a medical facility, an air curtain is made a double cylinder when more caution is necessary, such as for a surgeon or a patient. By making an air curtain into a double cylinder in this manner, it becomes possible to create a space where no one is present between two air curtains, thus making it possible to separate the space more strictly. In addition, in a case where people move quickly and actively, in order to switch the air curtain more safely, it may be better to make an air curtain into a double cylinder where a buffer zone is set, or radius setting may be changed.

In addition, in a case where the large hall is utilized for a lecture, a theatrical play, a concert, or the like, it is possible to set a double cylinder or make a radius somewhat larger for a speaker or a player. Note that in this case, an air curtain for audience may be a single cylinder having a radius that is set normally.

Figure 25:
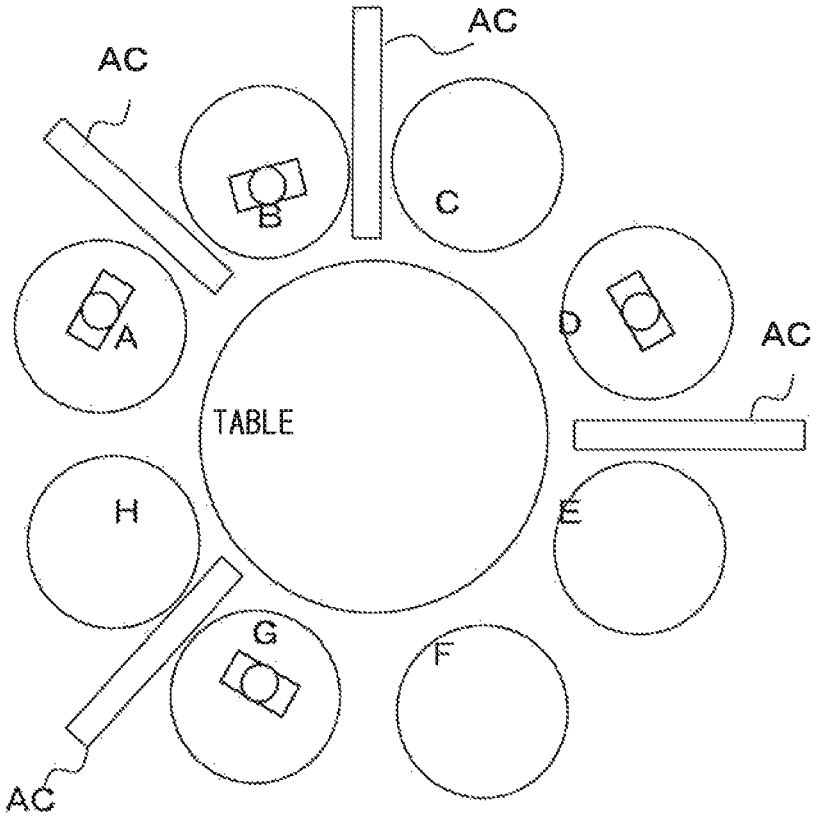
FIG. 25 is an explanatory diagram illustrating another example of air curtain formation in the utilization example 2.

FIG. 25 is an explanatory diagram illustrating another example of forming the air curtain in the utilization example 2. In the other example of forming, if a person enters a specific area, the plurality of blowers 11 and blowers 22, which are associated with the specific area and set in advance, are driven to from the air curtain.

For example, as illustrated in FIG. 25, a round table is placed in a large hall and a plurality of specific areas A to H are set at equal intervals around the round table. The controller 200 stores coordinate data corresponding to a range of the specific areas A to H. Furthermore, the controller stores the plurality of blowers 11 and blowers 21 that each correspond to the specific areas A to H. For example, the specific area A is associated with the plurality of blowers 11 and blowers 22 that are located between the specific area A and the specific area B. The specific area B is associated with the plurality of blowers 11 and blowers 21 located between the specific area B and the specific area C. Hereinafter, each of the specific areas is associated with the plurality of blowers 11 and blowers 21 similarly.

Then, the controller 200 monitors a position of a person in the large hall. When the person enters the specific areas A to H, the controller 200 drives the plurality of blowers 11 and blowers 21 that correspond to the respective specific areas A to H and forms an air curtain. FIG. 25 illustrates an example in which a person is present in each of the specific area A, B, D, and G. To the left of the person facing the table is formed an air curtain AC. Note that when a person sitting on a seat stands up and leaves the specific area, the controller 200 turns off the air curtain AC corresponding to the specific area.

Note that the group information of the RFID tag 310 of the cards possessed by the persons may be utilized so that those in a same group may sit on the seats of the round table. For example, an output apparatus of sound or images controllable by the controller 200 is placed on the round table. Then, when the controller 200 determines that a person of a different group enters the specific area, the controller drives the output apparatus to alert by image display or audio output or the like.

It is also possible to utilize the other examples of forming the air curtain in the above-mentioned utilization example 2 to individually separate chairs, desks, sofa, or the like located in a shared space of commercial facilities by an air curtain.

Utilization Example 3 of Seventh Modification Example

Figure 26A:
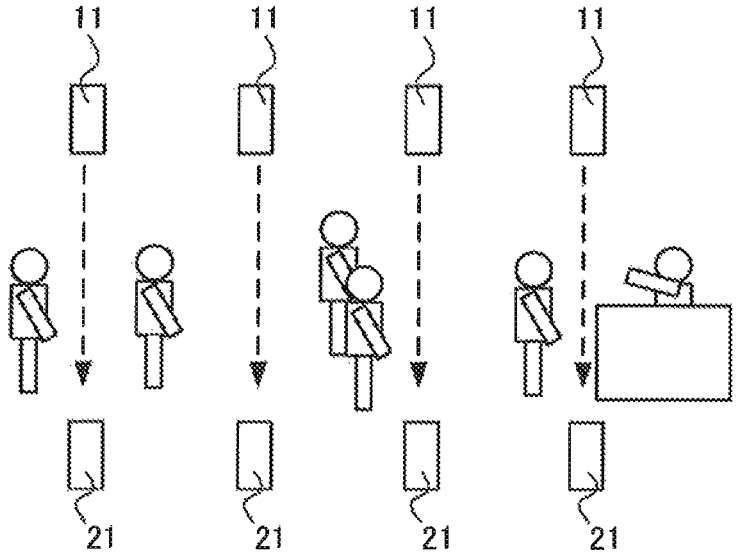
FIG. 26A is a lateral view schematically illustrating a utilization example 3 in which the seventh modification example is used in a place, such as a cash desk or a ticket box office, where people line up.
Figure 26B:
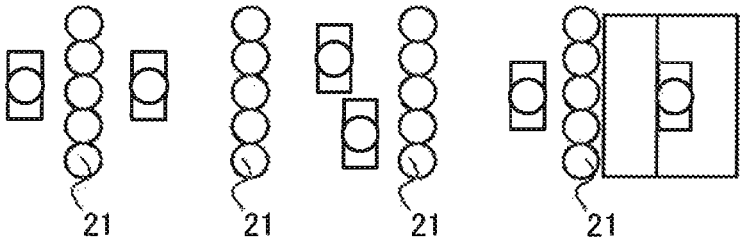
FIG. 26B is a top view schematically illustrating the utilization example 3 in which the seventh modification example is used in a place, such as a cash desk or a ticket box office, where people line up.

FIG. 26 is an explanatory diagram schematically illustrating an example in which the seventh modification example is utilized in n a place, such as a cash desk or a ticket box office, where people line up. FIG. 26A is a lateral view and FIG. 26B is a top view. In the utilization example 3, similarly to the utilization example 2 illustrated in FIG. 22, blowers 11 and blowers 12 are arranged in a matrix on the ceiling and the floor, respectively.

A partition line is drawn at a position on the floor where people are to line up. The plurality of blowers 21 in contact with the partition line and the blowers 22 corresponding thereto are to be controlled by the controller 200. Note that although not illustrated in FIG. 25, the controller 200 and the sensing apparatus 300 illustrated in FIG. 18 are used in this utilization example. In addition, in this utilization example, an imaging apparatus is used as the sensing apparatus 300.

The controller 200 performs a person detection process from a captured image by the imaging apparatus and determines the person and his or her position. Then, the controller 200 selects the plurality of blowers 11 and the plurality of blowers 21 to be driven, and forms an air curtain between the ticket box office and the person in the front row, and between the person in the front row and the person in the back row by driving and controlling. The controller 200 performs control to stop the plurality of blowers 11 and the plurality of blowers 21 behind the person in the last row. Here, the controller may perform control to stop the plurality of blowers 11 and the plurality of blowers 21 when the people in line move and straddle the blowers 21.

Figure 27:
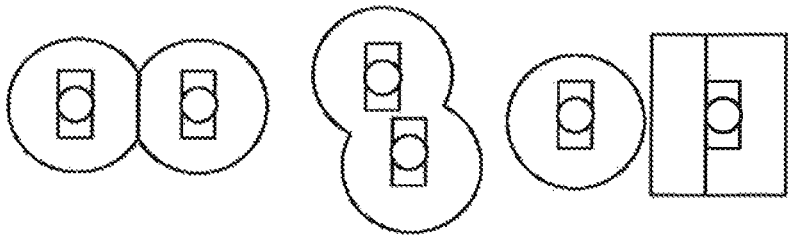
FIG. 27 is an explanatory diagram illustrating an example of air curtain formation in the utilization example 3.

Note that similarly to the utilization example 2, cylindrical air curtains may be formed by driving the plurality of blowers 11 and the plurality of blowers 21 arranged in a circle having a radius r of the people in line, as illustrated in FIG. 27. In this case, the center of the circle may be set at a position that is slightly offset forward in the traveling direction with respect to the positions of the people in line. As a result, when the position of the person in line moves to the traveling direction, the person approaches the center of the cylindrical air curtain, so that it is possible to prevent the person from going out of the air curtain.

In addition, similarly to the utilization example 2, a contactless sensing apparatus is applied as the sensing apparatus 300. If the controller 200 is able to obtain the group information, an air curtain may be formed around the group in a case where persons in the same group line up. For example, in FIG. 27, if two persons who line up after the first person in line belong to the same group, the air curtain may be formed around these two persons.

Figure 28:
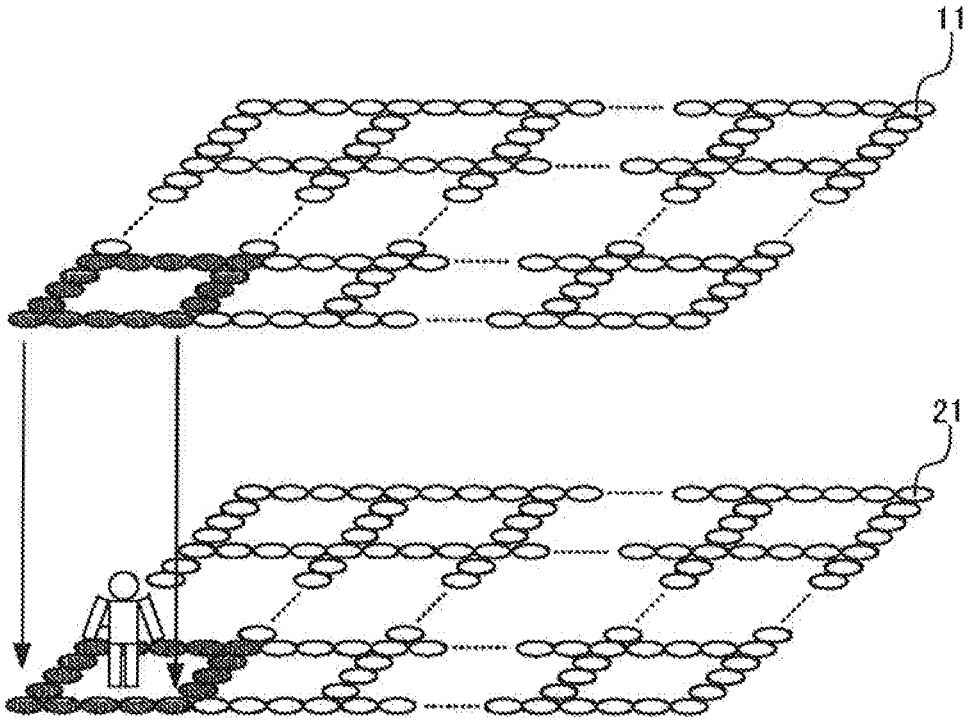
FIG. 28 is an explanatory diagram illustrating another example of arrangement of the blower s11 and blowers 21 on a ceiling and a floor.

In addition, although in the utilization example 4, the blowers 11 and the blowers 21 are arranged in a matrix on the ceiling and the floor, respectively, similarly to the utilization example 2, the utilization example 3 is not limited to this, and the blowers 11 and the blowers 21 may be arranged in a grid pattern on the ceiling and the floor, respectively, as illustrated in FIG. 28. In this case, if people line up in a transverse direction with respect to the ticket office box, it becomes possible to separate the front and the back of the people in line, by driving some of the blowers 11 and the blowers 21 on the line in the lengthwise direction, as illustrated in FIG. 26B.

Utilization Example 4 of Seventh Modification Example

Figure 29A:
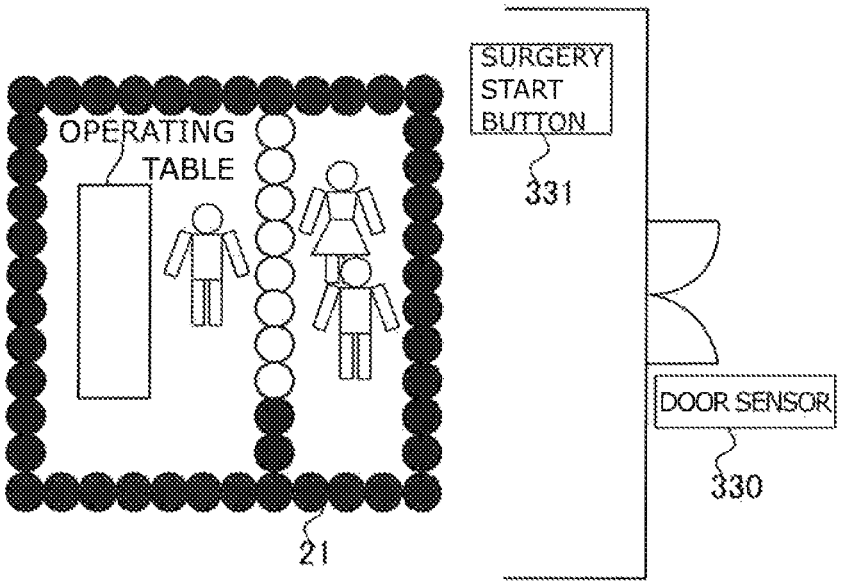
FIG. 29A is an explanatory diagram schematically illustrating a utilization example 4 in which the seventh modification example is used in a hospital.
Figure 29B:
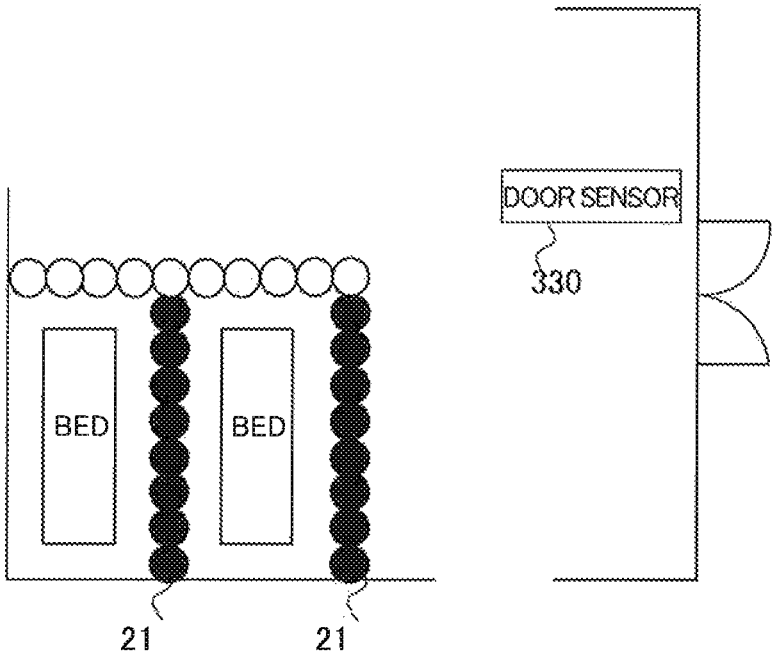
FIG. 29B is an explanatory diagram schematically illustrating the utilization example 4 in which the seventh modification example is used in the hospital.

FIG. 29 is an explanatory diagram schematically illustrating an example in which the seventh modification example is utilized in a hospital. FIG. 29A illustrates a utilization example in an operating room, and FIG. 29B illustrates a utilization example in a hospital room. Note that although not illustrated in FIG. 29, the controller 200 and the sensing apparatus 300 illustrated in FIG. 18 are used in this utilization example. In the utilization example 3, the blowers 11 and the blowers 21 are arranged in a grid pattern on the ceiling and the floor, respectively, as illustrated in FIG. 28. Note that FIG. 29 illustrates only the blowers 21 to be controlled by the controller 200.

In addition, in the utilization example 4, an imaging apparatus is used as the sensing apparatus 300. Furthermore, a door sensor 330 is provided on a door that serves as an entrance/exit to the operating room or the hospital room. The door sensor 330 transmits to the controller 200 an ON signal when the door is open and an OFF signal when the door is closed.

As illustrated in FIG. 29A, in the operating room, the plurality of blowers 21 to be controlled by the controller 200 are arrayed on the floor so as to draw a rectangle that surrounds an operating table, a surgeon's working area, and an assistant's area, respectively. On the ceiling, the plurality of blowers 11 corresponding to the plurality of blowers 21 and to be controlled by the controller 200 are arrayed so as to draw a rectangle. In addition, a surgery start button 331 is provided in the operating room.

The surgery start button 331 is operated by the assistant. The surgery start button 331 enters an ON state when an operation starts, continues to be in the ON state during the operation, and enters an OFF state when the operation ends. The surgery start button 331 transmits to the controller 200 the ON signal during the ON state and OFF signal during the OFF state.

Then, on receipt of the ON signal from the door sensor 330 during a preset reserved period of the operating room, the controller 200 drives the blowers 11 and the blowers 21 corresponding thereto and forms an air curtain around the operating table, as illustrated in FIG. 29A. Here, if the controller 200 receives the ON signal from the door sensor 330 outside the reserved period of the operating room, the controller 200 does not drive the blowers 11 and the blowers 21 corresponding thereto, but if the controller 200 receives the ON signal from the surgery start button 33, it forms the air curtain.

During the operation, the controller performs a process to detect surgical staff members present in the operating room, such as the surgeon and the assistant, or the like, from a captured image by the imaging apparatus, and determines positions of the surgical staff members. The controller 200 monitors movement of the surgical staff members on the basis of the captured image by the imaging apparatus. When the surgical staff member enters a specific area, the controller performs control to stop the specific blower 11 and the blower 21 corresponding thereto or to weaken an air volume.

For example, in the example illustrated in FIG. 29A, when a body part (hand, for example) of the surgeon or the surgical staff member or equipment straddles over the blower 21 between the surgeon and the surgical staff member, control is performed to stop or weaken this blower 21 and several bowers 21 adjacent to this blower 21 as well as the plurality of blowers 11 corresponding to these blowers 21. This allows for adjustment to the air volume pressure that does not bother the surgeon or the assistant.

Then, after the operation ends, the assistant operates the surgery start button 331. When the controller 200 receives the OFF signal from the surgery start button 331, the blowers 11 and the blowers 21 stop and then the air curtain turns off.

As such, according to the utilization example 4, the periphery of the patient undergoing surgery is separated by the air curtain, and aerosol floating in the air is less likely to reach the patient undergoing surgery. Therefore, it is possible to improve the surgical environment.

Note that for the blowers 11 and the blowers 21 that form the air curtain between the surgeon and the assistant, the air volume may be set weaker in advance than other blowers 11 and blowers 21. In addition, the surgical staff member may be able to adjust the air volume of the air curtain locally by operating the controller 200.

As illustrated in FIG. 29B, in the hospital room, the plurality of blowers 21 is arrayed on the floor so as to draw a rectangle surrounding a bed. On the ceiling, the plurality of blowers 11 corresponding to the plurality of blowers 21 is arrayed so as to draw a rectangle. Note that although not illustrated in FIG. 29, the controller 200 and the sensing apparatus 300 illustrated in FIG. 18 are used in this utilization example. In addition, in this utilization example, an imaging apparatus is used as the sensing apparatus 300.

In the example illustrated in FIG. 29B, when the controller 200 receives the ON signal from the door sensor 330, the sensing apparatus 300 starts operating. When the sensing apparatus 300 senses a person entering from the door, the controller 200 performs control to stop some of the blowers 21 around the bed and the corresponding blowers 11 or to weaken the air volume. Consequently, when a doctor comes to examine, or when a meal is served, it becomes possible to perform the examination or meal serving work at a location where there is no air curtain or where the air volume pressure is weak.

Note that in a case it is possible to recognize what kind of a person, such as a doctor, a nurse, a meal serving staff, a cleaning worker, a visitor, or the like, enters the hospital room, an air curtain suitable for that may be formed. For example, in the case of the cleaning worker, all air curtains may be turned off, and in the case of the visitor, the air curtain around a target of the visit may be turned off. It is possible to recognize a person entering the hospital room, by giving the person a card with the RFID tag, installing a tag reader at the entrance of the hospital room, causing the RFID tag to be read by the tag reader before the person enters the room, and further equipping the controller 200 with a so-called face recognition capability that identifies the person from an image captured by the imaging apparatus.

In addition, the blowers 21 surrounding the bed may be provided with a pressure sensor that senses airflow pressure of helical air currents from the blowers 11, and ventilation may be automatically turned on or off when a drop in the airflow pressure is sensed. A contact sensor may be provided on the floor near the blowers 21 surrounding the bed, and ventilation may be automatically turned on or off when the contact sensor senses a contact. In addition, for example, in a case where the pressure sensor or the contact sensor senses any pressure or contact even though there is no one else than the patient in the hospital room, the patient or a nurse in charge may be notified, by sound or an image, of the possibility that an object is placed on the blower 21.

As above, although description has been given of the utilization examples of the seventh modification example, the utilization examples of the seventh modification example are not limited to the above. For example, by making the sensing apparatus 300 act as a pressure sensor and installing this pressure sensor on a chair or a sofa, it is possible to sense whether or not there is any seated person. Then, when the person sits on the chair or the sofa, an air curtain may be formed between adjacent chairs or sofa, and when the person leaves the seat, the air curtain may be turned off.

For example, if a person waiting for a medical examination sits on a seat in a waiting room of a hospital, this makes it possible to separate him or her from a person seated next by the air curtain. In addition to the waiting room in the hospital, for example, in audience seats of a theater, it becomes possible to separate adjacent persons by an air curtain. Note that for adjacent seats, it is desirable to provide a buffer (buffer zone) where there is no one between seats, so that helical air currents from the blowers 11 flow to the blowers 21 between the adjacent seats.

In addition, in the utilization example 2, the air curtain patterns are changed according to the movement of the person. In the utilization example 2, however, the air curtain may be formed when the person enters the specific area, and the air curtain may be turned off when the person moves out of the specific area. For example, in a concert hall, when the sensing apparatus 300 senses that a conductor has gone up to a conductor's podium, an air curtain may be formed around the conductor, and when the sensing apparatus 300 senses that the conductor has gone down the conductor's podium, the air curtain may be turned off.

Figure 30A:
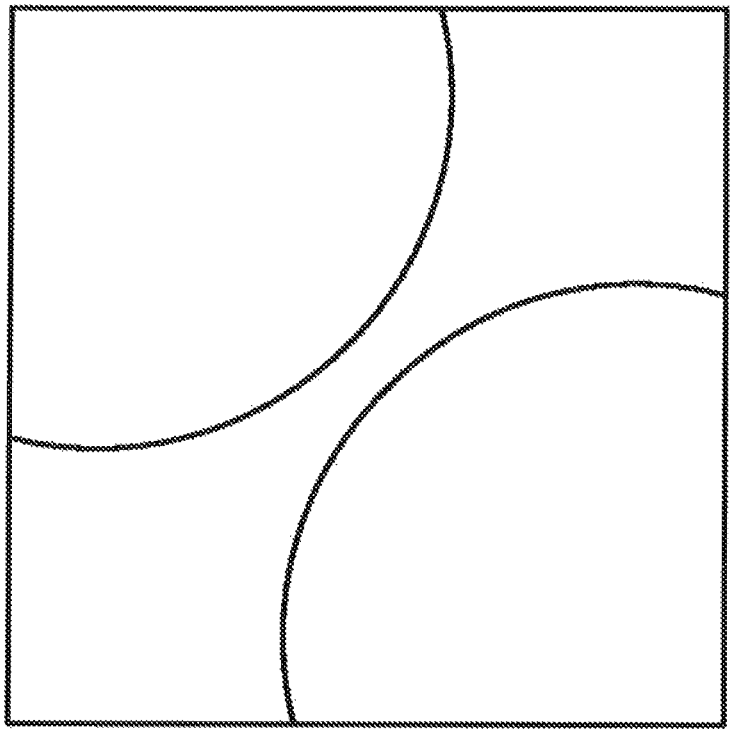
FIG. 30A is an explanatory diagram schematically illustrating the other example of arrangement of the blowers 11 and the blowers 21 on the ceiling and the floor.
Figure 30B:
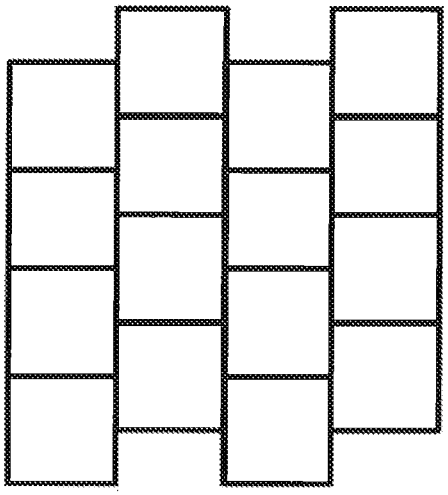
FIG. 30B is an explanatory diagram schematically illustrating the other example of arrangement of the blowers 11 and the blowers 21 on the ceiling and the floor.
Figure 30C:
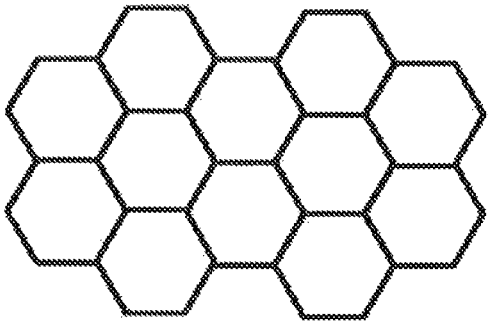
FIG. 30C is an explanatory diagram schematically illustrating the other example of arrangement of the blowers 11 and the blowers 21 on the ceiling and the floor.

In addition, although in the above-mentioned utilization examples of the seventh modification example, the examples are illustrated in which the blowers 11 and the blowers 21 are arranged in a cross shape, arranged in a matrix or in a grid pattern on the ceiling or floor, respectively, the arrangement patterns of the blowers 11 and the blowers 21 on the ceiling and the floor are not limited thereto. For example, the blowers 11 and the blowers 21 may be arranged in an arc shape as illustrated in FIG. 30A, or in a staggered grid pattern as illustrated in FIG. 30B, or in a honeycomb shape as illustrated in FIG. 30C. The arrangement of blowers 11 and the blowers 21 may be appropriately determined according to a purpose of use of a building. In particular, in a case where it is desired to form an air curtain in a rectangular tubular shape, it is desirable to array the blowers 11 and the blowers 21 in a grid pattern as illustrated in FIG. 28. In a case where it is desired to form an air curtain in a cylindrical shape, it is desirable to array the blowers 11 and the blowers 21 in a honeycomb shape as illustrated in FIG. 30C.

In addition, according to the seventh modification example, the air curtain is formed by helical air currents in the lengthwise direction from the ceiling toward the floor, but as in the air curtain apparatus illustrated in FIG. 1, it is also possible to use together an air curtain apparatus that forms an air curtain with helical air currents in the horizontal direction. As a result, it is possible to form various air curtains. In this case, the blowers 11 and 21 of the air curtain apparatus that forms an air curtain with the helical air currents in the lateral direction may be controllable by the controller 200. This makes it possible to form a preferred air curtain in various scenes. In addition, by attaching an RFID tag to the blowers 11 and the blowers 21, respectively, of the air curtain apparatus illustrated in FIG. 1, it becomes possible for the controller 200 to confirm positions of the blowers 11 and the blowers 21. As a result, when the position is displaced, it becomes possible for the controller 200 to stop the blowers 11 and the blowers 21 or promptly instruct a worker to adjust the position.

It is to be noted that any one type or a plurality of types of the air curtain apparatuses of the first modification example to the fifth modification example of the embodiment may be combined where appropriate.

As above, the invention made by the inventor has been specifically described on the basis of the embodiment thereof. It is needless to say, however, that the present invention is not limited to the above-mentioned embodiment, and various alterations may be made thereto without departing from the gist thereof.

Within the scope of the thought of the present invention, those skilled in the art may come up with various alterations and modifications, and it is understood that those alterations and modifications also fall within the present invention.

For example, the above-mentioned embodiment or the respective modification examples to which those skilled in the art appropriately have made additions, deletions, or design changes, or to which those skilled in the art have added, deleted, or changed a condition of a process also fall within the present invention as far as they have the gist of the present invention.

<Additional Statements>

The following is a brief description of the overview of a typical example of the embodiments described above.

An air curtain apparatus as one aspect of the present invention is an air curtain apparatus that forms an air curtain. The air curtain apparatus includes a plurality of first blowers being arrayed in an up-down direction and each including a first air inlet port in which air is sucked and a first air outlet port from which air is blown out; and a plurality of second blowers being arrayed in the up-down direction, each including a second air inlet port in which air is sucked and a second air outlet port from which air is blown out, and, in a plan view, the second air inlet port each facing the first air outlet port included in each of the plurality of first blowers. In a pair of the first blower and the second blower, the first blower blows out a helical air current from the first air outlet port included in the first blower toward the second air inlet port included in the second blower, and the second blower sucks in the helical air current blown out by the first blower from the second air inlet port included in the second blower. In addition, the air curtain apparatus forms the air curtain of a plurality of the helical air currents, the plurality of helical air currents being blown out from the plurality of first air outlet ports each included in each of the plurality of first blowers and sucked into the plurality of second air inlet ports each included in each of the plurality of second blowers.

In addition, as another aspect, a third blower, which is any of the plurality of first blowers, may include a light emitting unit. The light emitting unit emits light in a direction in which the helical air current is blown out of the first air outlet port included in a third blower. Relative positions of the plurality of second blowers with respect to the plurality of first blowers may be adjusted so that light applied by the light emitting unit is applied to a fourth blower. The fourth blower is any of the plurality of second blowers and, in a plan view, includes the second air inlet port facing the first air outlet port included in the third blower.

In addition, as another aspect, the light emitting unit may be a laser or a light emitting diode that emits visible light or infrared light.

In addition, as another aspect, the fourth blower may also include a light receiving unit that receives light applied by the light emitting unit. Relative positions of the plurality of second blowers with respect to the plurality of first blowers may be adjusted so that light applied by the light emitting unit is applied to the light receiving unit.

In addition, as another aspect, the air curtain apparatus includes two air curtain forming units, each of which forms an air curtain. Each of the two air curtain forming units may have a plurality of first blowers and a plurality of second blowers. The plurality of second blowers held by a first air curtain forming unit, which is any of the two air curtain forming units, in a plan view, may be adjacent to the plurality of first blowers held by a second air curtain forming unit, which is different from the first air curtain forming unit of the two air curtain forming units. In a plan view, a direction from the plurality of first blowers held by the second air curtain forming unit toward the plurality of second blowers held by the second air curtain forming unit may differ from a direction from the plurality of first blowers held by the first air curtain forming unit toward the plurality of second blowers held by the first air curtain forming unit. The first air curtain forming unit may have a first connection unit that connects the plurality of second air outlet ports and the plurality of first air inlet ports in an airtight manner, each of the plurality of second air outlet ports being included in each of the plurality of second blowers held by the first air curtain forming unit, and each of the plurality of first air inlet ports being included in each of the plurality of first blowers held by the second air curtain forming unit.

In addition, as another aspect, the air curtain apparatus may include N air curtain forming units (N being an integer of 3 or larger), the air curtain forming units being arrayed along an annular path around a central axis along the up-down direction and each forming an air curtain. Each of the N air curtain forming units may have a plurality of first blowers and a plurality of second blowers. For each of the N air curtain forming units, in a pair of a third air curtain forming unit and a fourth air curtain forming unit, in a plan view, the plurality of second blowers held by the third air curtain forming unit may be adjacent to a plurality of first blowers held by the fourth air curtain forming unit, the third air curtain forming unit being the air curtain forming unit, and the fourth air curtain forming unit, of the N air curtain forming units, being arranged on a first side which is, in a plan view, side of an anti-clockwise direction or that of a clockwise direction, along the annular path of the third air curtain forming unit, and the fourth air curtain forming unit being the air curtain forming unit adjacent to the third air curtain forming unit. The third air curtain forming unit may have a second connection unit that connects in an air-tight manner the plurality of second air outlet ports and the plurality of first air inlet ports in an airtight manner, the plurality of second air outlet ports each being included in each of the plurality of second blowers held by the third air curtain forming unit and the plurality of first air inlet ports each being included in each of the plurality of first blowers held by the fourth air curtain forming unit.

In addition, as another aspect, a rotation direction of the helical air current, when the helical air current blown out by the first blower is seen from the first blower, is a clockwise or anti-clockwise rotation direction, and may be the same rotation direction among the plurality of first blowers.

In addition, as another aspect, each of the plurality of first blowers includes a first cylinder part and a first fan provided inside the first cylinder part. The first air inlet port is provided at a first end in an axial direction of the first cylinder part. The first air outlet port is provided at a second end opposite to the first end, in the axial direction of the first cylinder part. The first fan may suck in air from the first air inlet port and blow out from the first air outlet port the air sucked in from the first air inlet port. Each of the plurality of first blowers may further include a first grille, the first grille being provided at the first air outlet port and having a plurality of holes formed therein, each having a helical shape swirling in a clockwise or anti-clockwise direction when viewed from the direction of the first cylinder part.

In addition, as another aspect, each of the plurality of first blowers may have a spraying unit that sprays an antiseptic solution inside the first cylinder part.

In addition, as another aspect, each of the plurality of second blowers includes a second cylinder part and a second fan provided inside the second cylinder part. The second air inlet port is provided at a third end in the axial direction of the second cylinder part. The second air outlet port is provided at a fourth end which is opposite to the third end in the axial direction of the second cylinder part. The second fan may suck in air from the second air inlet port and blow out from the second air outlet port the air sucked from the second air inlet port. An inner diameter of the second air inlet port may be larger than that of the first air outlet port.

In addition, as another aspect, each of the plurality of first blowers may include a first injection unit that injects a colored gas into the inside of the first cylinder part.

In addition, as another aspect, each of the plurality of first blowers may include a second injection unit that injects a gas containing a smell component into the inside of the first cylinder part.

With one aspect of the present invention applied, simply using a small and simple air curtain apparatus makes it possible to efficiently separate and divide a certain space and to efficiently prevent entry of foreign matters such as droplets or the like from one subspace to the other subspace.

INDUSTRIAL APPLICABILITY

The present invention is effective when applied to an air curtain apparatus that forms an air curtain.

DESCRIPTION OF THE REFERENCE NUMERALS

1 Air curtain apparatus
2, 2*a*-2*d* Air curtain forming unit
3 Air outlet unit
4 Air inlet unit++
11, 11*a*, 21, 21*a* Blower
12, 22 Support part
13, 23 Air inlet port
14, 24 Air outlet port
15, 25 Leg
16, 26 Frame part
31, 41, AX1 Central axis
32, 42 Cylinder part
33, 43 Fan
34, 44 Drive unit
35, 36, 45, 46 End
51 Table
52 User
53 Employee
54, 55 Table group
56 Aisle
57 Partition
61 Light emitting unit
62 Light receiving unit
63 Grille
63*a* Hole
64 to 66 Connection unit
71 Spraying unit
71*a* Antiseptic solution
72, 73 Injection unit
80 Identification apparatus
81 Stretching part
82 Placement part
83 Strip-shaped member
84 Storing body
86 Drawer port
87 Recess

| | |
|---|---|
| 87a | Groove part |
| 90 | Scope unit |
| 91 | Scope |
| 92 | Support |
| 93 | Long member |
| 94 | Short member |
| 95 | Hinge |
| 96 | Rod member |
| 97 | Placement part |
| 100 | Member |
| 101 | Bag body |
| 102 | Thread-like member |

-continued

| | |
|---|---|
| 103 | Spring member |
| 200 | Controller |
| 201 | Control unit |
| 202 | Storage unit |
| 300 | Sensing apparatus |
| 301, 302, 303 | Tag reader |
| 310 | RFID tag |
| 320 | Guiding apparatus |
| 330 | Door sensor |
| 331 | Surgery start button |
| 500 | Elevator car |
| AC1, AC10, AC11, AC12 | Air curtain |
| AC2 | Annular air curtain |
| AR1 | Area |

CR1 Circular route
GS1, GS2 Gas
ID1, ID2 Inside diameter
LG1 Light
SA1 Helical air current
SP Space
SP1, SP2 Subspace

The invention claimed is:

1. An air curtain apparatus that forms an air curtain, comprising:

a plurality of first blowers that is arrayed in an up-down direction, and each include a first air inlet port in which air is sucked in and a first air outlet port from which the air is blown out; and a plurality of second blowers that is arrayed in the up-down direction, each includes a second air inlet port in which air is sucked in and a second air outlet port from which the air is blown out, and, in a plan view, the second air inlet port each faces the first air outlet port included in each of the plurality of first blowers, wherein in a pair of the first blower and the second blower, the first blower blows out a helical air current from the first air outlet port included in the first blower toward the second air inlet port included in the second blower, the second blower sucks in the helical air current blown out by the first blower from the second air inlet port included in the second blower, and the air curtain apparatus forms the air curtain of a plurality of the helical air currents, the plurality of helical air currents being blown out from the plurality of first air outlet ports each included in each of the plurality of first blowers and sucked into the plurality of second air inlet ports each included in each of the plurality of second blowers, and wherein a third blower, which is any of the plurality of first blowers, includes a light emitting unit, the light emitting unit emitting light in a direction in which the helical air current is blown out from the first air outlet port included in the third blower, and relative positions of the plurality of second blowers with respect to the plurality of first blowers are adjusted so that light applied by the light emitting unit is applied to a fourth blower, the fourth blower being any of the plurality of second blowers and, in a plan view, including the second air inlet port facing the first air outlet port included in the third blower.

2. The air curtain apparatus according to claim 1, wherein the light emitting unit is a laser or a light emitting diode that emits visible light or infrared light.

3. The air curtain apparatus according to claim 1, wherein the fourth blower includes a light receiving unit that receives light applied by the light emitting unit, and relative positions of the plurality of second blowers with respect to the plurality of first blowers are adjusted so that light applied by the light emitting unit is applied to the light receiving unit.

4. The air curtain apparatus according to claim 1, wherein a rotation direction of the helical air current, when the helical air current blown out by the first blower is seen from the first blower, is a clockwise or anti-clockwise rotation direction, and may be the same rotation direction among the plurality of first blowers.

5. The air curtain apparatus according to claim 1, wherein each of the plurality of first blowers includes:

a first cylinder part, and a first fan provided inside the first cylinder part, wherein the first air inlet port is provided at a first end in an axial direction of the first cylinder part, the first air outlet port is provided at a second end opposite to the first end, in the axial direction of the first cylinder part, the first fan sucks in air from the first air inlet port and blows out from the first air outlet port the air sucked in from the first air inlet port, each of the plurality of first blowers further includes a first grille, the first grille being provided at the first air outlet port and having a plurality of holes formed therein, each having a helical shape swirling in a clockwise or anti-clockwise direction when viewed from the direction of the first cylinder part.

6. The air curtain apparatus according to claim 5, wherein each of the plurality of first blowers includes a spraying unit that sprays an antiseptic solution inside the first cylinder part.

7. The air curtain apparatus according to claim 5, wherein each of the plurality of second blowers includes:

a second cylinder part, and a second fan provided inside the second cylinder part, wherein the second air inlet port is provided at a third end in the axial direction of the second cylinder part, the second air outlet port is provided at a fourth end which is opposite to the third end in the axial direction of the second cylinder part, the second fan sucks in air from the second air inlet port and blows out from the second air outlet port the air sucked from the second air inlet port, and an inner diameter of the second air inlet port is larger than an inside diameter of the first air outlet port.

8. The air curtain apparatus according to claim 5, wherein each of the plurality of first blowers includes a first injection unit that injects a colored gas into the inside of the first cylinder part.

9. The air curtain apparatus according to claim 5, wherein each of the plurality of first blowers includes a second injection unit that injects a gas containing a smell component into the inside of the first cylinder part.

10. An air curtain apparatus that forms an air curtain, comprising:

a plurality of first blowers that is arrayed in an up-down direction, and each include a first air inlet port in which air is sucked in and a first air outlet port from which the air is blown out; and a plurality of second blowers that is arrayed in the up-down direction, each includes a second air inlet port in which air is sucked in and a second air outlet port from which the air is blown out, and, in a plan view, the second air inlet port each faces the first air outlet port included in each of the plurality of first blowers, wherein in a pair of the first blower and the second blower, the first blower blows out a helical air current from the first air outlet port included in the first blower toward the second air inlet port included in the second blower, the second blower sucks in the helical air current blown out by the first blower from the second air inlet port included in the second blower, and the air curtain apparatus forms the air curtain of a plurality of the helical air currents, the plurality of helical air currents being blown out from the plurality of first air outlet ports each included in each of the plurality of first blowers and sucked into the plurality of second air inlet ports each included in each of the plurality of second blowers, and wherein the air curtain apparatus comprises N air curtain forming units (N being an integer of 3 or larger), the air curtain forming units being arrayed along an annular path around a central axis along the up-down direction and each forming an air curtain, wherein each of the N air curtain forming units includes:

a plurality of first blowers, and a plurality of second blowers, wherein for each of the N air curtain forming units, in a pair of a third air curtain forming unit and a fourth air curtain forming unit, in a plan view, the third air curtain forming unit being the air curtain forming unit, and the fourth air curtain forming unit, of the N air curtain forming units, being arranged on a first side which is, in a plan view, side of an anti-clockwise direction or side of a clockwise direction, along the annular path of the third air curtain forming unit, and the fourth air curtain forming unit being the air curtain forming unit adjacent to the third air curtain forming unit, the plurality of second blowers held by the third air curtain forming unit is adjacent to a plurality of first blowers held by the fourth air curtain forming unit, the third air curtain forming unit has a second connection unit that connects in an air-tight manner the plurality of second air outlet ports and the plurality of first air inlet ports in an airtight manner, the plurality of second air outlet ports each being included in each of the plurality of second blowers held by the third air curtain forming unit and the plurality of first air inlet ports each being included in each of the plurality of first blowers held by the fourth air curtain forming unit.

11. An air curtain apparatus that forms an air curtain, comprising:

a plurality of first blowers that is arrayed in an up-down direction, and each include a first air inlet port in which air is sucked in and a first air outlet port from which the air is blown out; and a plurality of second blowers that is arrayed in the up-down direction, each includes a second air inlet port in which air is sucked in and a second air outlet port from which the air is blown out, and, in a plan view, the second air inlet port each faces the first air outlet port included in each of the plurality of first blowers, wherein in a pair of the first blower and the second blower, the first blower blows out a helical air current from the first air outlet port included in the first blower toward the second air inlet port included in the second blower, the second blower sucks in the helical air current blown out by the first blower from the second air inlet port included in the second blower, and the air curtain apparatus forms the air curtain of a plurality of the helical air currents, the plurality of helical air currents being blown out from the plurality of first air outlet ports each included in each of the plurality of first blowers and sucked into the plurality of second air inlet ports each included in each of the plurality of second blowers, and wherein at least any one of the first blower and the second blower further comprises an identification member that makes it possible to visually identify a traveling direction of the helical air current, the identification member includes a strip-shaped member, a storing part that stores the strip-shaped member in a rolled-up state, and a placement part in which the strip-shaped member is drawn from the storing part is placed, and in a case where the strip-shaped member is drawn from the storing part, the strip-shaped member is maintained in a state in which the strip-shaped member is extended along the traveling direction of the helical air current.

12. An air curtain apparatus that forms an air curtain, comprising:

a plurality of first blowers that is arrayed in an up-down direction, and each include a first air inlet port in which air is sucked in and a first air outlet port from which the air is blown out; and a plurality of second blowers that is arrayed in the up-down direction, each includes a second air inlet port in which air is sucked in and a second air outlet port from which the air is blown out, and, in a plan view, the second air inlet port each faces the first air outlet port included in each of the plurality of first blowers, wherein in a pair of the first blower and the second blower, the first blower blows out a helical air current from the first air outlet port included in the first blower toward the second air inlet port included in the second blower, the second blower sucks in the helical air current blown out by the first blower from the second air inlet port included in the second blower, and the air curtain apparatus forms the air curtain of a plurality of the helical air currents, the plurality of helical air currents being blown out from the plurality of first air outlet ports each included in each of the plurality of first blowers and sucked into the plurality of second air inlet ports each included in each of the plurality of second blowers, and wherein at least any one of the first blower and the second blower further comprises an identification member that makes it possible to visually identify the traveling direction of the helical air current, the identification member includes a strip-shaped member, being deformable in any of an elongated state in which a plurality of short members is connected and a folded state; and a placement part in which a predetermined region of the strip-shaped member in the elongated state is placed, and the strip-shaped member extends along the traveling direction of the helical air current in the elongated state.

13. An air curtain apparatus that forms an air curtain, comprising:

a plurality of first blowers that is arrayed in an up-down direction, and each include a first air inlet port in which air is sucked in and a first air outlet port from which the air is blown out; and a plurality of second blowers that is arrayed in the up-down direction, each includes a second air inlet port in which air is sucked in and a second air outlet port from which the air is blown out, and, in a plan view, the second air inlet port each faces the first air outlet port included in each of the plurality of first blowers, wherein in a pair of the first blower and the second blower, the first blower blows out a helical air current from the first air outlet port included in the first blower toward the second air inlet port included in the second blower, the second blower sucks in the helical air current blown out by the first blower from the second air inlet port included in the second blower, and the air curtain apparatus forms the air curtain of a plurality of the helical air currents, the plurality of helical air currents being blown out from the plurality of first air outlet ports each included in each of the plurality of first blowers and sucked into the plurality of second air inlet ports each included in each of the plurality of second blowers, and wherein at least any one of the first blower and the second blower further comprises an identification member that makes it possible to visually identify the traveling direction of the helical air current, the identification member comprises a stretchable member including a plurality of cylindrical members of varying diameters arranged concentrically, and a placement part where a predetermined region of the stretchable member in a stretched state is placed, and the stretchable member extends along the traveling direction of the helical air current in the stretched state.

14. An air curtain apparatus that forms an air curtain, comprising:

a plurality of first blowers that is arrayed in an up-down direction, and each include a first air inlet port in which air is sucked in and a first air outlet port from which the air is blown out; and a plurality of second blowers that is arrayed in the up-down direction, each includes a second air inlet port in which air is sucked in and a second air outlet port from which the air is blown out, and, in a plan view, the second air inlet port each faces the first air outlet port included in each of the plurality of first blowers, wherein in a pair of the first blower and the second blower, the first blower blows out a helical air current from the first air outlet port included in the first blower toward the second air inlet port included in the second blower, the second blower sucks in the helical air current blown out by the first blower from the second air inlet port included in the second blower, and the air curtain apparatus forms the air curtain of a plurality of the helical air currents, the plurality of helical air currents being blown out from the plurality of first air outlet ports each included in each of the plurality of first blowers and sucked into the plurality of second air inlet ports each included in each of the plurality of second blowers, and wherein at least any one of the first blower and the second blower further comprises an identification member that makes it possible to visually identify the traveling direction of the helical air current, the identification member comprises a scope unit, the scope unit being arranged in one of the first blower and the second blower and capable of visually recognizing an object present in a direction along the traveling direction of the helical air current.

15. An air curtain apparatus that forms an air curtain, comprising:

a plurality of first blowers that is arrayed in an up-down direction, and each include a first air inlet port in which air is sucked in and a first air outlet port from which the air is blown out; and a plurality of second blowers that is arrayed in the up-down direction, each includes a second air inlet port in which air is sucked in and a second air outlet port from which the air is blown out, and, in a plan view, the second air inlet port each faces the first air outlet port included in each of the plurality of first blowers, wherein in a pair of the first blower and the second blower, the first blower blows out a helical air current from the first air outlet port included in the first blower toward the second air inlet port included in the second blower, the second blower sucks in the helical air current blown out by the first blower from the second air inlet port included in the second blower, and the air curtain apparatus forms the air curtain of a plurality of the helical air currents, the plurality of helical air currents being blown out from the plurality of first air outlet ports each included in each of the plurality of first blowers and sucked into the plurality of second air inlet ports each included in each of the plurality of second blowers, and wherein at least any one of the first blower and the second blower further comprises an identification member that makes it possible to visually identify the traveling direction of the helical air current, the identification member comprises an elongated bag-shaped member, a base end of the elongated bag-shaped member being opened and a termination of the elongated bag-shaped member being closed; and a linear spring member fixed to the bag-shaped member and deforming the bag-shaped member into a wrapped state, and the bag-like member is arranged so that the base end faces the first blower and extends along the traveling direction of the helical air current, by air from the first blower flowing in from the base end.

16. An air curtain apparatus that forms an air curtain, comprising:

a plurality of first blowers that is arrayed in an up-down direction, and each include a first air inlet port in which air is sucked in and a first air outlet port from which the air is blown out; and a plurality of second blowers that is arrayed in the up-down direction, each includes a second air inlet port in which air is sucked in and a second air outlet port from which the air is blown out, and, in a plan view, the second air inlet port each faces the first air outlet port included in each of the plurality of first blowers, wherein in a pair of the first blower and the second blower, the first blower blows out a helical air current from the first air outlet port included in the first blower toward the second air inlet port included in the second blower, the second blower sucks in the helical air current blown out by the first blower from the second air inlet port included in the second blower, and the air curtain apparatus forms the air curtain of a plurality of the helical air currents, the plurality of helical air currents being blown out from the plurality of first air outlet ports each included in each of the plurality of first blowers and sucked into the plurality of second air inlet ports each included in each of the plurality of second blowers, and wherein the air curtain apparatus has a controller that drives and controls the first blower and the second blower, the plurality of first blowers is juxtaposed in an upper part of an indoor space, and the plurality of second blowers is juxtaposed in a lower part of an indoor space, wherein in the plurality of first blowers and the plurality of second blowers, the controller selects a plurality of predetermined pairs, the predetermined pairs being pairs of predetermined first blowers of the plurality of first blowers and predetermined second blowers facing the predetermined first blowers, and drives and controls the selected first blowers and second blowers.

17. The air curtain apparatus according to claim 16, wherein the air curtain apparatus further includes a position sensing apparatus that senses a position of a mobile object in the indoor space, and the controller obtains positional information of a mobile object from the position sensing apparatus, selects the plurality of the predetermined pairs that are located at a certain distance from the mobile object, and drives and controls the first blower and the second blower that constitute the selected predetermined pairs.

18. The air curtain apparatus according to claim 17, wherein the plurality of first blowers and the plurality of second blowers are arranged in a matrix in the indoor space.

19. The air curtain apparatus according to claim 18, wherein the controller selects a plurality of the predetermined pairs located in a predetermined radius from the mobile object, and forms a cylindrical air curtain surrounding the mobile object.

20. The air curtain apparatus according to claim 17, wherein the plurality of first blowers and the plurality of second blowers are arranged in a grid pattern in the indoor space.

21. The air curtain apparatus according to claim 20, wherein the controller is able to collectively select the plurality of first blowers and the plurality of second blowers aligned on an individual line of four lines that form one grid.

22. The air curtain apparatus according to claim 17, wherein the controller forms an air curtain surrounding a plurality of mobile objects in a case where the plurality of mobile objects sensed by the position sensing apparatus mutually has a group relationship, and a distance between the respective mobile objects is closer than a predetermined distance.

23. The air curtain apparatus according to claim 17, wherein the controller updates the positional information for every predetermined period, and selects the plurality of predetermined pairs on the basis of the updated positional information.

24. The air curtain apparatus according to claim 17, wherein the controller selects the plurality of predetermined pairs, the predetermined pairs being able to configure an air curtain that separates only a specific mobile object in a case where there is the specific mobile object for one or more mobile objects located at a position corresponding to the positional information obtained by the position sensing apparatus, the controller drives and controls the first blower and the second blower that constitute the selected predetermined pair, and the second blower sucks in, from the second air inlet port included in the second blower, the helical air current blown out from the first blower located vertically above.

25. The air curtain apparatus according to claim 24, further including:

guide means that is able to guide to a specific position in the certain space with respect to the specific mobile object.

26. The air curtain apparatus according to claim 16, further including:

marker means that is able to notify a position that differs from a position of an air curtain formed in a direction from the first blower to the second flower, the first blower and the second blower being selected by the controller.

* * * * *